US010304385B2

(12) United States Patent
Takizawa et al.

(10) Patent No.: US 10,304,385 B2
(45) **Date of Patent: *May 28, 2019**

(54) DISPLAY DEVICE

(71) Applicant: SHARP KABUSHIKI KAISHA, Sakai, Osaka (JP)

(72) Inventors: Kazuo Takizawa, Sakai (JP); Noritaka Kishi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/042,345

(22) Filed: Jul. 23, 2018

(65) Prior Publication Data

US 2018/0350301 A1 Dec. 6, 2018

Related U.S. Application Data

(62) Division of application No. 15/124,202, filed as application No. PCT/JP2015/058891 on Mar. 24, 2015, now Pat. No. 10,062,326.

(30) Foreign Application Priority Data

Mar. 31, 2014 (JP) ..... 2014-071298

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0809* (2013.01);
(Continued)

(58) Field of Classification Search
None
See application file for complete search history.

(56) References Cited

U.S. PATENT DOCUMENTS 9,041,628 B2 5/2015 Yamashita et al.
10,062,326 B2 * 8/2018 Takizawa ..... G09G 3/3233
(Continued)

FOREIGN PATENT DOCUMENTS

CN 102222463 A 10/2011
JP 2002-278514 A 9/2002
(Continued)

OTHER PUBLICATIONS

Non-Final Office Action dated Nov. 14, 2017 for U.S. Appl. No. 15/124,202.

*Primary Examiner* — Kenneth B Lee, Jr.
(74) *Attorney, Agent, or Firm* — ScienBiziP, P.C.

(57) ABSTRACT

An object of the present invention is to implement a display device capable of compensating for degradation of circuit elements without causing a grayscale failure. Based on the results of detection of characteristics of drive transistors and organic EL elements, a control circuit (20) finds magnitudes of threshold shifts of the drive transistors and the organic EL elements. A power supply voltage control unit (201) sets a value of a low-level power supply voltage (ELVSS) to a value lower, by a voltage value corresponding to an average value of the magnitudes of the threshold shifts for all pixels, than a value at an initial point in time. Furthermore, the power supply voltage control unit (201) adjusts a value of a high-level power supply voltage (ELVDD), depending on magnitudes of mobilities obtained by detection of characteristics of the drive transistors.

16 Claims, 37 Drawing Sheets

(52) U.S. Cl.
CPC ..... *G09G 2300/0819* (2013.01); *G09G 2310/0289* (2013.01); *G09G 2310/08* (2013.01); *G09G 2320/0233* (2013.01); *G09G 2320/0295* (2013.01); *G09G 2320/043* (2013.01); *G09G 2320/046* (2013.01); *G09G 2330/021* (2013.01); *G09G 2330/028* (2013.01)

(56) References Cited

U.S. PATENT DOCUMENTS

| | | | |
|---|---|---|---|
| 2009/0303163 | A1 | 12/2009 | Kohno et al. |
| 2011/0157134 | A1 | 6/2011 | Ogura |
| 2011/0254871 | A1 | 10/2011 | Yoo et al. |
| 2012/0138922 | A1 | 6/2012 | Yamazaki et al. |
| 2012/0162280 | A1 | 6/2012 | Yamashita et al. |
| 2012/0299973 | A1 | 11/2012 | Jaffari et al. |

FOREIGN PATENT DOCUMENTS

| | | | |
|---|---|---|---|
| JP | 2009-294371 | A | 12/2009 |
| JP | 2011-154348 | A | 8/2011 |
| JP | 2012-134475 | A | 7/2012 |
| JP | 2012-141334 | A | 7/2012 |
| WO | 2012/160424 | A1 | 11/2012 |

* cited by examiner

Fig.7

| | CHARACTERISTIC DETECTION OPERATION | NORMAL OPERATION |
|---|---|---|
| (k+1)TH FRAME | FIRST ROW | SECOND TO nTH ROWS |
| (k+2)TH FRAME | SECOND ROW | FIRST ROW AND THIRD TO nTH ROWS |
| (k+3)TH FRAME | THIRD ROW | FIRST AND SECOND ROWS AND FOURTH TO nTH ROWS |
| ⋮ | ⋮ | ⋮ |
| (k+n)TH FRAME | nTH ROW | FIRST TO (n-1)TH ROWS |

Fig.28

| TEMPERATURE | THRESHOLD VOLTAGE |
|---|---|
| ..... | ..... |
| ..... | ..... |
| ..... | ..... |
| ⋮ | ⋮ |
| ..... | ..... |
| ..... | ..... |
| ..... | ..... |

Fig.29

| TEMPERATURE | MOBILITY |
|---|---|
| ..... | ..... |
| ..... | ..... |
| ..... | ..... |
| ⋮ | ⋮ |
| ..... | ..... |
| ..... | ..... |
| ..... | ..... |

DISPLAY DEVICE

The present application is a divisional application of U.S. patent application Ser. No. 15/124,202, filed on Sep. 7, 2016, which is the U.S. national phase of International Application No. PCT/JP2015/058891 filed Mar. 24, 2015, which designated the U.S. and claims priority to Japanese Patent Application No. 2014-071298 filed in Japan on Mar. 31, 2014. The entire disclosure of such parent application is incorporated herein by reference.

TECHNICAL FIELD

The present invention relates to a display device and a method for driving the same, and more specifically to a display device provided with a pixel circuit including an electrooptical element such as an organic EL (Electro Luminescence) element, and a method for driving the same.

BACKGROUND ART

As a display element provided in a display device, there have hitherto been an electrooptical element whose luminance is controlled by an applied voltage, and an electrooptical element whose luminance is controlled by a flowing current. Examples of the electrooptical element whose luminance is controlled by an applied voltage include a liquid crystal display element. Meanwhile, examples of the electrooptical element whose luminance is controlled by a flowing current include an organic EL element. The organic EL element is also called an OLED (Organic Light-Emitting Diode). An organic EL display device that uses the organic EL element being a spontaneous electrooptical element can be easily reduced in thickness and power consumption and increased in luminance as compared to the liquid crystal display device that requires a backlight, a color filter and the like. Hence in recent years, development of the organic EL display device has been actively advanced.

As drive systems for the organic EL display device, a passive matrix system (also called simple matrix system) and an active matrix system are known. As for an organic EL display device employing the passive matrix system, its structure is simple, but a large size and high definition are difficult to achieve. In contrast, as for an organic EL display device employing the active matrix system (hereinafter referred to as an "active matrix-type organic EL display device"), a large size and high definition can be easily realized as compared to the organic EL display device employing the passive matrix system.

In the active matrix-type organic EL display device, a plurality of pixel circuits are formed in a matrix form. The pixel circuit of the active matrix-type organic EL display device typically includes an input transistor for selecting a pixel and a drive transistor for controlling supply of a current to the organic EL element. It is to be noted that in the following, a current that flows from the drive transistor to the organic EL element may be referred to as a "drive current".

FIG. 36 is a circuit diagram showing a configuration of a conventional general pixel circuit 91. This pixel circuit 91 is provided corresponding to each of intersections of a plurality of data lines S and a plurality of scanning lines G which are disposed in a display portion. As shown in FIG. 36, this pixel circuit 91 is provided with two transistors T1 and T2, one capacitor Cst, and one organic EL element OLED. The transistor T1 is an input transistor, and the transistor T2 is a drive transistor.

The transistor T1 is provided between the data line S and a gate terminal of the transistor T2. As for the transistor T1, a gate terminal is connected to the scanning line G, and a source terminal is connected to the data line S. The transistor T2 is provided in series with the organic EL element OLED. As for the transistor T2, a drain terminal is connected to a power supply line that supplies a high-level power supply voltage ELVDD, and a source terminal is connected to an anode terminal of the organic EL element OLED. It should be noted that, the power supply line that supplies the high-level power supply voltage ELVDD is referred to as a "high-level power supply line" in the following, and the high-level power supply line is added with the same symbol ELVDD as that of the high-level power supply voltage. As for the capacitor Cst, one end is connected to the gate terminal of the transistor T2, and the other end is connected to the source terminal of the transistor T2. A cathode terminal of the organic EL element OLED is connected to a power supply line that supplies a low-level power supply voltage ELVSS. It should be noted that, the power supply line that supplies the low-level power supply voltage ELVSS is referred to as a "low-level power supply line" in the following, and the low-level power supply line is added with the same symbol ELVSS as that of the low-level power supply voltage. Further, here, a contact point of the gate terminal of the transistor T2, the one end of the capacitor Cst, and the drain terminal of the transistor T1 is referred to as a "gate node VG" for the sake of convenience. It is to be noted that, although one having a higher potential between a drain and a source is generally called a drain, in descriptions of the present specification, one is defined as a drain and the other is defined as a source, and hence a source potential may become higher than a drain potential.

FIG. 37 is a timing chart for explaining an operation of the pixel circuit 91 shown in FIG. 36. Before time t1, the scanning line G is in a non-selected state. Therefore, before the time t1, the transistor T1 is in an off state, and a potential of the gate node VG is held at an initialization level (e.g., a level in accordance with writing in the last frame). At the time t1, the scanning line G comes into a selected state and the transistor T1 is turned on. Thereby, a data voltage Vdata corresponding to a luminance of a pixel (sub-pixel) formed by this pixel circuit 91 is supplied to the gate node VG via the data line S and the transistor T1. Thereafter, in a period till time t2, the potential of the gate node VG changes in accordance with the data voltage Vdata. At this time, the capacitor Cst is charged with a gate-source voltage Vgs which is a difference between the potential of the gate node VG and a source potential of the transistor T2. At the time t2, the scanning line G comes into the non-selected state. Thereby, the transistor T1 is turned off and the gate-source voltage Vgs held by the capacitor Cst is determined. The transistor T2 supplies a drive current to the organic EL element OLED in accordance with the gate-source voltage Vgs held by the capacitor Cst. As a result, the organic EL element OLED emits light with a luminance in accordance with the drive current.

Meanwhile, the organic EL display device typically adopts a thin film transistor (TFT) as a drive transistor. However, the thin film transistor is likely to have variations in its characteristics. Specifically, variations in threshold voltage and mobility are likely to occur. When the drive transistors provided in the display unit have variations in threshold voltage and mobility, variations occur in luminance, degrading display quality. In addition, the threshold voltage and mobility also change by temperature. Furthermore, regarding the organic EL element, current efficiency (light emission efficiency) decreases with the passage of time. Therefore, even when a constant current is supplied to the organic EL element, the luminance gradually decreases with the passage of time. As a result, burn-in occurs.

Hence, conventionally, regarding an organic EL display device, there is proposed a technique for compensating for degradation of circuit elements such as drive transistors and organic EL elements. For example, Japanese Patent Application Laid-Open No. 2009-294371 discloses a technique for correcting an image voltage based on a difference between a reference voltage and the image voltage, etc.

PRIOR ART DOCUMENT

Patent Document

[Patent Document 1] Japanese Patent Application Laid-Open No. 2009-294371

SUMMARY OF THE INVENTION

Problems to be Solved by the Invention

According to the conventional art, however, even when a data voltage is corrected to compensate for degradation of circuit elements, the corrected data voltage may exceed a range of voltage outputtable by a source driver (hereinafter, referred to as "driver output range"). In such a case, desired compensation for degradation is not performed and accordingly desired grayscale display is not performed, which will be described in detail below.

In an organic EL display device, as described above, a high-level power supply voltage ELVDD and a low-level power supply voltage ELVSS are supplied as power supply voltages into a pixel circuit. In addition, a data voltage is supplied into the pixel circuit from a source driver. For example, in the case of an organic EL display device capable of performing 256-level grayscale display, data voltages of 256 levels are outputted from the source driver. Note that in the present specification, a range of data voltage required to perform desired grayscale display is referred to as "grayscale voltage range", and the magnitude between the upper and lower limits of the grayscale voltage range is referred to as "grayscale voltage width".

FIG. 38 is a diagram showing an example of a relationship among the high-level power supply voltage ELVDD, low-level power supply voltage ELVSS, driver output range, and grayscale voltage range of an organic EL display device capable of performing 256-level grayscale display for an initial state. Note that the lower limit of the driver output range is represented by reference character VL, the upper limit of the driver output range is represented by reference character VH, the voltage corresponding to a grayscale value of 0 is represented by V(0), and the voltage corresponding to a grayscale value of 255 is represented by V(255). In addition, the threshold voltage of a drive transistor in a pixel for an initial state is represented by reference character Vth0. As shown in FIG. 38, in the initial state, the grayscale voltage range is completely included in the driver output range.

Now, focusing on a given pixel, it is assumed that the threshold voltage of a drive transistor in the pixel gradually increases as shown in FIG. 39. At point in time t0 (initial point in time), the grayscale voltage range is completely included in the driver output range (the range from VL to VH). At point in time t01, when the threshold voltage of the drive transistor increases by ΔVth (t01) from the initial point in time, data voltages corresponding to the respective grayscale values also increase by ΔVth(t01) from the initial point in time. Therefore, the grayscale voltage range wholly increases by ΔVth(t01) from the initial point in time. Note that at this point in time t01, too, the grayscale range is completely included in the driver output range. At point in time t02, when the threshold voltage of the drive transistor increases by ΔVth (t02) from the initial point in time, the data voltages corresponding to the respective grayscale values also increase by ΔVth(t02) from the initial point in time. Therefore, the grayscale voltage range wholly increases by ΔVth (t02) from the initial point in time. At this point in time t02, a high-grayscale portion of the grayscale voltage range exceeds the driver output range. In the present specification, the fact that a corrected data voltage for compensating for degradation of circuit elements thus goes out of the driver output range is referred to as "grayscale failure". At point in time t02 in FIG. 39, since a grayscale failure occurs at the high-grayscale portion, high grayscale is not displayed properly. As described above, according to the conventional art, a grayscale failure may occur due to the limitation of the driver output range and accordingly desired grayscale display may not be performed.

An object of the present invention is therefore to implement a display device capable of compensating for degradation of circuit elements without causing a grayscale failure.

Means for Solving the Problems

A first aspect of the present invention is directed to a display device including a plurality of pixel circuits, each including an electrooptical element whose luminance is controlled by a current, and a drive transistor configured to control a current to be supplied to the electrooptical element, the display device including:

a plurality of data lines configured to supply data voltages for grayscale display to the plurality of pixel circuits;

a data line drive circuit configured to apply the data voltages to the plurality of data lines;

an amount-of-threshold-voltage-change obtaining unit configured to find an amount of change in threshold voltage of a target circuit element, at least either one of the drive transistor and the electrooptical element serving as the target circuit element; and a power supply voltage control unit configured to control a value of at least a low-level power supply voltage out of the low-level power supply voltage and a high-level power supply voltage that are supplied to the plurality of pixel circuits, wherein in each of the plurality of pixel circuits, a data voltage supplied by a corresponding data line is provided to a control terminal of the drive transistor, the high-level power supply voltage is provided to a first conduction terminal of the drive transistor, a second conduction terminal of the drive transistor is connected to an anode of the electrooptical element, and the low-level power supply voltage is provided to a cathode of the electrooptical element, and the power supply voltage control unit controls the value of the low-level power supply voltage, depending on the amount of change found by the amount-of-threshold-voltage-change obtaining unit.

According to a second aspect of the present invention, in the first aspect of the present invention, the display device further includes a characteristic detecting unit configured to detect a characteristic of the target circuit element and find a threshold voltage of the target circuit element based on results of the detection, wherein the amount-of-threshold-voltage-change obtaining unit finds an amount of change in threshold voltage of the target circuit element, based on a threshold voltage found by the characteristic detecting unit.

According to a third aspect of the present invention, in the second aspect of the present invention, the amount-of-threshold-voltage-change obtaining unit finds an amount of change in threshold voltage of the target circuit element, based on a difference between a threshold voltage of the target circuit element at a predetermined reference time and a threshold voltage of the target circuit element at a point in time when characteristic detection by the characteristic detecting unit is performed.

According to a fourth aspect of the present invention, in the second aspect of the present invention, the display device further includes a dummy circuit element, drive operation of which is not performed, the dummy circuit element being of a same type as the target circuit element, wherein the amount-of-threshold-voltage-change obtaining unit finds an amount of change in threshold voltage of the target circuit element, based on a difference between a threshold voltage of the target circuit element found based on the results of the characteristic detection by the characteristic detecting unit and a threshold voltage of the dummy circuit element.

According to a fifth aspect of the present invention, in the first aspect of the present invention, the display device further includes a temperature detecting unit configured to detect a temperature, wherein the amount-of-threshold-voltage-change obtaining unit finds an amount of change in threshold voltage of the target circuit element, based on a temperature detected by the temperature detecting unit.

According to a sixth aspect of the present invention, in the first aspect of the present invention, when values of the amount of change found by the amount-of-threshold-voltage-change obtaining unit are defined as calculated values of change, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the low-level power supply voltage to a value lower, by a voltage value corresponding to the representative value, than a value at a reference time.

According to a seventh aspect of the present invention, in the sixth aspect of the present invention, the amount-of-threshold-voltage-change obtaining unit finds amounts of change in threshold voltages of both the drive transistor and the electrooptical element as target circuit elements, and the power supply voltage control unit sets the value of the low-level power supply voltage to a value lower, by a voltage value corresponding to a sum of the representative value for the drive transistors and the representative value for the electrooptical elements, than the value at the reference time.

According to an eighth aspect of the present invention, in the first aspect of the present invention, when values of the amount of change found by the amount-of-threshold-voltage-change obtaining unit are defined as calculated values of change, the power supply voltage control unit sets the value of the low-level power supply voltage to a value lower, by a voltage value corresponding to a maximum value of the calculated values of change for the plurality of pixel circuits, than a value at a reference time.

According to a ninth aspect of the present invention, in the eighth aspect of the present invention, the amount-of-threshold-voltage-change obtaining unit finds amounts of change in threshold voltages of both the drive transistor and the electrooptical element as target circuit elements, and the power supply voltage control unit sets the value of the low-level power supply voltage to a value lower, by a voltage value corresponding to a sum of a maximum value of the calculated values of change for the drive transistors and a maximum value of the calculated values of change for the electrooptical elements, than the value at the reference time.

According to a tenth aspect of the present invention, in the first aspect of the present invention, when values of the amount of change found by the amount-of-threshold-voltage-change obtaining unit are defined as calculated values of change, the power supply voltage control unit sets the value of the low-level power supply voltage to a value lower, by a voltage value corresponding to a minimum value of the calculated values of change for the plurality of pixel circuits, than a value at a reference time.

According to an eleventh aspect of the present invention, in the tenth aspect of the present invention, the amount-of-threshold-voltage-change obtaining unit finds amounts of change in threshold voltages of both the drive transistor and the electrooptical element as target circuit elements, and the power supply voltage control unit sets the value of the low-level power supply voltage to a value lower, by a voltage value corresponding to a sum of a minimum value of the calculated values of change for the drive transistors and a minimum value of the calculated values of change for the electrooptical elements, than the value at the reference time.

According to a twelfth aspect of the present invention, in the first aspect of the present invention, when values of the amount of change found by the amount-of-threshold-voltage-charge obtaining unit are defined as calculated values of change, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the low-level power supply voltage to a value lower by a voltage value than a value at a reference time, the voltage value being determined based on a relationship among the representative value, the maximum value of the calculated values of change for the plurality of pixel circuits, a range of data voltage that can be supplied by the data line drive circuit to the plurality of pixel circuits, and a range of voltage required for grayscale display.

According to a thirteenth aspect of the present invention, in the first aspect of the present invention, when values of the amount of change found by the amount-of-threshold-voltage-change obtaining unit are defined as calculated values of change, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the low-level power supply voltage to a value lower by a voltage value than a value at a reference time, the voltage value being determined based on a relationship among the representative value, the maximum value of the calculated values of change for the plurality of pixel circuits, the minimum value of the calculated values of change for the plurality of pixel circuits, a range of data voltage that can be supplied by the data line drive circuit to the plurality of pixel circuits, and a range of voltage required for grayscale display.

According to a fourteenth aspect of the present invention, in the first aspect of the present invention, the display device further includes a mobility obtaining unit configured to find a mobility of the drive transistor, wherein the power supply voltage control unit controls a value of the high-level power supply voltage, depending on the mobility found by the mobility obtaining unit.

According to a fifteenth aspect of the present invention, in the fourteenth aspect of the present invention, the power supply voltage control unit controls a value Vh of the high-level power supply voltage to satisfy a following expression:

$$Vh > V1 + V\max + (2 \times I\max/\beta)^{1/2}$$

where V1 is a value of the low-level power supply voltage, Vmax is a maximum value of voltages applied between the anode and cathode of the electrooptical element, Imax is a maximum value of currents flowing between the anode and cathode of the electrooptical element, and β is a gain value proportional to the mobility found by the mobility obtaining unit.

According to a sixteenth aspect of the present invention, in the first aspect of the present invention, the power supply voltage control unit changes a value of the high-level power supply voltage in a same direction as a direction in which a value of the low-level power supply voltage changes and by a same value as a changed value of the low-level power supply voltage.

A seventeenth aspect of the present invention is directed to a display device including a plurality of pixel circuits, each including an electrooptical element whose luminance is controlled by a current, and a drive transistor configured to control a current to be supplied to the electrooptical element, the display device including:

a plurality of data lines configured to supply data voltages for grayscale display to the plurality of pixel circuits;

a data line drive circuit configured to apply the data voltages to the plurality of data lines;

an amount-of-threshold-voltage-change obtaining unit configured to find an amount of change in threshold voltage of a target circuit element, at least either one of the drive transistor and the electrooptical element serving as the target circuit element; and a power supply voltage control unit configured to control at least a value of a first power supply voltage, the first power supply voltage being one of a first-level voltage and a second-level voltage, and the first-level voltage and the second-level voltage being supplied to the plurality of pixel circuits, wherein in each of the plurality of pixel circuits, a data voltage supplied by a corresponding data line is provided to a control terminal of the drive transistor, the second-level voltage is provided to a first conduction terminal of the drive transistor, a second conduction terminal of the drive transistor is connected to one electrode of the electrooptical element, and the first-level voltage is provided to an other electrode of the electrooptical element, and the power supply voltage control unit controls the value of the first power supply voltage, depending on the amount of change found by the amount-of-threshold-voltage-change obtaining unit.

According to an eighteenth aspect of the present invention, in the seventeenth aspect of the present invention, the display device further includes a characteristic detecting unit configured to detect a characteristic of the target circuit element and find a threshold voltage of the target circuit element based on results of the detection, wherein the amount-of-threshold-voltage-change obtaining unit finds an amount of change in threshold voltage of the target circuit element, based on a threshold voltage found by the characteristic detecting unit.

According to a nineteenth aspect of the present invention, in the eighteenth aspect of the present invention, the amount-of-threshold-voltage-change obtaining unit finds an amount of change in threshold voltage of the target circuit element, based on a difference between a threshold voltage of the target circuit element at a predetermined reference time and a threshold voltage of the target circuit element at a point in time when characteristic detection by the characteristic detecting unit is performed.

According to a twentieth aspect of the present invention, in the eighteenth aspect of the present invention, the display device further includes a dummy circuit element, drive operation of which is not performed, the dummy circuit element being of a same type as the target circuit element, wherein the amount-of-threshold-voltage-change obtaining unit finds an amount of change in threshold voltage of the target circuit element, based on a difference between a threshold voltage of the target circuit element found based on the results of the characteristic detection by the characteristic detecting unit and a threshold voltage of the dummy circuit element.

According to a twenty-first aspect of the present invention, in the seventeenth aspect of the present invention, the display device further includes a temperature detecting unit configured to detect a temperature, wherein the amount-of-threshold-voltage-change obtaining unit finds an amount of change in threshold voltage of the target circuit element, based on a temperature detected by the temperature detecting unit.

According to a twenty-second aspect of the present invention, in the seventeenth aspect of the present invention, when values of the amount of change found by the amount-of-threshold-voltage-change obtaining unit are defined as calculated values of change, and one of the first-level voltage and the second-level voltage that is different than the first power supply voltage is defined as a second power supply voltage, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the first power supply voltage to a value such that a difference between the first power supply voltage and the second power supply voltage is larger, by a voltage value corresponding to the representative value, than a value at a reference time.

According to a twenty-third aspect of the present invention, in the twenty-second aspect of the present invention, the amount-of-threshold-voltage-change obtaining unit finds amounts of change in threshold voltages of both the drive transistor and the electrooptical element as target circuit elements, and the power supply voltage control unit sets the value of the first power supply voltage to a value such that the difference between the first power supply voltage and the second power supply voltage is larger, by a voltage value corresponding to a sum of the representative value for the drive transistors and the representative value for the electrooptical elements, than the value at the reference time.

According to a twenty-fourth aspect of the present invention, in the seventeenth aspect of the present invention, when values of the amount of change found by the amount-of-threshold-voltage-change obtaining unit are defined as calculated values of change and one of the first-level voltage and the second-level voltage that is different than the first power supply voltage is defined as a second power supply voltage, the power supply voltage control unit sets the value of the first power supply voltage to a value such that a difference between the first power supply voltage and the second power supply voltage is larger, by a voltage value corresponding to a maximum value of the calculated values of change for the plurality of pixel circuits, than a value at a reference time.

According to a twenty-fifth aspect of the present invention, in the twenty-fourth aspect of the present invention, the amount-of-threshold-voltage-change obtaining unit finds amounts of change in threshold voltages of both the drive transistor and the electrooptical element as target circuit elements, and the power supply voltage control unit sets the value of the first power supply voltage to a value such that the difference between the first power supply voltage and the second power supply voltage is larger, by a voltage value corresponding to a sum of a maximum value of the calculated values of change for the drive transistors and a maximum value of the calculated values of change for the electrooptical elements, than the value at the reference time.

According to a twenty-sixth aspect of the present invention, in the seventeenth aspect of the present invention, when values of the amount of change found by the amount-of-threshold-voltage-change obtaining unit are defined as calculated values of change and one of the first-level voltage and the second-level voltage that is different than the first power supply voltage is defined as a second power supply voltage, the power supply voltage control unit sets the value of the first power supply voltage to a value such that a difference between the first power supply voltage and the second power supply voltage is larger, by a voltage value corresponding to a minimum value of the calculated values of change for the plurality of pixel circuits, than a value at a reference time.

According to a twenty-seventh aspect of the present invention, in the twenty-sixth aspect of the present invention, the amount-of-threshold-voltage-change obtaining unit finds amounts of change in threshold voltages of both the drive transistor and the electrooptical element as target circuit elements, and the power supply voltage control unit sets the value of the first power supply voltage to a value such that the difference between the first power supply voltage and the second power supply voltage is larger, by a voltage value corresponding to a sum of a minimum value of the calculated values of change for the drive transistors and a minimum value of the calculated values of change for the electrooptical elements, than the value at the reference time.

According to a twenty-eighth aspect of the present invention, in the seventeenth aspect of the present invention, when values of the amount of change found by the amount-of-threshold-voltage-change obtaining unit are defined as calculated values of change, and one of the first-level voltage and the second-level voltage that is different than the first power supply voltage is defined as a second power supply voltage, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the first power supply voltage to a value such that a difference between the first power supply voltage and the second power supply voltage is larger by a voltage value than a value at a reference time, the voltage value being determined based on a relationship among the representative value, the maximum value of the calculated values of change for the plurality of pixel circuits, a range of data voltage that can be supplied by the data line drive circuit to the plurality of pixel circuits, and a range of voltage required for grayscale display.

According to a twenty-ninth aspect of the present invention, in the seventeenth aspect of the present invention, when values of the amount of change found by the amount-of-threshold-voltage-change obtaining unit are defined as calculated values of change, and one of the first-level voltage and the second-level voltage that is different than the first power supply voltage is defined as a second power supply voltage, and one of an average value of the calculated values of change for the plurality of pixel circuits, an average value of a maximum value and a minimum value of the calculated values of change for the plurality of pixel circuits, and a median of the calculated values of change for the plurality of pixel circuits is defined as a representative value, the power supply voltage control unit sets the value of the first power supply voltage to a value such that a difference between the first power supply voltage and the second power supply voltage is larger by a voltage value than a value at a reference time, the voltage value being determined based on a relationship among the representative value, the maximum value of the calculated values of change for the plurality of pixel circuits, the minimum value of the calculated values of change for the plurality of pixel circuits, a range of data voltage that can be supplied by the data line drive circuit to the plurality of pixel circuits, and a range of voltage required for grayscale display.

According to a thirtieth aspect of the present invention, in the seventeenth aspect of the present invention, the display device further includes a mobility obtaining unit configured to find a mobility of the drive transistor, wherein when one of the first-level voltage and the second-level voltage that is different than the first power supply voltage is defined as a second power supply voltage, the power supply voltage control unit controls a value of the second power supply voltage, depending on the mobility found by the mobility obtaining unit.

According to a thirty-first aspect of the present invention, in the thirtieth aspect of the present invention, the power supply voltage control unit controls a value V2 of the second power supply voltage to satisfy a following expression A when the value V2 of the second power supply voltage is larger than a value V1 of the first power supply voltage, and controls the value V2 of the second power supply voltage to satisfy a following expression B when the value V2 of the second power supply voltage is smaller than the value V1 of the first power supply voltage:

$$V2>V1+V\max+(2\times I\max/\beta)^{1/2} \quad (A)$$

$$V2<V1-V\max-(2\times I\max/\beta)^{1/2} \quad (B)$$

where Vmax is a maximum value of voltages applied between the one electrode and other electrode of the electrooptical element, Imax is a maximum value of currents flowing between the one electrode and other electrode of the electrooptical element, and β is a gain value proportional to the mobility found by the mobility obtaining unit.

According to a thirty-second aspect of the present invention, in the seventeenth aspect of the present invention, the power supply voltage control unit changes a value of the second power supply voltage in a same direction as a direction in which the value of the first power supply voltage changes and by a same value as a changed value of the first power supply voltage.

A thirty-third aspect of the present invention is directed to a method for driving a display device including: a plurality of pixel circuits, each including an electrooptical element whose luminance is controlled by a current, and a drive transistor configured to control a current to be supplied to the electrooptical element; a plurality of data lines configured to supply data voltages for grayscale display to the plurality of pixel circuits; and a data line drive circuit configured to apply the data voltages to the plurality of data lines, the method including:

an amount-of-threshold-voltage-change obtaining step of finding an amount of change in threshold voltage of a target circuit element, at least either one of the drive transistor and the electrooptical element serving as the target circuit element; and a power supply voltage controlling step of controlling a value of at least a low-level power supply voltage out of the low-level power supply voltage and a high-level power supply voltage that are supplied to the plurality of pixel circuits, wherein in each of the plurality of pixel circuits, a data voltage supplied by a corresponding data line is provided to a control terminal of the drive transistor, the high-level power supply voltage is provided to a first conduction terminal of the drive transistor, a second conduction terminal of the drive transistor is connected to an anode of the electrooptical element, and the low-level power supply voltage is provided to a cathode of the electrooptical element, and in the power supply voltage controlling step, the value of the low-level power supply voltage is controlled depending on the amount of change found in the amount-of-threshold-voltage-change obtaining step.

A thirty-fourth aspect of the present invention is directed to a method for driving a display device including: a plurality of pixel circuits, each including an electrooptical element whose luminance is controlled by a current, and a drive transistor configured to control a current to be supplied to the electrooptical element; a plurality of data lines configured to supply data voltages for grayscale display to the plurality of pixel circuits; and a data line drive circuit configured to apply the data voltages to the plurality of data lines, the method including:

an amount-of-threshold-voltage-change obtaining step of finding an amount of change in threshold voltage of a target circuit element, at least either one of the drive transistor and the electrooptical element serving as the target circuit element; and a power supply voltage controlling step of controlling at least a value of a first power supply voltage, the first power supply voltage being one of a first-level voltage and a second-level voltage, the first-level voltage and the second-level voltage being supplied to the plurality of pixel circuits, wherein in each of the plurality of pixel circuits, a data voltage supplied by a corresponding data line is provided to a control terminal of the drive transistor, the second-level voltage is provided to a first conduction terminal of the drive transistor, a second conduct ion terminal of the drive transistor is connected to one electrode of the electrooptical element, and the first-level voltage is provided to an other electrode of the electrooptical element, and in the power supply voltage controlling step, the value of the first power supply voltage is controlled depending on the amount of change found in the amount-of-threshold-voltage-change obtaining step.

Effects of the Invention

According to the first aspect of the present invention, with at least either one of the drive transistor and the electrooptical element serving as target circuit element, an amount of change in threshold voltage of the target circuit element is found, and the value of the low-level power supply voltage is adjusted depending on the amount of change. Hence, a grayscale voltage range (a range of data voltage required to perform desired grayscale display) can be shifted depending on the degree of change in the characteristic of the target circuit element. By this, the occurrence of a grayscale failure is prevented. In addition, since the occurrence of a grayscale failure is prevented, an effect of extending the life of the display device can also be obtained. By the above, a display device capable of compensating for changes in the characteristics of circuit elements without causing a grayscale failure is implemented.

According to the second aspect of the present invention, while a component for detecting characteristics of the circuit elements in the pixel circuits is utilized, the value of the low-level power supply voltage can be adjusted.

According to the third aspect of the present invention, a display device capable of compensating for degradation of circuit elements caused by the passage of time is implemented without causing a grayscale failure.

According to the fourth aspect of the present invention, an amount of change in threshold voltage is found based on a difference between a threshold voltage based on the results of characteristic detection and a threshold voltage of the dummy circuit element. Hence, it is possible to separately consider degradation of the circuit elements in the pixel circuits caused by an environment and caused by lighting. Then, by adjusting the value of the low-level power supply voltage using the found amount of change, and correcting video signals based on the results of characteristic detection, even when a panel's periphery condition or environment condition has been changed from an initial point in time, degradation of the circuit elements can be effectively compensated for without causing a grayscale failure.

According to the fifth aspect of the present invention, an amount of change in threshold voltage is found based on a temperature. By this, the value of the low-level power supply voltage can be adjusted without performing detection of characteristics of the drive transistors.

According to the sixth aspect of the present invention, the value of the low-level power supply voltage is set to a value lower, by a voltage value corresponding to an "average value", an "average value of a maximum value and a minimum value", or a "median" of the amounts of change in threshold voltages for all pixels, than a value at a reference time. Hence, changes in characteristics of the circuit elements can be compensated for so as to minimize the occurrence of a grayscale failure on both the high-grayscale side and the low-grayscale side.

According to the seventh aspect of the present invention, changes in characteristics of the drive transistors and the electrooptical elements can be compensated for so as to minimize the occurrence of a grayscale failure on both the high-grayscale side and the low-grayscale side.

According to the eighth aspect of the present invention, the value of the low-level power supply voltage is set to a value lower, by a voltage value corresponding to a maximum value of the amounts of change in threshold voltages for all pixels, than a value at a reference time. Hence, an upper limit of a grayscale voltage range is effectively lowered. By this, the occurrence of a grayscale failure on the high-grayscale side is effectively prevented.

According to the ninth aspect of the present invention, while the occurrence of a grayscale failure on the high-grayscale side is effectively prevented, changes in characteristics of the drive transistors and the electrooptical elements can be compensated for.

According to the tenth aspect of the present invention, the value of the low-level power supply voltage is set to a value lower, by a voltage value corresponding to a minimum value of the amounts of change in threshold voltages for all pixels, than a value at a reference time. Hence, even after an adjustment of the value of the low-level power supply voltage, a lower limit of a grayscale voltage range is maintained at as high a value as possible. By this, the occurrence of a grayscale failure on the low-grayscale side is prevented.

According to the eleventh aspect of the present invention, while the occurrence of a grayscale failure on the low-grayscale side is prevented, changes in characteristics of the drive transistors and the electrooptical elements can be compensated for.

According to the twelfth aspect of the present invention, the value of the low-level power supply voltage is adjusted taking into account various types of conditions. Hence, while the occurrence of a grayscale failure is effectively prevented, changes in characteristics of the circuit elements can be compensated for.

According to the thirteenth aspect of the present invention, as with the twelfth aspect of the present invention, while the occurrence of a grayscale failure is effectively prevented, changes in characteristics of the circuit elements can be compensated for.

According to the fourteenth aspect of the present invention, with the adjustment of the value of the low-level power supply voltage, the value of the high-level power supply voltage is also adjusted. By this, a reduction in power consumption is possible.

According to the fifteenth aspect of the present invention, the occurrence of an operation failure caused by an adjustment of the value of the high-level power supply voltage is prevented.

According to the sixteenth aspect of the present invention, with the adjustment of the value of the low-level power supply voltage, the value of the high-level power supply voltage is also adjusted. By this, a reduction in power consumption is possible.

According to the seventeenth aspect of the present invention, with at least either one of the drive transistor and the electrooptical element serving as target circuit element, an amount of change in threshold voltage of the target circuit element is found, and the value of a power supply voltage (at least one of two-level power supply voltages which are provided into the pixel circuits) is adjusted depending on the amount of change. Hence, a grayscale voltage range (a range of data voltage required to perform desired grayscale display) can be shifted depending on the degree of change in the characteristic of the target circuit element. By this, the occurrence of a grayscale failure is prevented. In addition, since the occurrence of a grayscale failure is prevented, an effect of extending the life of the display device can also be obtained. By the above, a display device capable of compensating for changes in the characteristics of circuit elements without causing a grayscale failure is implemented.

According to the eighteenth aspect of the present invention, while a component for detecting characteristics of the circuit elements in the pixel circuits is utilized, the value of the power supply voltage provided into the pixel circuits can be adjusted.

According to the nineteenth aspect of the present invention, a display device capable of compensating for degradation of circuit elements caused by the passage of time is implemented without causing a grayscale failure.

According to the twentieth aspect of the present invention, an amount of change in threshold voltage is found based on a difference between a threshold voltage based on the results of characteristic detection and a threshold voltage of the dummy circuit element. Hence, it is possible to separately consider degradation of the circuit elements in the pixel circuits caused by an environment and caused by lighting. Then, by adjusting the value of a power supply voltage (at least one of two-level power supply voltages which are provided into the pixel circuits) using the found amount of change, and correcting video signals based on the results of characteristic detection, even when a panel's periphery condition or environment condition has been changed from an initial point in time, degradation of the circuit elements can be effectively compensated for without causing a grayscale failure.

According to the twenty-first aspect of the present invention, an amount of change in threshold voltage is found based on a temperature. By this, the value of at least one of two-level power supply voltages which are provided into the pixel circuits can be adjusted without performing detection of characteristics of the drive transistors.

According to the twenty-second aspect of the present invention, the value of a first power supply voltage (one of a first-level voltage and a second-level voltage) is set to a value such that a difference between the first power supply voltage and a second power supply voltage (one of the first-level voltage and the second-level voltage that is different than the first power supply voltage) is larger, by a voltage value corresponding to an "average value", an "average value of a maximum value and a minimum value", or a "median" of the amounts of change in threshold voltages for all pixels, than a value at a reference time. Hence, changes in characteristics of the circuit elements can be compensated for so as to minimize the occurrence of a grayscale failure on both the high-grayscale side and the low-grayscale side.

According to the twenty-third aspect of the present invention, changes in characteristics of the drive transistors and the electrooptical elements can be compensated for so as to minimize the occurrence of a grayscale failure on both the high-grayscale side and the low-grayscale side.

According to the twenty-fourth aspect of the present invention, the value of the first power supply voltage is set to a value such that a difference between the first power supply voltage and the second power supply voltage is larger, by a voltage value corresponding to a maximum value of the amounts of change in threshold voltages for all pixels, than a value at a reference time. Hence, by the upper limit of a grayscale voltage range lowered, the occurrence of a grayscale failure on the high-grayscale side is effectively prevented, or by the lower limit of a grayscale voltage range raised, the occurrence of a grayscale failure on the low-grayscale side is effectively prevented.

According n to the twenty-fifth aspect of the present invention, while the occurrence of a grayscale failure on the high-grayscale side or the low-grayscale side is effectively prevented, changes in characteristics of the drive transistors and the electrooptical elements can be compensated for.

According to the twenty-sixth aspect of the present invention, the value of the first power supply voltage is set to a value such that a difference between the first power supply voltage and the second power supply voltage is larger, by a voltage value corresponding to a minimum value of the amounts of change in threshold voltages for all pixels, than a value at a reference time. Hence, even after an adjustment of the value of the first power supply voltage, a lower limit of a grayscale voltage range is maintained at as high a value as possible, or an upper limit of a grayscale voltage range is maintained at as low a value as possible. By this, the occurrence of a grayscale failure on the low-grayscale side or the high-grayscale side is prevented.

According to the twenty-seventh aspect of the present invention, while the occurrence of a grayscale failure on the low-grayscale side or the high-grayscale side is prevented, changes in characteristics of the drive transistors and the electrooptical elements can be compensated for.

According to the twenty-eighth aspect of the present invention, the value of the first power supply voltage is adjusted taking into account various types of conditions. Hence, while the occurrence of a grayscale failure is effectively prevented, changes in characteristics of the circuit elements can be compensated for.

According to the twenty-ninth aspect of the present invention, as with the twenty-eighth aspect of the present invention, while the occurrence of a grayscale failure is effectively prevented, changes in characteristics of the circuit elements can be compensated for.

According to the thirtieth aspect of the present invention, with the adjustment of the value of the first power supply voltage, the value of the second power supply voltage is also adjusted. By this, a reduction in power consumption is possible.

According to the thirty-first aspect of the present invention, the occurrence of an operation failure caused by an adjustment of the value of the second power supply voltage is prevented.

According to the thirty-second aspect of the present invention, with the adjustment of the value of the first power supply voltage, the value of the second power supply voltage is also adjusted. By this, a reduction in power consumption is possible.

According to the thirty-third aspect of the present invention, the same effects as those of the first aspect of the present invention can be provided in an invention of a method for driving a display device.

According to the thirty-fourth aspect of the present invention, the same effects as those of the seventeenth aspect of the present invention can be provided in an invention of a method for driving a display device.

BRIEF DESCRIPTION OF THE DRAWINGS

FIG. 7 is a diagram for describing the transition of operation for each row in the embodiment.

FIG. 28 is a schematic diagram showing a configuration of a TFT temperature-threshold voltage correspondence table in the sixth variant of the embodiment.

FIG. 29 is a schematic diagram showing a configuration of a TFT temperature-mobility correspondence table in the sixth variant of the embodiment.

MODE FOR CARRYING OUT THE INVENTION

One embodiment of the present invention will be described below with reference to the accompanying drawings. Note that in the following it is assumed that m and n are integers greater than or equal to 2, i is an integer between 1 and n, inclusive, and j is an integer between 1 and m, inclusive. Note also that in the following the characteristics of a drive transistor provided in a pixel circuit are referred to as "TFT characteristics", and the characteristics of an organic EL element provided in the pixel circuit are referred to as "OLED characteristics".

<1. Overall Configuration>

Figure 1:
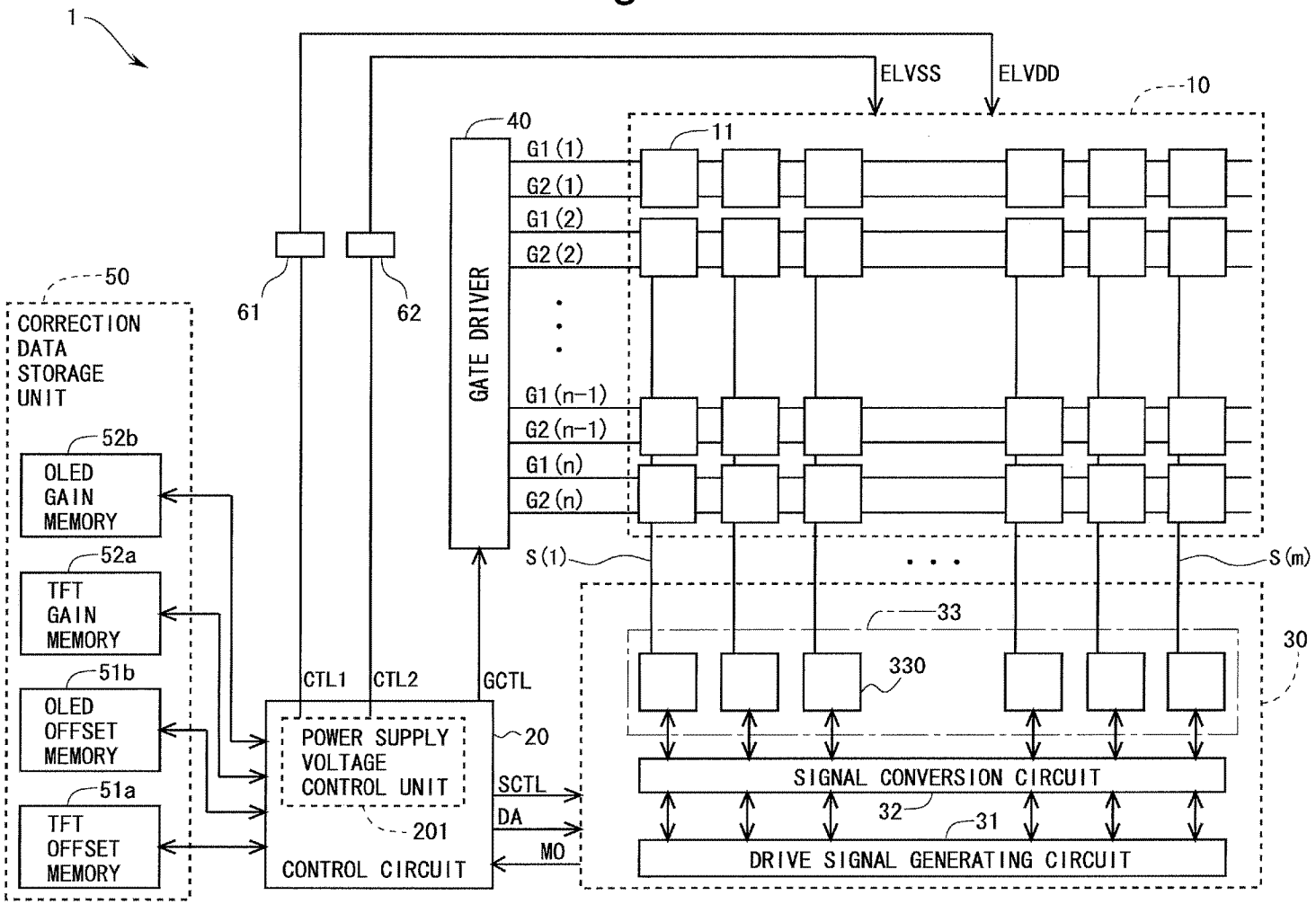
FIG. 1 is a block diagram showing an overall configuration of an active matrix-type organic EL display device according to one embodiment of the present invention.

FIG. 1 is a block diagram showing an overall configuration of an active matrix-type organic EL display device 1 according to one embodiment of the present invention. The organic EL display device 1 includes a display unit 10, a control circuit 20, a source driver (data line drive circuit) 30, a gate driver (scanning line drive circuit) 40, correction data storage unit 50, an organic EL high-level power supply 61, and an organic EL low-level power supply 62. Note that the configuration may be such that one or both of the source driver 30 and the gate driver 40 is(are) integrally formed with the display unit 10. In the present embodiment, an amount-of-threshold-voltage-change obtaining unit and a mobility obtaining unit are implemented by the control circuit 20.

In the display unit 10 there are disposed m data lines S(1) to S(m) and n scanning lines G1(1) to G1(*n*) which intersect the m data lines S(1) to S(m). In the following, a data line extension direction is a Y-direction and a scanning line extension direction is an X-direction. Components lying along the Y-direction may be referred to as "column", and components lying along the X-direction may be referred to as "row". In addition, in the display unit 10, n monitoring control lines G2(1) to G2(*n*) are disposed so as to have a one-to-one correspondence with the n scanning lines G1(1) to G1(*n*). The scanning lines G1(1) to G1(*n*) and the monitoring control lines G2(1) to G2(*n*) are parallel to each other. Furthermore, in the display unit 10, n×m pixel circuits 11 are provided at intersections of the n scanning lines G1(1) to G1(*n*) and the m data lines S(1) to S(m). By thus providing the n×m pixel circuits 11, a pixel matrix of n rows×m columns is formed in the display unit 10. In addition, in the display unit 10 there are disposed high-level power supply lines that supply a high-level power supply voltage ELVDD and low-level power supply lines that supply a low-level power supply voltage ELVSS.

Note that in the following, when the m data lines S(1) to S(m) do not need to be distinguished from each other, each of the data lines is simply represented by reference character S. Likewise, when the n scanning lines G(1) to G1(*n*) do not need to be distinguished from each other, each of the scanning line is simply represented by reference character G1, and when the n monitoring control lines G2(1) to G2(*n*) do not need to be distinguished from each other, each of the monitoring control line is simply represented by reference character G2.

The data lines S in the present embodiment are not only used as signal lines that transfer luminance signals for allowing the organic EL elements in the pixel circuits 11 to emit light at desired luminances, but also used as signal lines for providing control potentials for detecting TFT characteristics and OLED characteristics to the pixel circuits 11, and as signal lines serving as paths for currents that represent TFT characteristics and OLED characteristics and that can be measured by output and current-monitoring circuits 330 which will be described later.

The control circuit 20 controls the operation of the source driver 30 by providing data signals DA and a source control signal SCTL to the source driver 30, and controls the operation of the gate driver 40 by providing a gate control signal GCTL to the gate driver 40. The source control signal SCTL includes, for example, a source start pulse, a source clock, and a latch strobe signal. The gate control signal GCTL includes, for example, a gate start pulse, a gate clock, and an output enable signal. In addition, the control circuit 20 receives monitored data MO which is provided from the source driver 30, and performs an update to correction data stored in the correction data storage unit 50. Note that the monitored data MO is data measured to find TFT characteristics and OLED characteristics.

The control circuit 20 includes a power supply voltage control unit 201. The power supply voltage control unit 201 controls the value of the high-level power supply voltage ELVDD which is outputted from the organic EL high-level power supply 61, by providing a voltage control signal CTL1 to the organic EL high-level power supply 61, and controls the value of the low-level power supply voltage ELVSS which is outputted from the organic EL low-level power supply 62, by providing a voltage control signal CTL2 to the organic EL low-level power supply 62. Note that a detailed description of how those values are controlled will be made later.

The gate driver 40 is connected to the n scanning lines G1(1) to G1(*n*) and the n monitoring control lines G2(1) to G2(*n*). The gate driver 40 is composed of a shift register, a logic circuit, and the like. Meanwhile, in the organic EL display device 1 according to the present embodiment, video signals (base data for the above-described data signals DA) which are transmitted from an external source are corrected based on TFT characteristics and OLED characteristics. In this regard, in the present embodiment, in each frame, detection of TFT characteristics and OLED characteristics for one row is performed. Specifically, when detection of TFT characteristics and OLED characteristics for the first row is performed in a given frame, detection of TFT characteristics and OLED characteristics for the second row is performed in a subsequent frame, and detection of TFT characteristics and OLED characteristics for the third row is performed in a further subsequent frame. In this manner, detection of TFT characteristics and OLED characteristics for n rows is performed over n frame periods. Note that in this specification a row where detection of TFT characteristics and OLED characteristics is performed when focusing on any frame is referred to as "monitored row", and rows other than the monitored row are referred to as "non-monitored rows".

Figure 2:
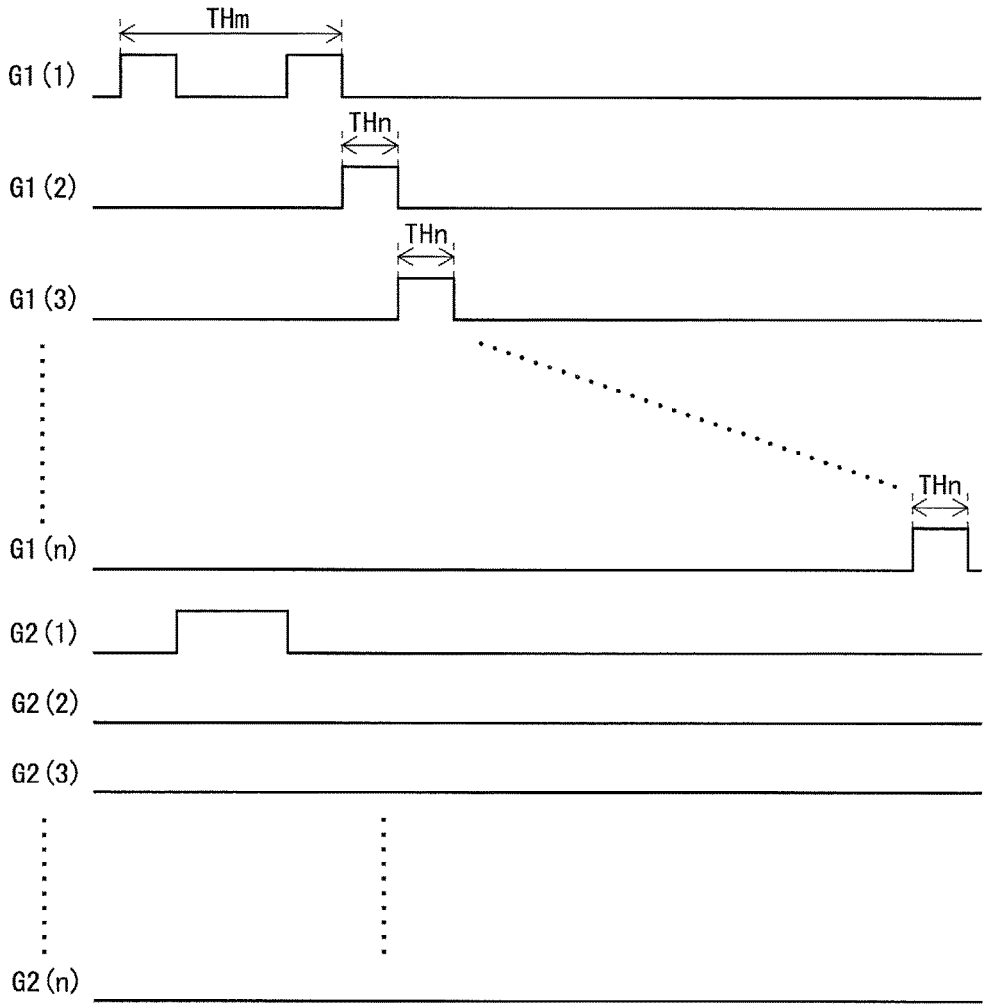
FIG. 2 is a timing chart for describing the operation of a gate driver in the embodiment.
Figure 3:
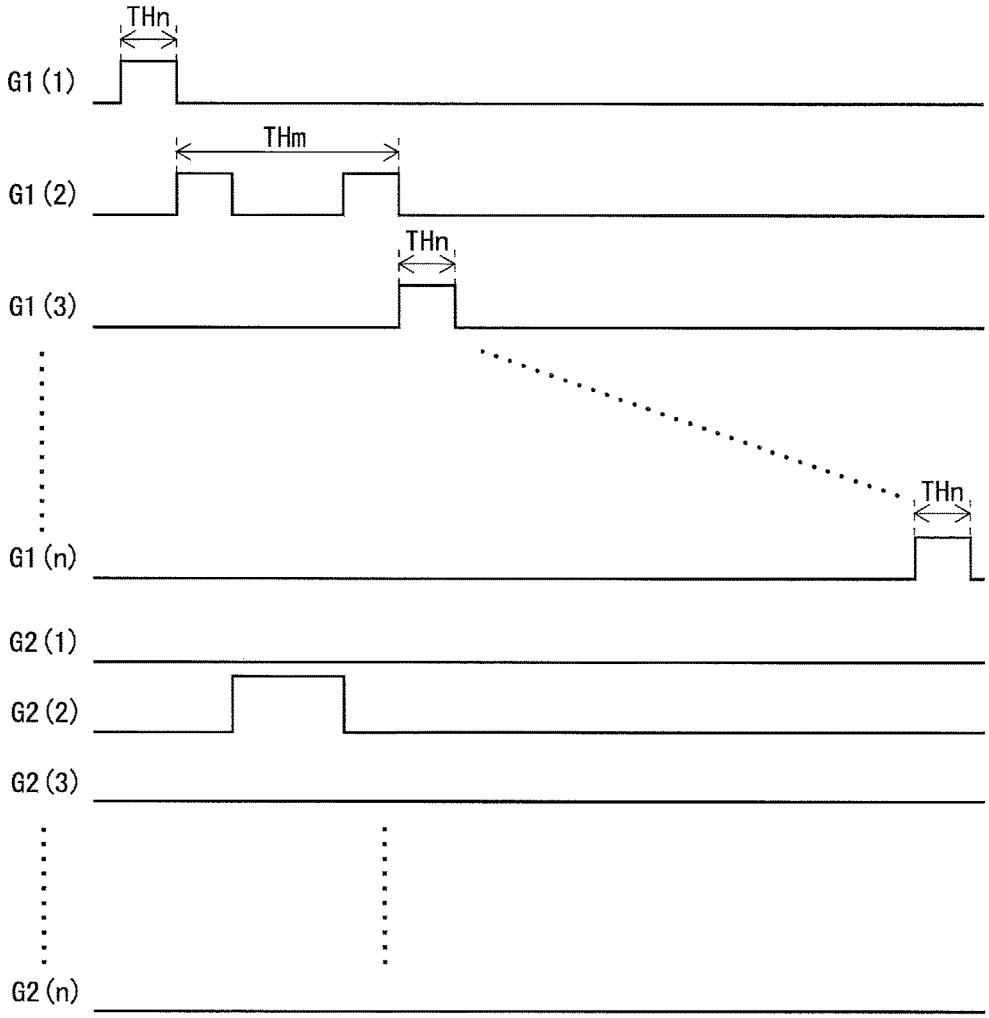
FIG. 3 is a timing chart for describing the operation of the gate driver in the embodiment.
Figure 4:
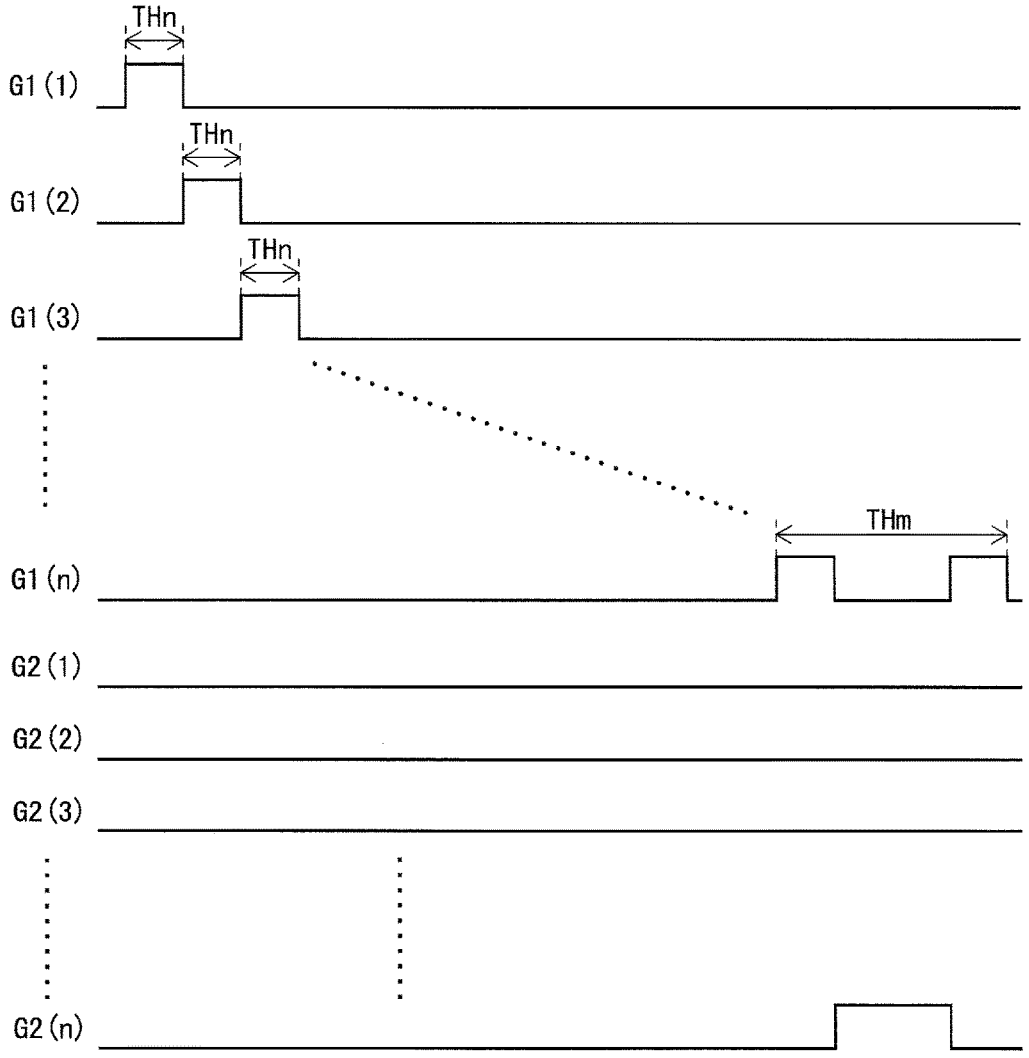
FIG. 4 is a timing chart for describing the operation of the gate driver in the embodiment.

Here, when a frame in which detection of TFT characteristics and OLED characteristics for the first row is performed is defined as a (k+1)th frame, the n scanning lines G1(1) to G1(*n*) and the n monitoring control lines G2(1) to G2(*n*) are driven in a manner shown in FIG. 2 in the (k+1)th frame, they are driven in a manner shown in FIG. 3 in a (k+2) th frame, and they are driven in a manner shown in FIG. 4 in a (k+n)th frame. Note that for FIGS. 2 to 4 a high-level state is an active state. Note also that in FIGS. 2 to 4 one horizontal scanning period for a monitored row is represented by reference character THm, and one horizontal scanning period for a non-monitored row is represented by reference character THn.

As can be grasped from FIGS. 2 to 4, the length of one horizontal scanning period is different between the monitored row and the non-monitored row. Specifically, the length of one horizontal scanning period for the monitored row is four times the length of one horizontal scanning period for the non-monitored row. Note, however, that the present invention is not limited thereto. For the non-monitored row, as with a common display device, there is one selection period during one frame period. For the monitored row, unlike a common display device, there are two selection periods during one frame period. The first selection period is the first quarter period of one horizontal scanning period THm, and the second selection period is the last quarter period of the one horizontal scanning period THm. Note that a more detailed description of one horizontal scanning period THm for the monitored row will be made later.

As shown in FIGS. 2 to 4, in each frame, a monitoring control line G2 corresponding to a non-monitored row is maintained in a non-active state. A monitoring control line G2 corresponding to a monitored row is maintained in an active state during a period other than selection periods in one horizontal scanning period THm (a period during which a scanning line G1 is in a non-active state). In the present embodiment, the gate driver 40 is configured such that the n scanning lines G1(1) to G1(*n*) and the n monitoring control lines G2(1) to G2(*n*) are driven in the above-described manner. Note that to generate two pulses on a scanning line G1 during one frame period in a monitored row, the waveform of an output enable signal which is transmitted to the gate driver 40 from the control circuit 20 may be controlled using publicly known techniques.

The source driver 30 is connected to the m data lines S(1) to S(m). The source driver 30 is composed of a drive signal generating circuit 31, a signal conversion circuit 32, and an output unit 33 including m output and current-monitoring circuits 330. The m output and current-monitoring circuits 330 in the output unit 33 are connected to their corresponding data lines S among the m data lines S(1) to S(m).

The drive signal generating circuit 31 includes a shift register, a sampling circuit, and a latch circuit. In the drive signal generating circuit 31, the shift register sequentially transfers a source start pulse from an input terminal to an output terminal in synchronization with a source clock. According to the transfer of the source start pulse, sampling pulses for the respective data lines S are outputted from the shift register. The sampling circuit sequentially stores data signals DA for one row, according to timing of the sampling pulses. The latch circuit catches and holds the data signals DA for one row which are stored in the sampling circuit, according to a latch strobe signal.

Note that, in the present embodiment, a data signal DA includes a luminance signal for allowing an organic EL element in a pixel to emit light at a desired luminance, and a monitoring control signal for controlling the operation of a pixel circuit 11 when detecting TFT characteristics and OLED characteristics.

The signal conversion circuit 32 includes a D/A converter and an A/D converter. The data signals DA for one row which are held in the latch circuit in the drive signal generating circuit 31 in the above-described manner are converted into analog voltages by the D/A converter in the signal conversion circuit 32. The converted analog voltages are provided to the output and current-monitoring circuits 330 in the output unit 33. In addition, monitored data MO is provided to the signal conversion circuit 32 from the output and current-monitoring circuits 330 in the output unit 33. The monitored data MO is converted from analog voltages into digital signals by the A/D converter in the signal conversion circuit 32. Then, the monitored data MO having been converted into the digital signals is provided to the control circuit 20 through the drive signal generating circuit 31.

Figure 5:
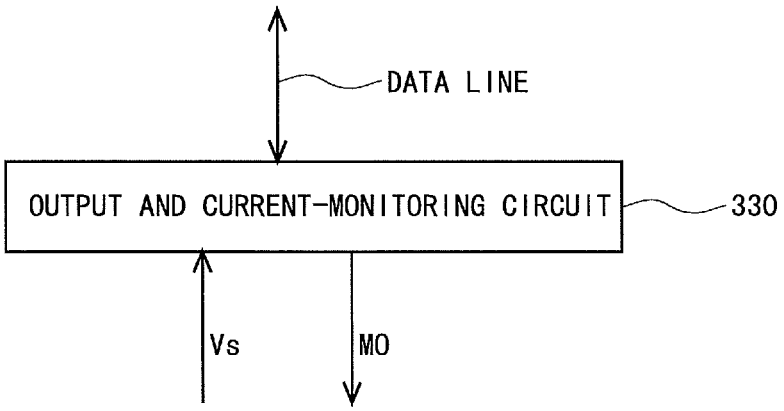
FIG. 5 is a diagram for describing input and output signals for an output and current-monitoring circuit in an output unit in the embodiment.

FIG. 5 is a diagram for describing input and output signals for an output and current-monitoring circuit 330 in the output unit 33. An analog voltage Vs serving as a data signal DA is provided to the output and current-monitoring circuit 330 from the signal conversion circuit 32. The analog voltage Vs is applied to a data line S through a buffer in the output and current-monitoring circuit 330. In addition, the output and current-monitoring circuit 330 has a function of measuring a current flowing through the data line S. Data measured by the output and current-monitoring circuit 330 is provided as monitored data MO to the signal conversion circuit 32. Note that a detailed configuration of the output and current-monitoring circuit 330 will be described later (see FIG. 6).

The correction data storage unit 50 includes a TFT offset memory 51*a*, an OLED offset memory 51*b*, a TFT gain memory 52*a*, and an OLED gain memory 52*b*. Note that these four memories may be physically one memory or may be physically different memories. The correction data storage unit 50 stores correction data which is used to correct video signals transmitted from an external source. Specifically, the TFT offset memory 51*a* stores, as correction data, offset values obtained based on the result of detection of TFT characteristics (each of these offset values is a value associated with a threshold voltage of a drive transistor). The OLED offset memory 51*b* stores, as correction data, offset values obtained based on the result of detection of OLED characteristics (each of these offset values is a value associated with a light emission threshold voltage of an organic EL element). The TFT gain memory 52*a* stores, as correction data, gain values obtained based on the result of detection of TFT characteristics (each of these gain values is a value associated with a mobility of the drive transistor). The OLED gain memory 52*b* stores, as correction data, degradation correction factors obtained based on the result of detection of OLED characteristics. Note that typically offset values and gain values whose numbers are equal to the number of pixels in the display unit 10 are stored in the TFT offset memory 51*a* and the TFT gain memory 52*a*, respectively, as correction data generated based on the results of detection of TFT characteristics. Note also that typically offset values and degradation correction factors whose numbers are equal to the number of pixels in the display unit 10 are stored in the OLED offset memory 51*b* and the OLED gain memory 52*b*, respectively, as correction data generated based on the results of detection of OLED characteristics. Note, however, that each memory may store one value for every plurality of pixels.

As described above, the control circuit 20 performs an update to correction data based on monitored data MO. Specifically, the control circuit 20 updates, based on monitored data MO provided from the source driver 30, offset values in the TFT offset memory 51*a*, offset values in the OLED offset memory 51*b*, gain values in the TFT gain memory 52*a*, and degradation correction factors in the OLED gain memory 52*b*. In addition, the control circuit 20 reads offset values in the TFT offset memory 51*a*, offset values in the OLED offset memory 51*b*, gain values in the TFT gain memory 52*a*, and degradation correction factors in the OLED gain memory 52*b*, and corrects video signals such that degradation of circuit elements is compensated for. Data obtained by the correction are transmitted as data signals DA to the source driver 30.

The organic EL high-level power supply 61 supplies a high-level power supply voltage ELVDD to the display unit 10. Note that the value of the high-level power supply voltage ELVDD is controlled based on a voltage control signal CTL1 outputted from the power supply voltage control unit 201. The organic EL low-level power supply 62 supplies a low-level power supply voltage ELVSS to the display unit 10. Note that the value of the low-level power supply voltage ELVSS is controlled based on a voltage control signal CTL2 outputted from the power supply voltage control unit 201.

<2. Configurations of the Pixel Circuits and the Output and Current-Monitoring Circuits>

<2.1 Pixel Circuits>

Figure 6:
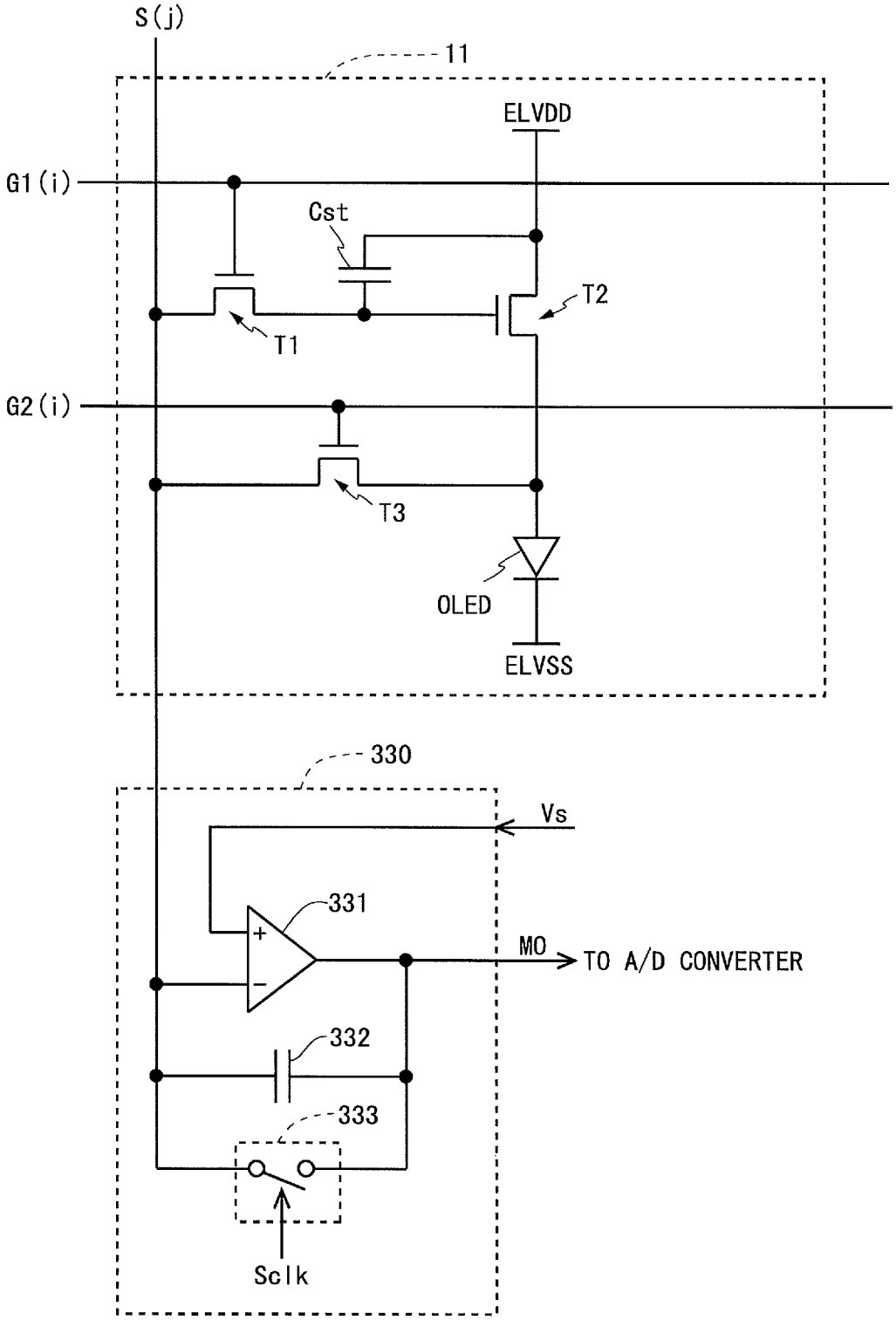
FIG. 6 is a circuit diagram showing a configuration of a pixel circuit and an output and current-monitoring circuit in the embodiment.

FIG. 6 is a circuit diagram showing the configurations of a pixel circuit 1.*i* and an output and current-monitoring circuit 330. Note that the pixel circuit 11 shown in FIG. 6 is a pixel circuit 11 at an ith row and a jth column. The pixel circuit 11 includes one organic EL element OLED, three transistors T1 to T3, and one capacitor Cst. The transistor T1 functions as an input transistor that selects a pixel, the transistor T2 functions as a drive transistor that controls the supply of a current to the organic EL element OLED, and the transistor T3 functions as a monitoring control transistor that controls whether to detect TFT characteristics and OLED characteristics.

The transistor T1 is provided between a data line S(j) and a gate terminal of the transistor T2. The transistor T1 is connected at its gate terminal to a scanning line G1(*i*) and connected at its source terminal to the data line S(j). The transistor T2 is provided in series with the organic EL element OLED. The transistor T2 is connected at its gate terminal to a drain terminal of the transistor T1, connected at its drain terminal to the high-level power supply line ELVDD, and connected at its source terminal to an anode terminal (anode) of the organic EL element OLED. The transistor 13 is connected at its gate terminal to a monitoring control line G2(*i*) connected at its drain terminal to the anode terminal of the organic EL element OLED, and connected at its source terminal to the data line S(j). The capacitor Cst is connected at is one end to the gate terminal of the transistor T2 and connected at its other end to the drain terminal of the transistor T2. A cathode terminal (cathode) of the organic EL element OLED is connected to the low-level power supply line ELVSS.

Note that, regarding the transistor T2, the gate terminal corresponds to a control terminal, the drain terminal corresponds to a first conduction terminal, and the source terminal corresponds to a second conduction terminal.

Figure 36:
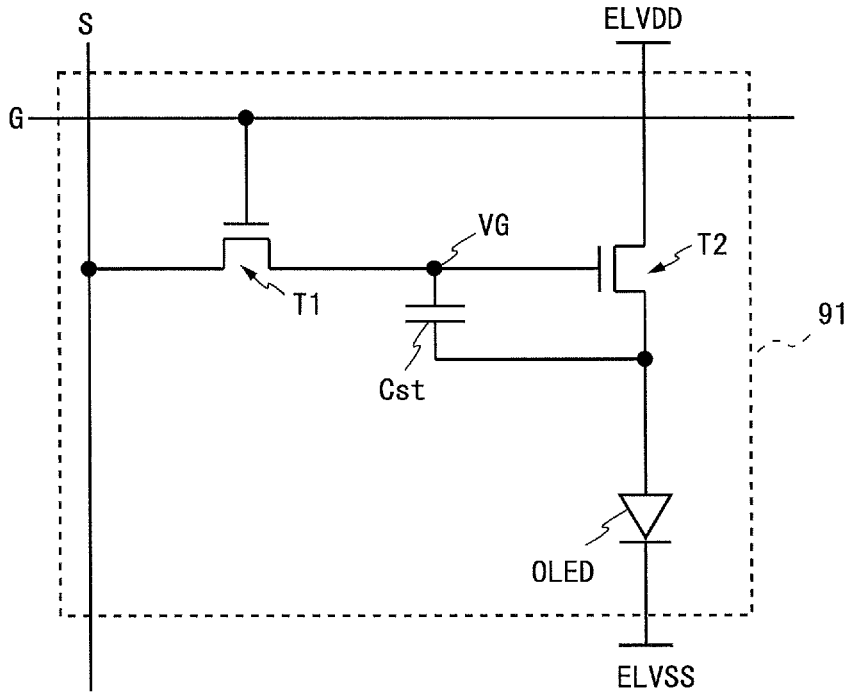
FIG. 36 is a circuit diagram showing a configuration of a conventional common pixel circuit.
Figure 37:
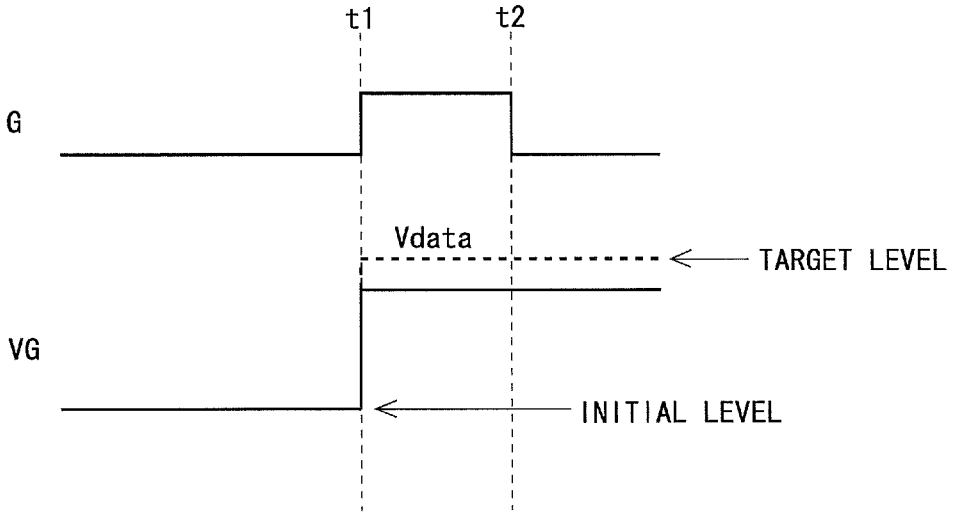
FIG. 37 is a timing chart for describing the operation of the pixel circuit shown in FIG. 36.
Figure 38:
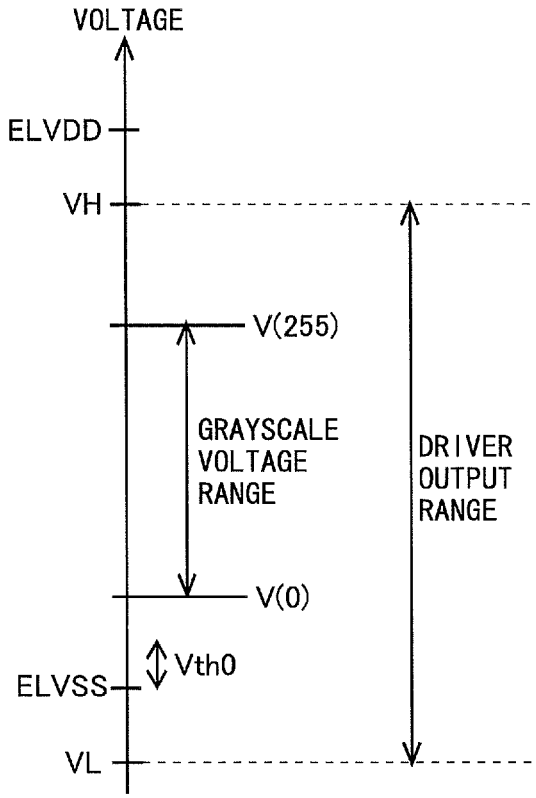
FIG. 38 is a diagram showing an example of a relationship among the high-level power supply voltage ELVDD, low-level power supply voltage ELVSS, driver output range, and grayscale voltage range of an organic EL display device capable of performing 256-level grayscale display for an initial state.
Figure 39:
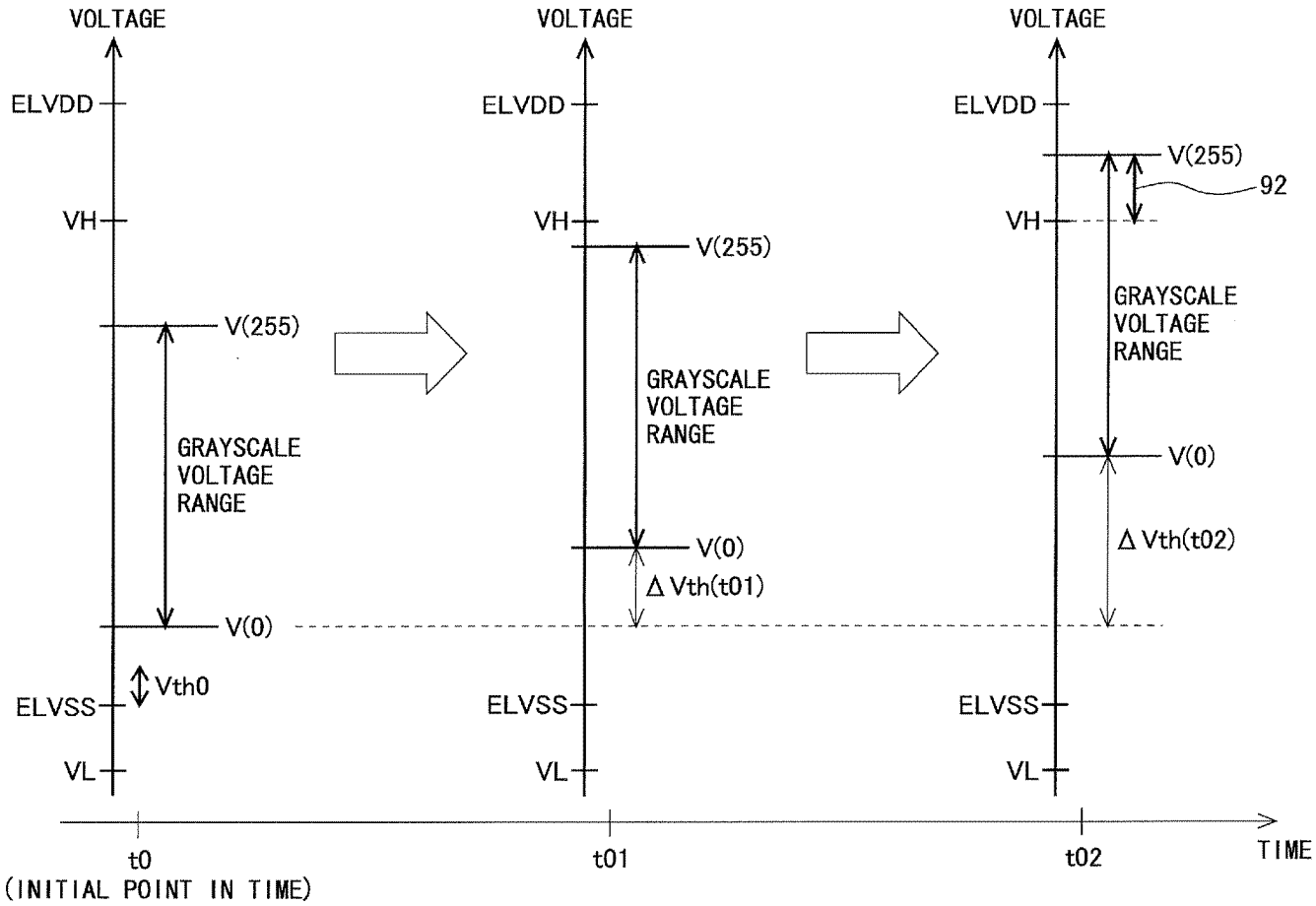
FIG. 39 is a diagram for describing a grayscale failure.

Meanwhile, in the configuration shown in FIG. 36, the capacitor Cst is provided between the gate and source of the transistor T2. On the other hand, in the present embodiment, the capacitor Cst is provided between the gate and drain of the transistor T2. The reason for this is as follows. Specifically, in the present embodiment, during one frame period, control is performed to change the potential of the data line S(j), with the transistor T3 being in an on state. If the capacitor Cst is provided between the gate and source of the transistor T2, then the gate potential of the transistor T2 also changes in accordance with the change in the potential of the data line S(j). This may result in the on/off state of the transistor T2 not going into a desired state. Hence, in the present embodiment, in order to prevent the gate potential of the transistor T2 from changing in accordance with the change in the potential of the data line S(j), the capacitor Cst is provided between the gate and drain of the transistor T2 as shown in FIG. 6. Note, however, that when the influence exerted on the gate potential of the transistor T2 by the change in the potential of the data line S(j) is small, the capacitor Cst may be provided between the gate and source of the transistor T2.

<2.2 Regarding Transistors in Pixel Circuit>

In the present embodiment, all of the transistors T1 to T3 in the pixel circuit 11 are of the n-channel type. Moreover, in the present embodiment, for the transistors T1 to T3, oxide TFTs (thin film transistors using an oxide semiconductor for channel layers) are adopted.

A description is made below of an oxide semiconductor layer included in each of the oxide TFTs. The oxide semiconductor layer is, for example, an In—Ga—Zn—O-based semiconductor layer. The oxide semiconductor layer contains, for example, an In—Ga—Zn—O-based semiconductor. The In—Ga—Zn—O-based semiconductor is a ternary oxide of in (indium), Ga (gallium) and Zn (zinc) A ratio (composition ratio) of In, Ga and Zn is not particularly limited. For example, the composition ratio may be In:Ga:Zn=2:2:1, In:Ga:Zn=1:1:1, In:Ga:Zn=1:1:2, and the like.

Such a TFT including the In—Ga—Zn—O-based semiconductor layer has high mobility (mobility exceeding 20 times that of an amorphous silicon TFT) and a low leak current (leak current of less than 1/100 of that of the amorphous silicon TFT. Accordingly, this TFT is suitably used as a drive TFT (the above-described transistor T2) in the pixel circuit and a switching TFT (t the above-described transistor T1) therein. When the TFT including the In—Ga—Zn—O-based semiconductor layer is used, electric power consumption of the display device can be reduced to a great extent.

The In—Ga—Zn—O-based semiconductor may be amorphous, or may include a crystalline portion and have crystallinity. As the crystallin In—Ga—Zn—O-based semiconductor, a crystalline In—Ga—Zn—O-based semiconductor, in which a c-axis is oriented substantially perpendicularly to a layer surface, is preferable. A crystal structure of the In—Ga—Zn—O-based semiconductor as described above is disclosed, for example, in Japanese Patent Application Laid-Open No. 2012-134475.

The oxide semiconductor layer may contain other oxide semiconductors in place of the In—Ga—Zn—O-based semiconductor. For example, the oxide semiconductor layer may contain a Zn—O-based semiconductor (ZnO), an In—Zn—O-based semiconductor (IZO (registered trademark)), a Zn—Ti—O-based oxide semiconductor (ZTO), a Cd—Ge—O-based semiconductor, a Cd—Pb—O-based semiconductor, a CdO (cadmium oxide), a Mg—Zn—O-based semiconductor, an In—Sn—O-based semiconductor (for example, In2O3-SnO2-ZnO), an In—Ga—Sn—O-based semiconductor and the like.

<2.3 Output and Current-Monitoring Circuits>

With reference to FIG. 6, a detailed configuration of an output and current-monitoring circuit 330 in the present embodiment will be described. The output and current-monitoring circuit 330 includes an operational amplifier 331, a capacitor 332, and a switch. The operational amplifier 331 has an inverting input terminal connected to the data line S(j), and a non-inverting input terminal to which an analog voltage Vs serving as a data signal DA is provided. The capacitor 332 and the switch 333 are provided between an output terminal of the operational amplifier 331 and the data line S(j). As described above, the output and current-monitoring circuit 330 is composed of an integrating circuit. In such a configuration, when the switch 333 is brought into an on state by a control clock signal Sclk, a short-circuit state occurs between the output terminal and the inverting input terminal of the operational amplifier 331. By this, the potentials of the output terminal of the operational amplifier 331 and the data line S(j) become equal to the potential of the analog voltage Vs. When a current flowing through the data line S(j) is measured, the switch 333 is brought into an off state by the control clock signal Sclk. By this, due to the presence of the capacitor 332, the potential of the output terminal of the operational amplifier 331 changes depending on the magnitude of the current flowing through the data line S(j). An output from the operational amplifier 331 is transmitted as monitored data MO to the A/D converter in the signal conversion circuit 32. Note that, in the present embodiment, a characteristic detecting unit is implemented by the output and current-monitoring circuit 330 and the control circuit 20.

<3. Drive Method>

<3.1 Overview>

Next, a drive method in the present embodiment will be described. As described above, in the present embodiment, detection of TFT characteristics and OLED characteristics for one row is performed in each frame. In each frame, operation for detecting TFT characteristics and OLED characteristics (hereinafter, referred to as "characteristic detection operation") is performed for a monitored row, and normal operation is performed for non-monitored rows. Specifically, when a frame in which detection of TFT characteristics and OLED characteristics for the first row is performed is defined as a (k+1)th frame, operation for each row transitions as shown in FIG. 7. In addition, when detection of TFT characteristics and OLED characteristics is performed, an update t corresponding correction data in the correction data storage unit 50 is performed using the results of the detection. Then, using the correction data stored in the correction data storage unit 50, corresponding video signals are corrected so as to compensate for degradation of corresponding circuit elements (transistors T2 and organic EL elements OLED). Furthermore, in the present embodiment, using the results of the detection of the TFT characteristics and the OLED characteristics, the value of the low-level power supply voltage ELVSS and the value of the high-level power supply voltage ELVDD are controlled. Note that time intervals at which the value of the low-level power supply voltage ELVSS and the value of the high-level power supply voltage ELVDD are controlled are not particularly limited.

Figure 8:
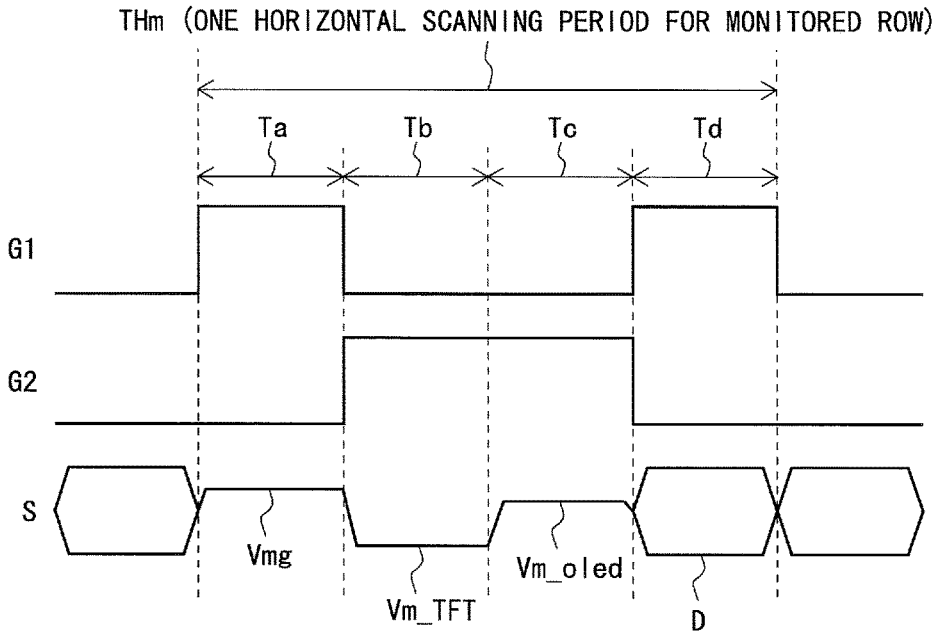
FIG. 8 is a timing chart for describing a detail of one horizontal scanning period for a monitored row in the embodiment.

FIG. 8 is a timing chart for describing a detail of one horizontal scanning period THm for a monitored row. As shown in FIG. 8, one horizontal scanning period THm for a monitored row includes a period during which preparation for detecting TFT characteristics and OLED characteristics is performed for the monitored row (hereinafter, referred to as "detection preparation period") Ta; a period during which current measurement for detecting TFT characteristics is performed (hereinafter, referred to as "TFT characteristic detection period") Tb; a period during which current measurement for detecting OLED characteristics is performed (hereinafter, referred to as "OLED characteristic detection period") Tc; and a period during which preparation for allowing organic EL elements OLED to emit light is performed for the monitored row (hereinafter, referred to as "light emission preparation period") Td.

During the detection preparation period Ta, a scanning line G1 is brought into an active state, a monitoring control line G2 is brought into a non-active state, and potentials Vmg are provided to the data lines S. During the TFT characteristic detection period Tb, the scanning line G1 is brought into a non-active state, the monitoring control line G2 is brought into an active state, and potentials Vm_TFT are provided to the data lines S. During the OLED characteristic detection period Tc, the scanning line G1 is brought into a non-active state, the monitoring control line G2 is brought into an active state, and potentials Vm_oled are provided to the data lines S. During the light emission preparation period Td, the scanning line G1 is brought into an active state, the monitoring control line G2 is brought into a non-active state, and data potentials D depending on target luminances of organic EL elements OLED included in the monitored row are provided to the data lines S. Note that a detailed description of the potential Vmg, the potential Vm_TFT, and the potential Vm_oled will be made later.

<3.2 Operation of the Pixel Circuits>

<3.2.1 Normal Operation>

Figure 9:
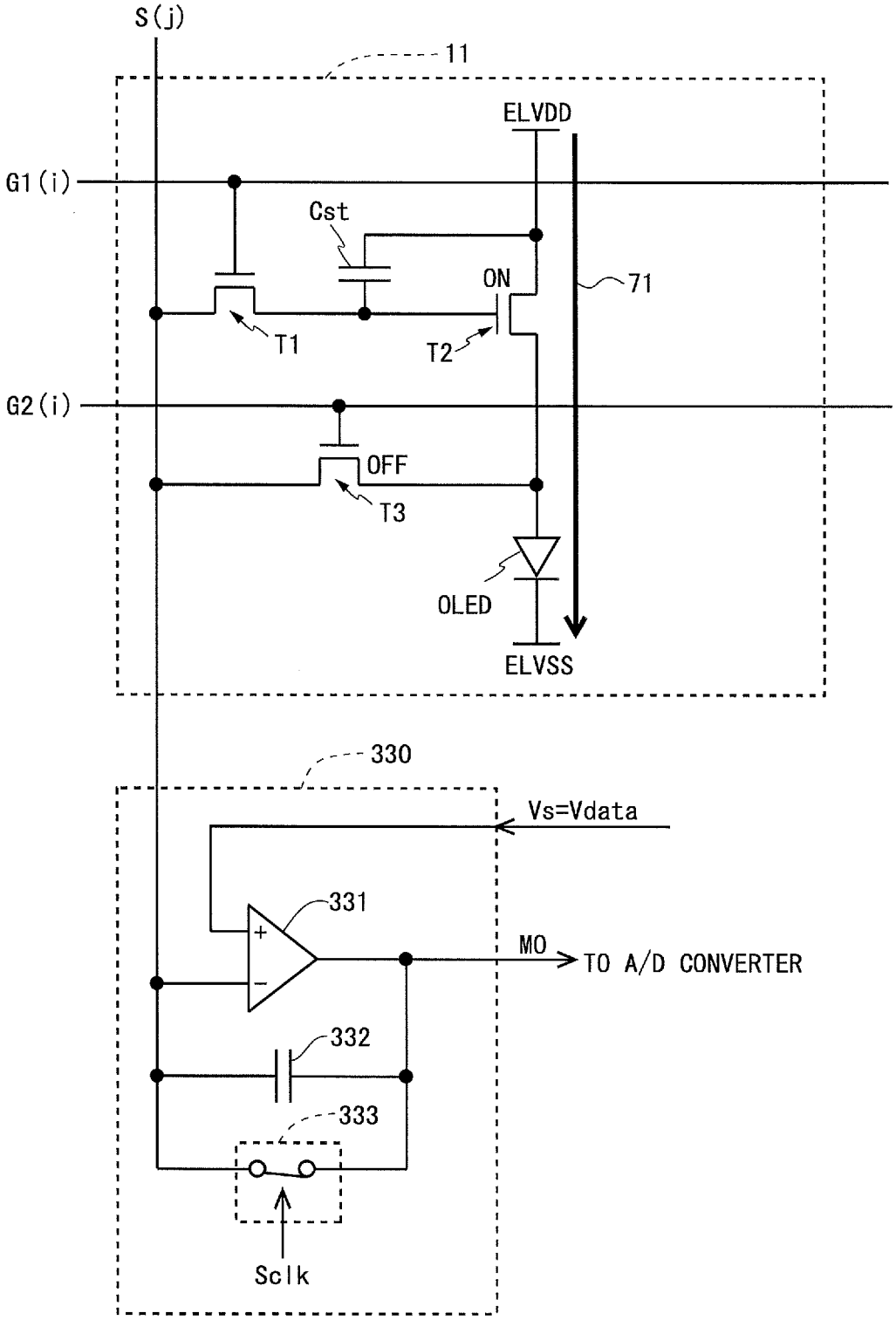
FIG. 9 is a diagram for describing the flow of a current for when normal operation is performed in the embodiment.

In each frame, for a non-monitored row, normal operation is performed. In a pixel circuit 11 included in the non-monitored row, writing based on a data potential Vdata corresponding to a target luminance is performed during a selection period, and then the transistor T1 is maintained in an off state. By the writing based on the data potential Vdata, the transistor T2 goes into an on state. The transistor T3 is maintained in an off state. By the above, a drive current is supplied to the organic EL element OLED through the transistor T2, as indicated by an arrow denoted by reference character 71 in FIG. 9. By this, the organic EL element OLED emits light at a luminance depending on the drive current.

<3.2.2 Characteristic Detection Operation>

Figure 10:
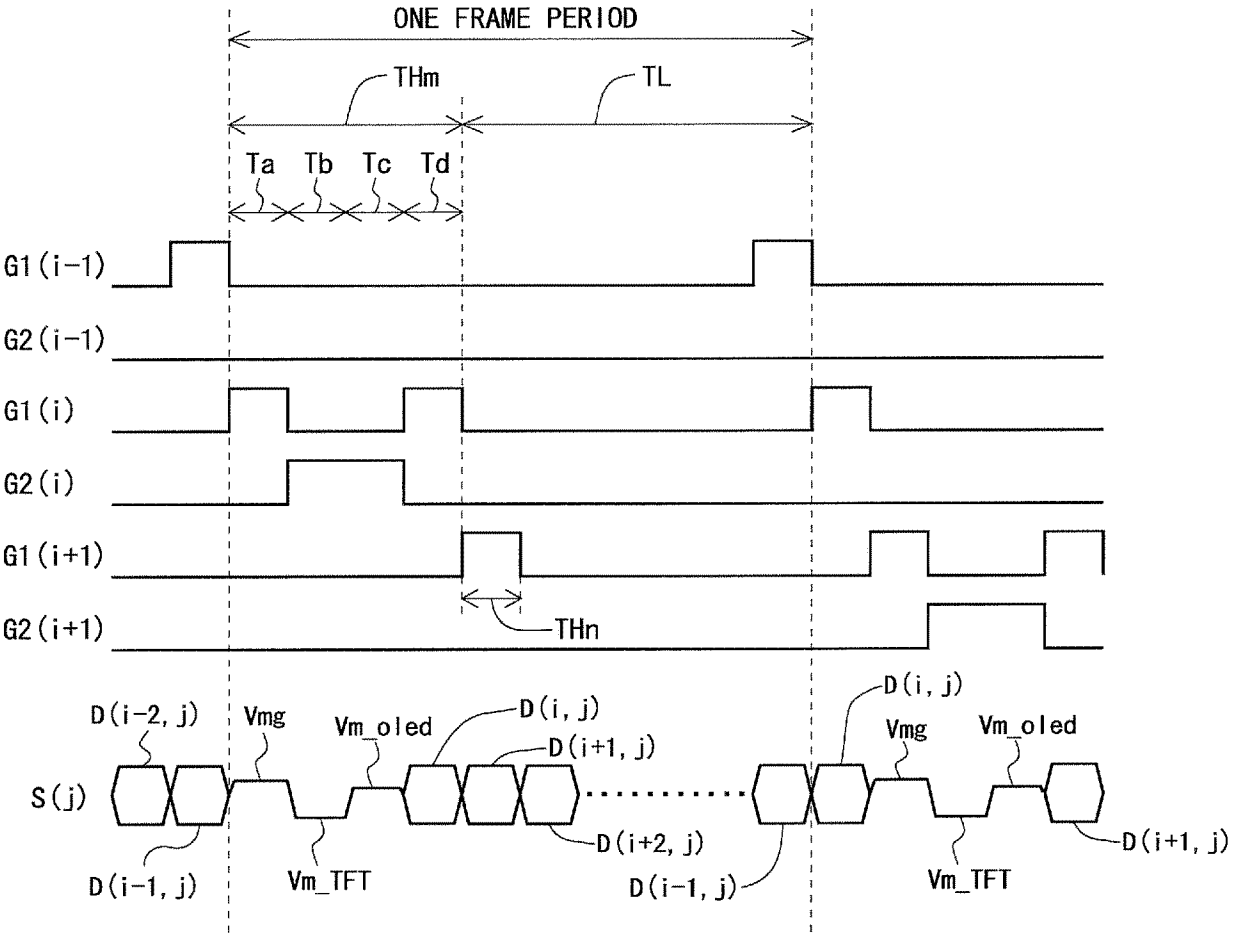
FIG. 10 is a timing chart for describing the operation of a pixel circuit (a pixel circuit at an ith row and a jth column) included in a monitored row in the embodiment.

In each frame, for a monitored row, characteristic detection operation is performed. FIG. 10 is a timing chart for describing the operation of a pixel circuit 11 (assumed to be a pixel circuit 11 at an ith row and a jth column) included in the monitored row. Note that in FIG. 10 "one frame period" is represented with reference to the first selection period start time point of the ith row in a frame in which the ith row is a monitored row. Note also that here a period other than the above-described one horizontal scanning period THm in one frame period for the monitored row is referred to as "light emission period". The light emission period is denoted by reference character TL.

Figure 11:
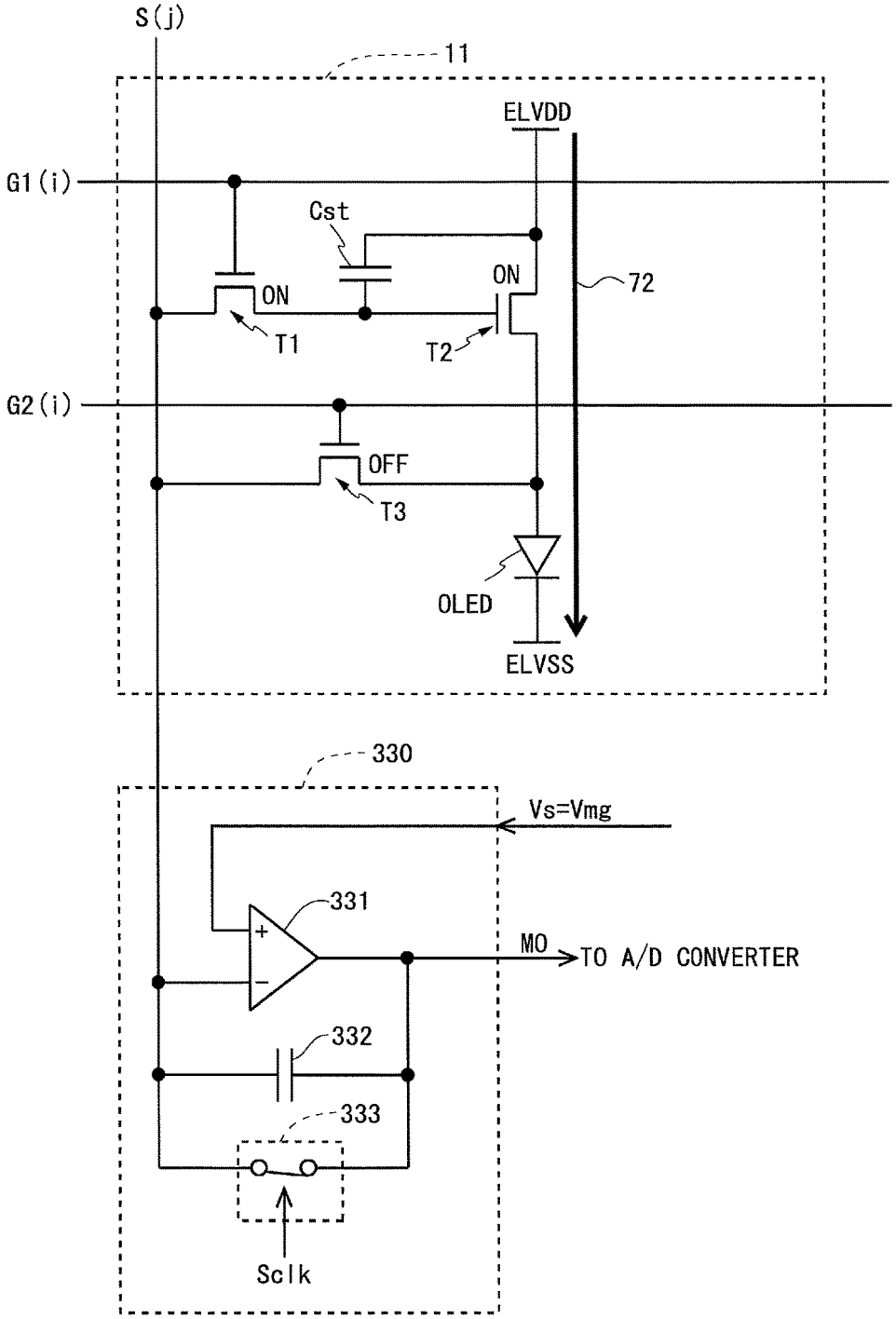
FIG. 11 is a diagram for describing the flow of a current during a detection preparation period in the embodiment.

During a detection preparation period Ta, a scanning line G1(*i*) is brought into an active state, a monitoring control line G2(*i*) is maintained in a non-active state. By this, the transistor T1 goes into an on state and the transistor T3 is maintained in an off state. In addition, during this period, a potential Vmg is provided to a data line S(j). By writing based on the potential Vmg, the capacitor Cst is charged and the transistor T2 goes into an on state. By the above, during the detection preparation period Ta, a drive current is supplied to the organic EL element OLED through the transistor T2, as indicated by an arrow denoted by reference character 72 in FIG. 11. By this, the organic EL element OLED emits light at a luminance depending on the drive current. Note, however, that the organic EL element OLED emits light for only a very short period of time.

During a TFT characteristic detection period Tb, the scanning line G1(*i*) is brought into a non-active state and the monitoring control line G2(*i*) is brought into an active state. By this, the transistor T1 goes into an off state and the transistor T3 goes into an on state. In addition, during this period, a potential Vm_TFT is provided to the data line S(j). Note that during an OLED characteristic detection period Tc which will be described later, a potential Vm_oled is provided to the data line S(j) in addition, as described above, during the detection preparation period Ta, writing based on the potential Vmg is performed.

Here, when the threshold voltage of the transistor T2 which is found based on an offset value stored in the TFT offset memory 51*a* is Vth (T2), the value of the potential Vmg, the value of the potential Vm_TFT, and the value of the potential Vm_oled are set such that the following expressions (1) and (2) hold true:

$$Vm_\mathrm{TFT}+Vth(T2)<Vmg \quad (1)$$

$$Vmg<Vm_\mathrm{oled}+Vth(T2) \quad (2)$$

In addition, when the light emission threshold voltage of the organic EL element OLED which is found based on an offset value stored in the OLED offset memory 51*b* is Vth(oled), the value of the potential Vm_TFT is set such that the following expression (3) holds true:

$$Vm_\mathrm{TFT}<\mathrm{ELVSS}+Vth(\mathrm{oled}) \quad (3)$$

Furthermore, when the breakdown voltage of the organic EL element OLED is Vbr(oled), the value of the potential Vm_TFT is set such that the following expression (4) holds true:

$$Vm_\mathrm{TFT}>\mathrm{ELVSS}+Vbr(\mathrm{oled}) \quad (4)$$

As described above, after performing writing based on the potential Vmg that satisfies the above expressions (1) and (2) during the detection preparation period Ta, the potential Vm_TFT that satisfies the above expressions (1), (3), and (4) is provided to the data line S(j) during the TFT characteristic detection period Tb. By the above expression (1), during the TFT characteristic detection period Tb, the transistor T2 goes into an on state. In addition, by the above expressions (3) and (4), during the TFT characteristic detection period Tb, a current does not flow through the organic EL element OLED.

Figure 12:
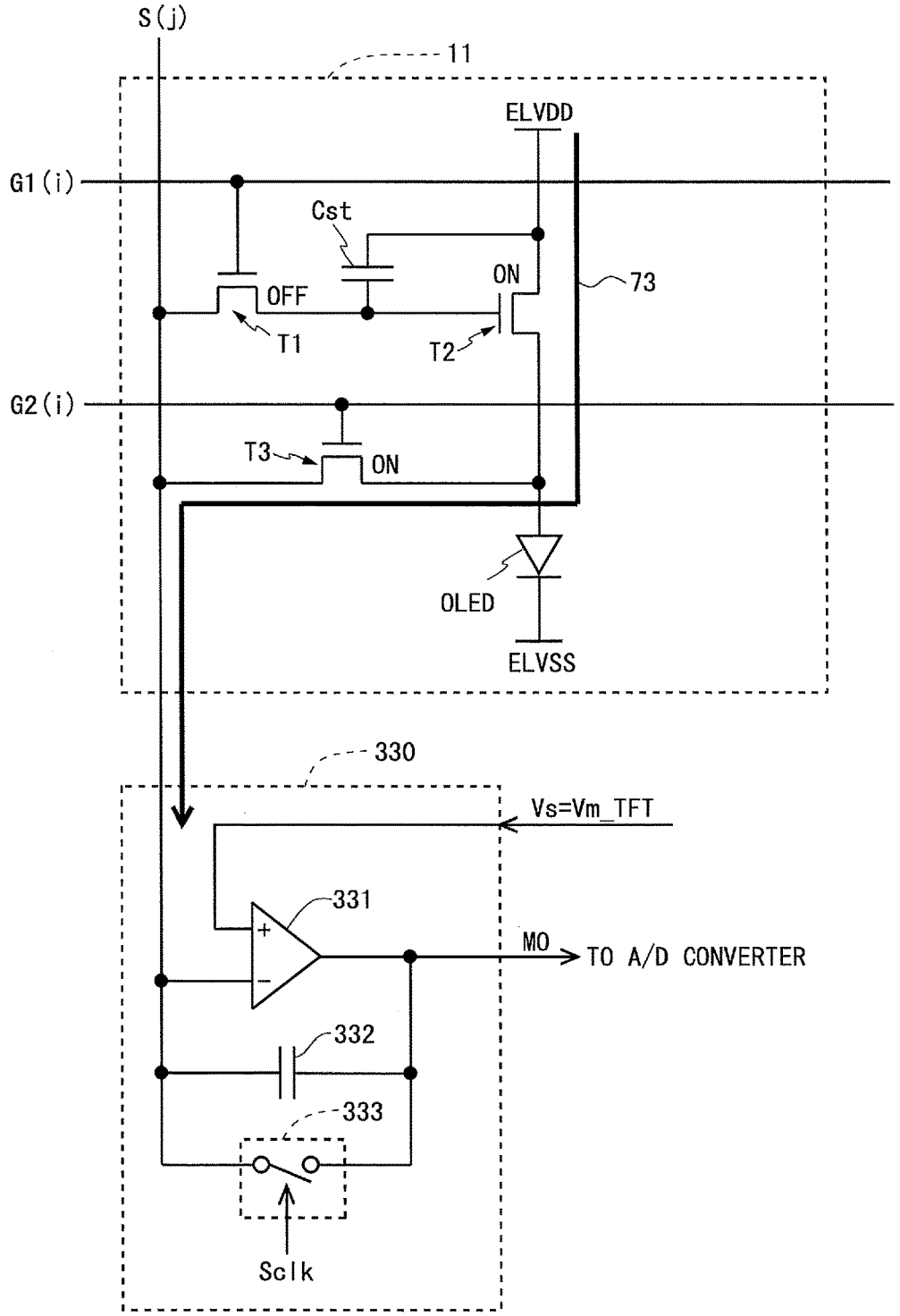
FIG. 12 is a diagram for describing the flow of a current during a TFT characteristic detection period in the embodiment.

By the above, during the TFT characteristic detection period Tb, a current flowing through the transistor T2 is outputted to the data line S(j) through the transistor T3, as indicated by an arrow denoted by reference character 73 in FIG. 12. By this, the current (sink current) outputted to the data line S(j) is measured by the output and current-monitoring circuit 330. In the above-described manner, the magnitude of the current flowing between the drain and source of the transistor T2 is measured with the voltage between the gate and source of the transistor T2 set to a predetermined magnitude (Vmg−Vm_TFT), by which TFT characteristics are detected.

During the OLED characteristic detection period. Tc, the scanning line G1(*i*) is maintained in the non-active state and the monitoring control line G2(*i*) is maintained in the active state. Hence, during this period, the transistor T1 is maintained in the off state and the transistor T3 is maintained in the on state. In addition, as described above, during this period, the potential Vm_oled is provided to the data line S(j).

Here, the value of the potential Vm_oled is set such that the above expression (2) and the following expression (5) hold true:

$$\mathrm{ELVSS}+Vth(\mathrm{oled})<Vm_\mathrm{oled} \quad (5)$$

In addition, when the break down voltage of the transistor T2 is Vbr(T2), the value of the potential Vm_oled is set such that the following expression (6) holds true:

$$Vm_\mathrm{oled}<Vmg+Vbr(T2) \quad (6)$$

As described above, during the OLED characteristic detection period Tc, the potential Vm_oled that satisfies the above expressions (2), (5), and (6) is provided to the data line S(j). By the above expressions (2) and (6), during the OLED characteristic detection period Tc, the transistor T2 goes into an off state. In addition, by the above expression (5), during the OLED characteristic detection period Tc, a current flows through the organic EL element OLED.

Figure 13:
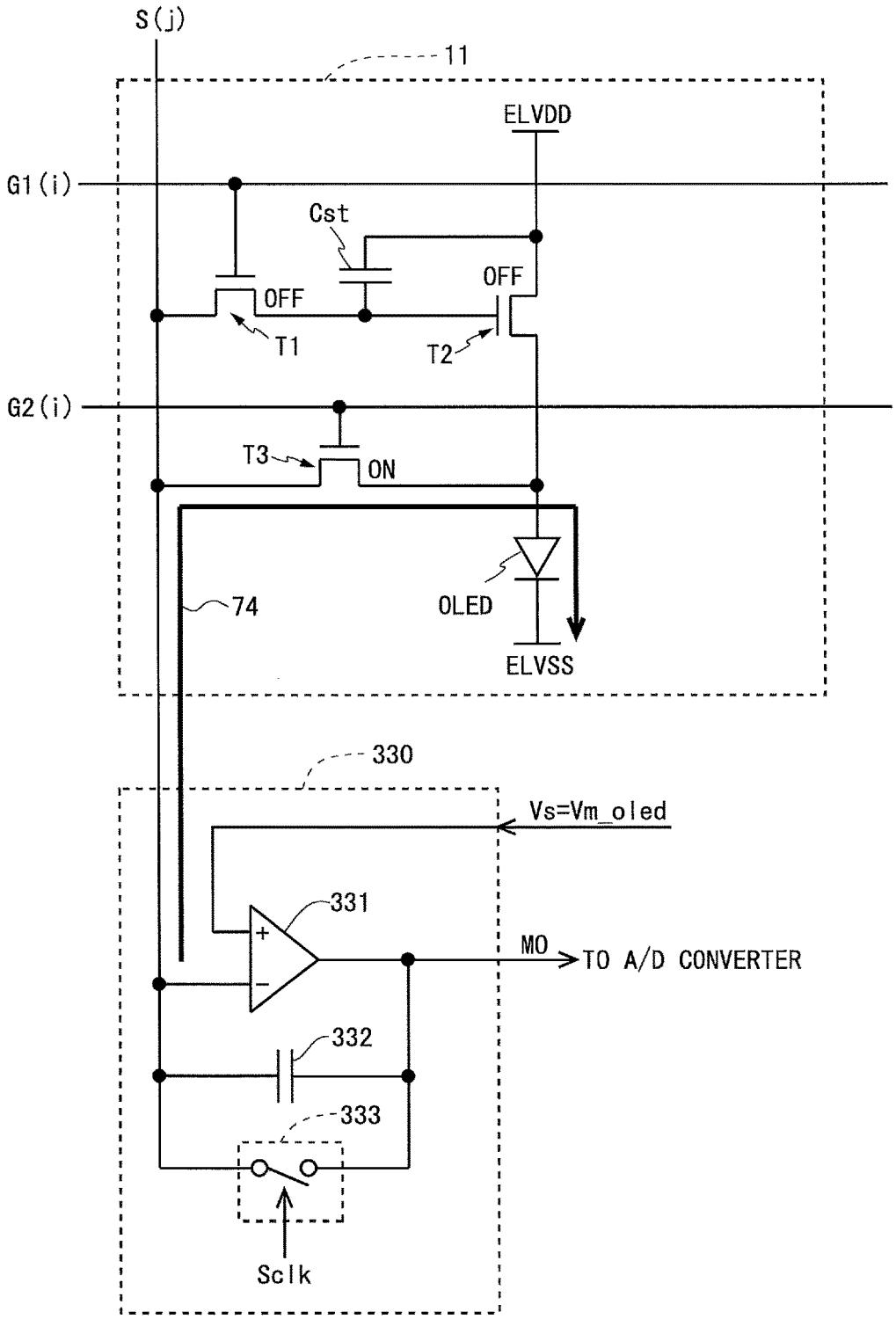
FIG. 13 is a diagram for describing the flow of a current during an OLED characteristic detection period in the embodiment.

By the above, during the OLED characteristic detection period Tc, a current flows through the organic EL element OLED through the transistor T3 from the data line S(j), as indicated by an arrow denoted by reference character 74 in FIG. 13, and the organic EL element OLED emits light. In this state, the current flowing through the data line S(j) is measured by the output and current-monitoring circuit 330. In the above-described manner, the magnitude of the current flowing through the organic EL element OLED is measured with the voltage between the anode and cathode of the organic EL element OLED set to a predetermined magnitude (Vm_oled−ELVSS), by which OLED characteristics are detected.

Note that the value of the potential Vmg, the value of the potential Vm_TFT, and the value of the potential Vm_oled are determined taking also into account a range of current measurable by an output and current-monitoring circuit 330 adopted, etc., in addition to the above expressions (1) to (6).

Now, changes in the on/off state of the switch 333 in the output and current-monitoring circuit 330 will be described. When the switch 333 is switched from an off state to an on state, charge accumulated in the capacitor 332 is discharged. When the switch 333 is switched from the on state to an off state thereafter, charging of the capacitor 332 starts. Then, the output and current-monitoring circuit 330 operates as an integrating circuit. Note that the switch 333 is maintained in the off state during a period during which a current flowing through the data line S is measured. Specifically, first, during the TFT characteristic detection period Tb, the switch 333 is brought into an on state to provide a potential Vm_TFT to the data line S, and then the switch 333 is brought into an off state to measure a current flowing through the data line S. Then, during the OLED characteristic detection period Tc, the switch 333 is brought into an on state to provide a potential Vm_oled to the data line S, and then the switch 333 is brought into an off state to measure a current flowing through the data line S.

Figure 14:
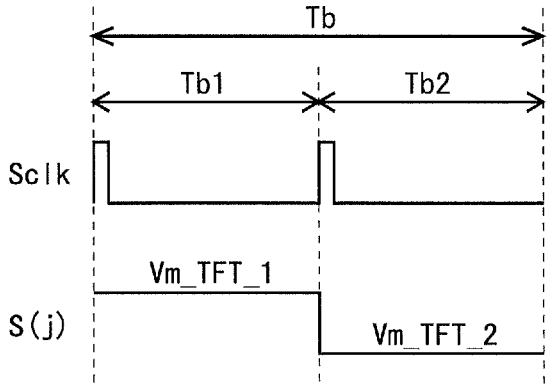
FIG. 14 is a timing chart for describing a detail of the TFT characteristic detection period in the embodiment.

Meanwhile, in the present embodiment, during the TFT characteristic detection period Tb, detection of TFT characteristics is performed based on two types of potentials (Vm_TFT_1 and Vm_TFT_2). Specifically, by controlling, during the TFT characteristic detection period Tb, the control clock signal Sclk for switching the on/off state of the switch 333 and the potentials (Vm_TFT_1 and Vm_TFT_2) which are provided to the data line S(j), as shown in FIG. 14, TFT characteristics are detected based on the potential Vm_TFT_1 during a period Tb1, and TFT characteristics are detected based on the potential Vm_TFT_2 during a period Tb2. Likewise, during the OLED characteristic detection period Tc, too, OLED characteristics are detected based on two types of potentials.

When the threshold voltage of the transistor T2 is Vth, the gain of the transistor T2 is β, and the gate-source voltage of the transistor T2 is Vgs, a current I(T2) flowing between the drain and source of the transistor T2 when the transistor T2 operates in saturation region is represented by the following equation (7):

$$I(T2)=(\beta/2)\times(Vgs-Vth)^2 \quad (7)$$

Here, the gain β of the transistor T2 is represented by the following equation (8):

$$\beta=\mu\times(W/L)\times Cox \quad (8)$$

In the above equation (8), μ, W, L, and Cox represent the mobility, gate width, gate length, and gate insulating film capacitance per unit area of the transistor T2, respectively.

Regarding the above equation (8), μ (mobility) changes depending on the degree of degradation of the transistor T2. Therefore, β (gain) changes depending on the degree of degradation of the transistor T2. In addition, regarding the above equation (7), in addition to β, Vth (threshold voltage) also changes depending on the degree of degradation of the transistor T2. Since current measurement is performed based on two types of potentials during the TFT characteristic detection period Tb in the present embodiment as described above, by solving simultaneous equations based on two equations that are obtained by substituting the results of the current measurement into the above equation (7), the threshold voltage and gain of the transistor T2 at a point in time when detection of TFT characteristics is performed can be found. Note that since, as can be grasped from the above equation (8), β (gain) and μ (mobility) have a proportional relationship, finding the gain corresponds to finding the mobility.

Figure 15:
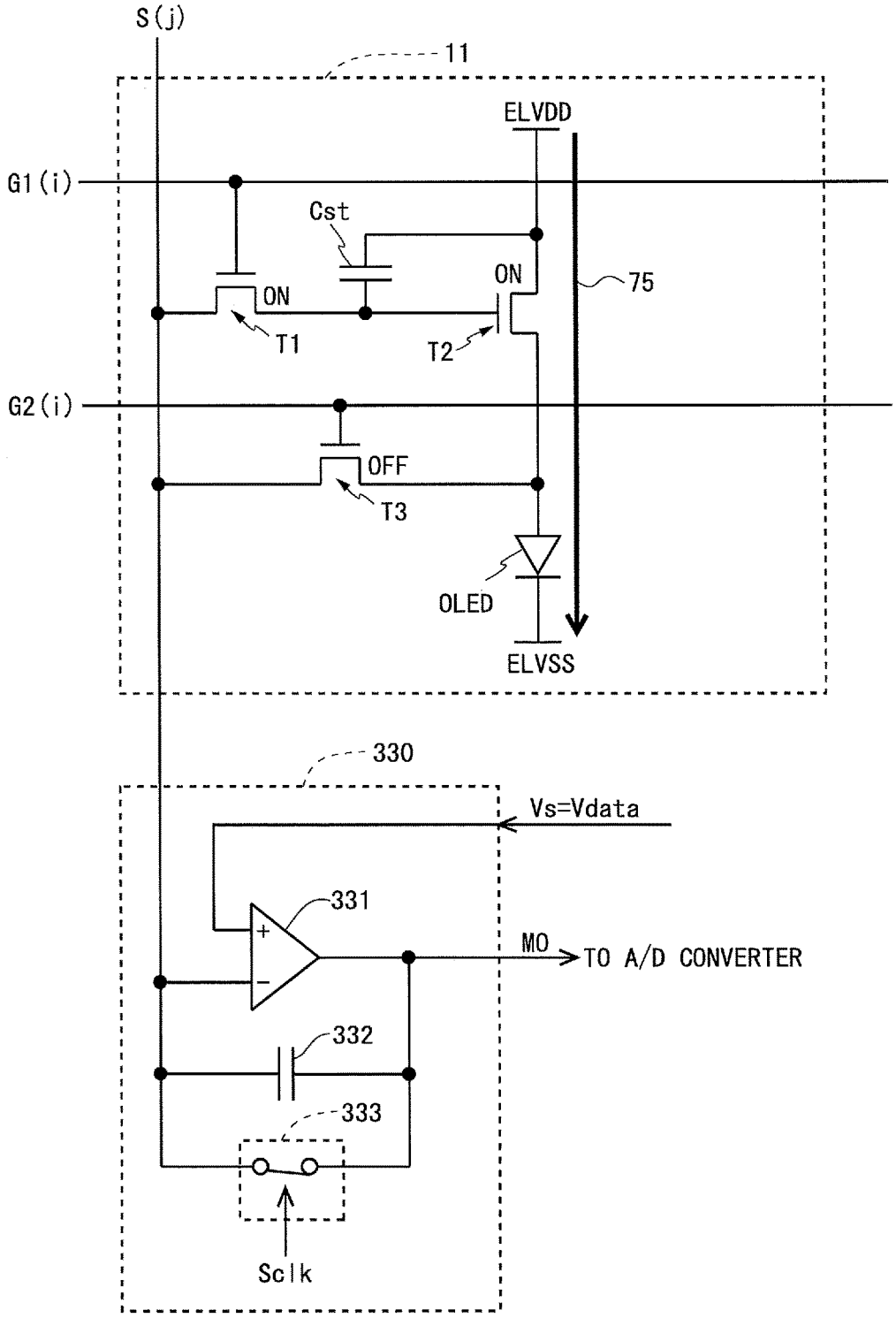
FIG. 15 is a diagram for describing the flow of a current during a light emission preparation period in the embodiment.

During a light emission preparation period Td, the scanning line G1(*i*) is brought into an active state and the monitoring control line G2(*i*) is brought into a non-active state. By this, the transistor T1 goes into an on state and the transistor T3 goes into an off state. In addition, during this period, a data potential D(i, j) depending on a target luminance is provided to the data line S(j). By writing based on the data potential D(i, j), the capacitor Cst is charged and the transistor T2 goes into an on state. By the above, during the light emission preparation period Td, a drive current is supplied to the organic EL element OLED through the transistor T2, as indicated by an arrow denoted by reference character 75 in FIG. 15. By this, the organic EL element OLED emits light at a luminance depending on the drive current.

Figure 16:
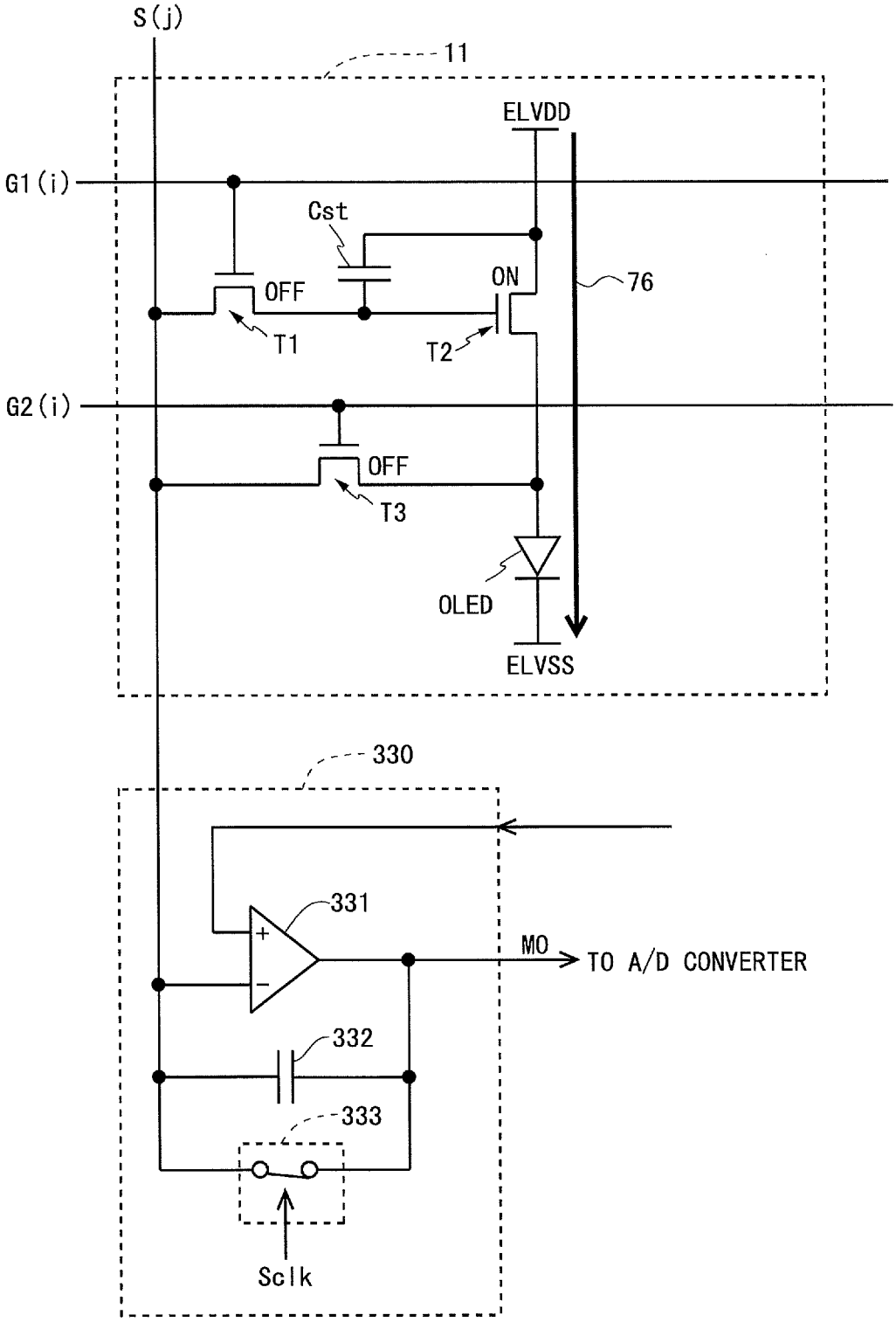
FIG. 16 is a diagram for describing the flow of a current during a light emission period in the embodiment.

During the light emission period TL, the scanning line G1(*i*) is brought into a non-active state and the monitoring control line G2(*i*) is maintained in the non-active state. By this, the transistor T1 goes into an off state and the transistor T3 is maintained in the off state. Although the transistor T1 goes into an off state, since the capacitor Cst is charged during the light emission preparation period Td by the writing based on the data potential D(i, j) depending on the target luminance, the transistor T2 is maintained in the on state. Therefore, during the light emission period TL, a drive current is supplied to the organic EL element OLED through the transistor T2, as indicated by an arrow denoted by reference character 76 in FIG. 16. By this, the organic EL element OLED emits light at a luminance depending on the drive current. That is, during the light emission period TL, the organic EL element OLED emits light depending on the target luminance.

In the present embodiment, in the above-described manner, detection of TFT characteristics and OLED characteristics for one row is performed for each frame. By this, TFT characteristics and OLED characteristics for the n rows are detected over n frame periods.

Note that a technique for detecting TFT characteristics and OLED characteristics is not limited to the one described above. For example, a circuit configuration different than the one described above can be adopted, or characteristics of circuit elements may be detected by a different sequence than that described above.

<3.3 Update to Correction Data and Correction of Video Signals>

When TFT characteristics and OLED characteristics are detected, correction data stored in the correction data storage unit 50 is updated based on the results of the detection. Specifically, since a threshold voltage of the transistor T2 and a gain value corresponding to a mobility of the transistor T2 are found in the above-described manner during a TFT characteristic detection period Tb, an offset value corresponding to the found threshold voltage is stored as a new offset value in the TFT offset memory 51*a*, and the found gain value is stored as a new gain value in the TFT gain memory 52*a*. In addition, since a threshold voltage of the organic EL element OLED and a degradation correction factor of the organic EL element OLED are found during an OLED characteristic detection period Tc, an offset value corresponding to the found threshold voltage is stored as a new offset value in the OLED offset memory 51*b*, and the found degradation correction factor is stored as a new degradation correction factor in the OLED gain memory 52*b*. Note that since, in the present embodiment, detection of TFT characteristics and OLED characteristics for one row is performed in each frame, an update to m offset values in the TFT offset memory 51*a*, m gain values in the TFT gain memory 52*a*, m offset values in the OLED offset memory 51*b*, and m degradation correction factors in the OLED gain memory 52*b* is performed per frame period.

The control circuit 20 corrects video signals using correction data stored in the correction data storage unit 50, so as to compensate for degradation of circuit elements. Note that, as will be described later, in the present embodiment, the value of the low-level power supply voltage ELVSS is set to a value lower than a value at an initial point in time, depending on the magnitudes of threshold shifts (changes in threshold voltages from an initial point in time) of the transistor T2 (drive transistor) and the organic EL element OLED. Here, the difference between the value of the low-level power supply voltage ELVSS at an initial point in time and the value of the low-level power supply voltage ELVSS at a point in time when a video signal is corrected is represented by ΔV.

When a voltage of a video signal after gamma correction is Vc, a gain value stored in the TFT gain memory 52*a* is B1, a degradation correction factor stored in the OLED gain memory 52*b* is B2, an offset value stored in the TFT offset memory 51*a* is Vt1, and an offset value stored in the OLED offset memory 51*b* is Vt2, a corrected voltage Vdata is found by the following equation (9):

$$V\text{data}=Vc\cdot B1\cdot B2+Vt1+Vt2-\Delta V \tag{9}$$

A digital signal representing the voltage Vdata found by the above equation (9) is transmitted as a data signal DA to the source driver 30 from the control circuit 20. Note that the corrected voltage Vdata may be found by the following equation (10) so as to compensate for attenuation of a data potential caused by parasitic capacitance in the pixel circuit 11:

$$V\text{data}=Z(Vc\cdot B1\cdot B2+Vt1+Vt2-\Delta V) \tag{10}$$

where Z is a factor for compensating for attenuation of the data potential.

<3.4 Control of the Low-Level Power Supply Voltage (ELVSS)>

In the present embodiment, in order to prevent the occurrence of a grayscale failure, the value of the low-level power supply voltage ELVSS is controlled by the power supply voltage control unit 201, based on the results of detection of TFT characteristics and OLED characteristics. How the value of the low-level power supply voltage ELVSS is controlled in the present embodiment will be described below.

As described above, in the present embodiment, TFT characteristics and OLED characteristics for the n rows are detected over n frame periods. That is, TFT characteristics and OLED characteristics for all pixels in the display unit 10 are detected every n frame periods. By this, threshold shifts of the transistors T2 (drive transistors) and the organic EL elements for all pixels are found, but there are variations in the degree of degradation of the circuit elements. That is, the magnitudes of threshold shifts of the transistors T2 and the organic EL elements OLED vary pixel by pixel. Here, in the present embodiment, an average value of the magnitudes of threshold shifts of all pixels in the display unit 10 is used as a value for controlling the value of the low-level power supply voltage ELVSS.

In order to use an average value of the magnitudes of threshold shifts of all pixels to control the value of the low-level power supply voltage ELVSS, the control circuit 20 first finds, for each pixel, a magnitude of a threshold shift (an amount of change in threshold voltage) of the transistor T2, based on a difference between a threshold voltage of the transistor T2 at an initial point in time and a threshold voltage of the transistor T2 at a point in time when detection of TFT characteristics is performed. In addition, the control circuit 20 finds, for each pixel, a magnitude of a threshold shift of the organic EL element OLED, based on a difference between a threshold voltage of the organic EL element OLED at an initial point in time and a threshold voltage of the organic EL element OLED at a point in time when detection of OLED characteristics is performed. Note that, for convenience of description, the magnitude of the threshold shift of each circuit element thus found is referred to as "calculated value of change". Note also that, in the present embodiment, target circuit elements are implemented by the transistor T2 and the organic EL element OLED.

Then, the control circuit 20 finds, for the threshold shifts of the transistors T2, an average value of the calculated values of change for all pixels. The control circuit 20 also finds, for the threshold shifts of the organic EL elements OLED, an average value of the calculated values of change for all pixels. Thereafter, the control circuit 20 determines the value of the low-level power supply voltage ELVSS using the average values. Specifically, when the value of the low-level power supply voltage ELVSS at an initial point in time is $V_{(ELVSS)(0)}$, the average value of the calculated values of change for the transistors T2 is $\Delta Vth_{(TFT)(AVE)}$, and the average value of the calculated values of change for the organic EL elements OLED is $\Delta Vth_{(OLED)(AVE)}$, the value $V_{(ELVSS)}$ of a controlled low-level power supply voltage ELVSS is found by the following equation (11):

$$V_{(ELVSS)}=V_{(ELVSS)(0)}-\Delta Vth_{(TFT)(AVE)}-\Delta Vth_{(OLED)(AVE)} \tag{11}$$

As can be grasped from the above equation (11), in the present embodiment, the value of the low-level power supply voltage ELVSS is set to a value lower, by a voltage value corresponding to the sum of the average value of the magnitudes of threshold shifts for the transistors T2 (drive transistors) and the average value of the magnitudes of threshold shifts for the organic EL elements OLED, than the value at the initial point in time. Since normally the threshold shift increases with the passage of time, the value of the low-level power supply voltage ELVSS is lowered with the passage of time.

In the present embodiment, the value of the low-level power supply voltage ELVSS is controlled in the above-described manner. Note that the value of the low-level power supply voltage ELVSS may be found based on the magnitudes of threshold shifts of only the transistors T2 as shown in the following equation (12), and the value of the low-level power supply voltage ELVSS may be found based on the magnitudes of threshold shifts of only the organic EL elements OLED as shown in the following equation (13):

$$V_{(ELVSS)}=V_{(ELVSS)(0)}-\Delta Vth_{(TFT)(AVE)} \tag{12}$$

$$V_{(ELVSS)}=V_{(ELVSS)(0)}-\Delta Vth_{(OLED)(AVE)} \tag{13}$$

<3.5 Control of the High-Level Power Supply Voltage (ELVDD)>

In the present embodiment, with the control of the value of the low-level power supply voltage ELVSS in the above-described manner, the value of the high-level power supply voltage ELVDD is also controlled by the power supply voltage control unit 201. Note that the value of the high-level power supply voltage ELVDD is controlled so as to reduce power consumption. How the value of the high-level power supply voltage ELVDD is controlled in the present embodiment will be described below.

In the present embodiment, gains (values proportional to mobilities) of the transistors T2 (drive transistors) for all pixels are found by detecting TFT characteristics, but there are variations in the degree of degradation of the transistors T2. That is, the gain of the transistor T2 varies pixel by pixel. Here, in the present embodiment, an average value of gains of all pixels in the display unit 10 is used as a value for controlling the value of the high-level power supply voltage ELVDD.

Specifically, when the value of the low-level power supply voltage ELVSS at an initial point in time is $V_{(ELVSS)(0)}$, the maximum value of voltages applied between the anodes and cathodes of the organic EL elements OLED is Voled, and the maximum value of overdrive voltages (differences between gate-source voltages and threshold voltages) of the transistors T2 is "Vgs−Vth", the value $V_{(ELVDD)}$ of a controlled high-level power supply voltage ELVDD is found to satisfy the following expression (14):

$$V_{(ELVDD)} > V_{(ELVSS)} + Voled + Vgs - Vth \quad (14)$$

The above expression (14) is an expression representing a condition that satisfies a saturated state.

Meanwhile, when the transistors T2 operate in saturation region, the following equation (15) holds true for the overdrive voltage "Vgs−Vth" of the transistors T2:

$$Vgs - Vth = (2 \times Ioled/\beta)^{1/2} \quad (15)$$

Note that in the above equation (15), Ioled represents the magnitudes of currents flowing between the anodes and cathodes of the organic EL elements OLED, and β represents the gains of the transistors T2.

Here, a minimum value of gains of all pixels for the transistors T2 is substituted into β of the above equation (15). The value of "Vgs−Vth" obtained thereby is substituted into "Vgs−Vth" of the above expression (14). That is, it may be considered that the value $V_{(ELVDD)}$ of a controlled high-level power supply voltage ELVDD is found to satisfy the following expression (16).

$$V_{(ELVDD)} > V_{(ELVSS)} + Voled + (2 \times Ioled/\beta)^{1/2} \quad (16)$$

Note that when detection of mobilities (gains) is not performed, the value of the high-level power supply voltage ELVDD may be changed in the same direction as a direction in which the value of the low-level power supply voltage changes and by the same value as the changed value of the low-level power supply voltage.

In the present embodiment, the value of the high-level power supply voltage ELVDD is controlled in the above-described manner. By this, for example, when the value of the low-level power supply voltage ELVSS has become a value lower than that at an initial point in time, the value of the high-level power supply voltage ELVDD is set to the lowest possible value within a range that satisfies the above expression (16), by which power consumption is reduced.

<4. Effects>

The organic EL display device 1 according to the present embodiment is provided with a monitoring function that detects the characteristics of the drive transistors (transistors T2) and the organic EL, elements OLED in the pixel circuits 11. By the monitoring function, the threshold voltages of the drive transistors and the organic EL elements OLED are found. Since the threshold voltages of each pixel are found every predetermined period, a threshold shift of the drive transistor in each pixel and a threshold shift of the organic EL element OLED in each pixel can be found. Then, as indicated by an arrow with reference character 78 in FIG. 17, the value of the low-level power supply voltage ELVSS is set to a value lower, by a value corresponding to an average value of calculated values of change (magnitudes of threshold shifts) of all pixels, than a value at an initial point in time. By this, compared to before an adjustment of the value of the low-level power supply voltage ELVSS, a grayscale voltage range (a range of data voltage required to perform desired grayscale display) is wholly lowered. Hence, a voltage that causes a grayscale failure in the conventional art out of corrected data voltages for compensation falls within a driver output range (see FIG. 18). As a result, the occurrence of a grayscale failure is prevented. In addition, since the occurrence of a grayscale failure is prevented, an effect of extending the life of the organic EL display device can also be obtained. As described above, according to the present embodiment, an organic EL display capable of compensating for degradation of circuit elements without causing a grayscale failure is implemented.

Figure 17:
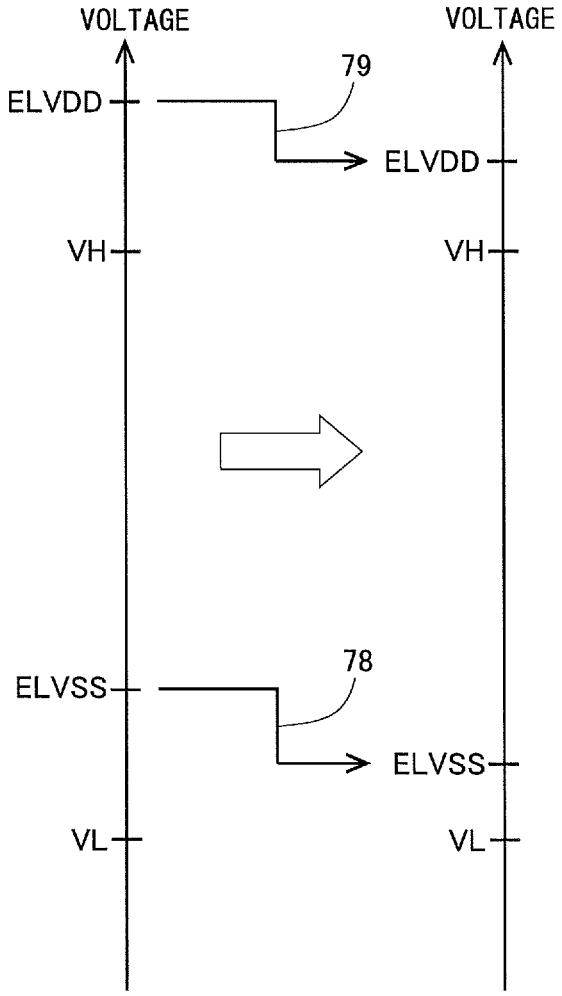
FIG. 17 is a diagram for describing effects of the embodiment.
Figure 18:
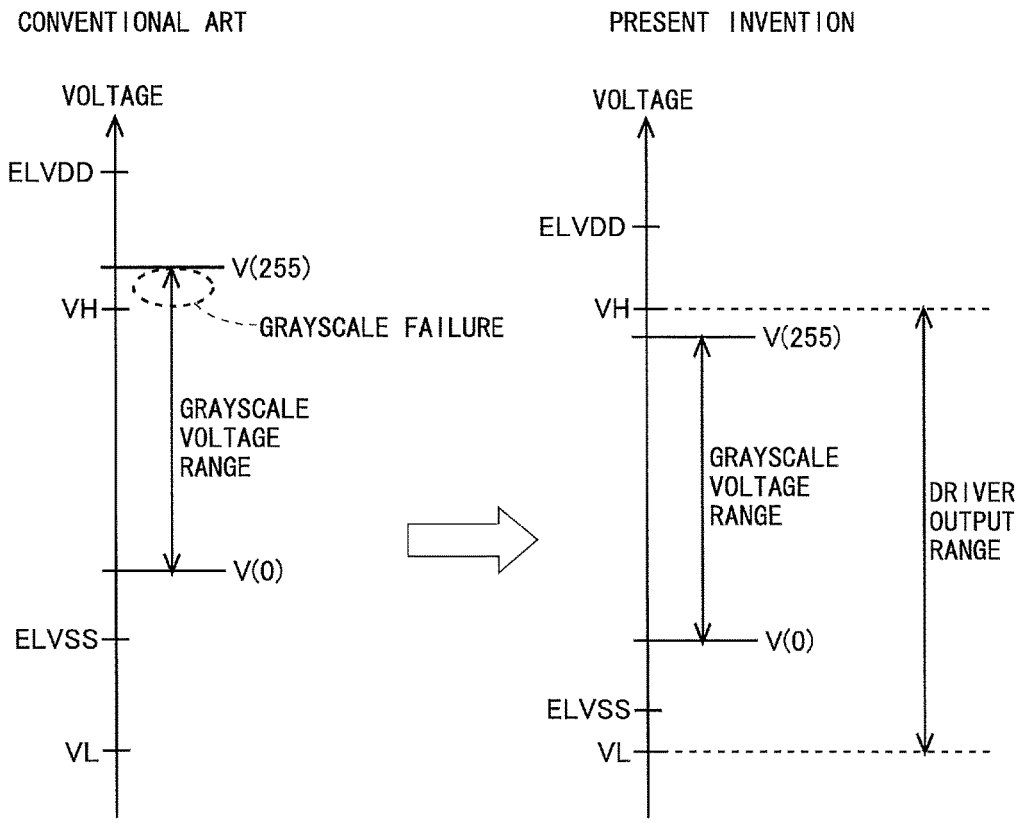
FIG. 18 is a diagram for describing the effects of the embodiment.

In addition, according to the present embodiment, with the setting of the value of the low-level power supply voltage ELVSS to a value lower than a value at an initial point in time, the value of the high-level power supply voltage ELVDD is also set to a value lower than a value at an initial point in time as indicated by an arrow with reference character 79 in FIG. 17. By this, power consumption is reduced. Note that the value of the high-level power supply voltage ELVDD does not necessarily need to be adjusted.

Furthermore, in the present embodiment, an average value of the magnitudes of threshold shifts (calculated values of change) of all pixels is found for both of the transistors T2 and the organic EL elements OLED. Hence, the TFT offset memory 51*a* and the OLED offset memory 51*b* (see FIG. 1) may store the value of a difference between a "calculated value of change of each pixel" and an "average value of calculated values of change of all pixels". By thus storing the values of differences in the memories, memory capacity required by the organic EL display device 1 can be reduced.

<5. Variants>

Variants of the above-described embodiment will be described below. Note that in the following only differences from the embodiment will be described in detail and description of the same points as in the embodiment is omitted.

<5.1 First Variant>

In the embodiment, the value of the low-level power supply voltage ELVSS is adjusted based on an average value of calculated values of change (magnitudes of threshold shifts) for all pixels. However, the present invention is not limited thereto. The value of the low-level power supply voltage ELVSS may be adjusted based on a midpoint value between the maximum value and minimum value of the calculated values of change for all pixels (i.e., an average value of the maximum value and minimum value of the calculated values of change for all pixels). Alternatively, the value of the low-level power supply voltage ELVSS may be adjusted based on a median of the calculated values of change for all pixels.

Specifically, when one of an average value of the calculated values of change for all pixels, an average value of the maximum value and minimum value of the calculated values of change for all pixels, and a median of the calculated values of change for all pixels is defined as a representative value, the value of the low-level power supply voltage ELVSS may be set to a value lower, by a voltage value corresponding to the representative value, than a value at an initial point in time.

<5.2 Second Variant>

In the embodiment, the value of the low-level power supply voltage ELVSS is adjusted based on an average value of calculated values of change (magnitudes of threshold shifts) for all pixels. However, the present invention is not limited thereto. In the present variant, the value of the low-level power supply voltage ELVSS is adjusted based on a maximum value of the calculated values of change of all pixels.

Specifically, when the value of the low-level power supply voltage ELVSS at an initial point in time is $V_{(ELVSS)(0)}$, the maximum value of calculated values of change for the transistors T2 (drive transistors) is $\Delta Vth_{(TFT)(MAX)}$, and the maximum value of calculated values of change for the organic EL elements OLED is $\Delta Vth_{(OLED)(MAX)}$, the value $V_{(ELVSS)}$ of a controlled low-level power supply voltage ELVSS is found by the following equation (17):

$$V_{(ELVSS)}=V_{(ELVSS)(0)}-\Delta Vth_{(TFT)(MAX)}-\Delta Vth_{(OLED)(MAX)} \quad (17)$$

According to the present variant, the value of the low-level power supply voltage ELVSS is set to a value lower, by a voltage value corresponding to the sum of a maximum value of the magnitudes of threshold shifts for the transistors T2 and a maximum value of the magnitudes of threshold shifts for the organic EL elements OLED, than a value at an initial point in time. Hence, an upper limit of a grayscale voltage range is effectively lowered. By this, the occurrence of a grayscale failure on the high-grayscale side is effectively prevented.

<5.3 Third Variant>

In the present variant, the value of the low-level power supply voltage ELVSS is adjusted based on a minimum value of the calculated values of change of all pixels. Specifically, when the value of the low-level power supply voltage ELVSS at an initial point in time is $V_{(ELVSS)(0)}$, the minimum value of calculated values of change for the transistors T2 (drive transistors) is $\Delta Vth_{(TFT)(0)(MIN)}$, and the minimum value of calculated values of change for the organic EL elements OLED is $\Delta Vth_{(OLED)(MIN)}$, the value $V_{(ELVSS)}$ Of a controlled low-level power supply voltage ELVSS is found by the following equation (18):

$$V_{(ELVSS)}=V_{(ELVSS)(0)}-\Delta Vth_{(TFT)(MIN)}-\Delta Vth_{(OLED)(MIN)} \quad (18)$$

According to the present variant, the value of the low-level power supply voltage ELVSS is set to a value lower, by a voltage value corresponding to the sum of a minimum value of the magnitudes of threshold shifts for the transistors T2 and a minimum value of the magnitudes of threshold shifts for the organic EL elements OLED, than a value at an initial point in time. Hence, even after an adjustment of the value of the low-level power supply voltage ELVSS, a lower limit of a grayscale voltage range is maintained at as high a value as possible. By this, the occurrence of a grayscale failure on the low-grayscale side is prevented.

<5.4 Fourth Variant>

As can be grasped from the embodiment, the first variant, the second variant, and the third variant, various methods are considered for a method for adjusting the value of the low-level power supply voltage ELVSS. In this regard, a case in which the following conditions (A) to (E) are satisfied is considered.

(A) The value of the low-level power supply voltage ELVSS at an initial point in time (ta) is 0 V, and if the value of threshold voltages (here, the sum of the value of a threshold voltage of a drive transistor and the value of a threshold voltage of an organic EL elements OLED) is 0 V, then a grayscale voltage range (a range of data voltage required to perform desired grayscale display) is 3 V to 7V.

(B) The magnitude of a threshold shift at the initial point in time (ta) is 0 V for all pixels.

(C) A minimum value of calculated values of change of all pixels at point in time tb is 1 V.

(D) A maximum value of the calculated values of change of all pixels at point in time tb is 3.5 V.

(E) An average value of the calculated values of change of all pixels at point in time tb is 2 V.

Note that, for convenience of description, a pixel having a minimum calculated value of change is referred to as "minimum shift pixel", and a pixel having a maximum calculated value of change is referred to as "maximum shift pixel". Note also that in FIGS. 19 to 25, a grayscale voltage range at the minimum shift pixel is indicated by an arrow with reference character 81 and a grayscale voltage range at the maximum shift pixel is indicated by an arrow with reference character 82.

Figure 19:
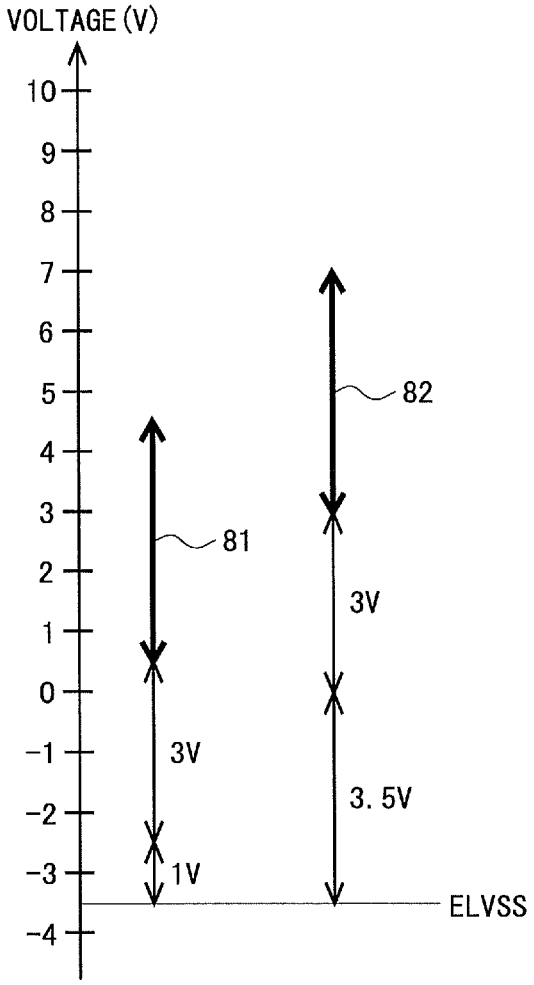
FIG. 19 is a diagram for describing a method for adjusting a low-level power supply voltage.
Figure 20:
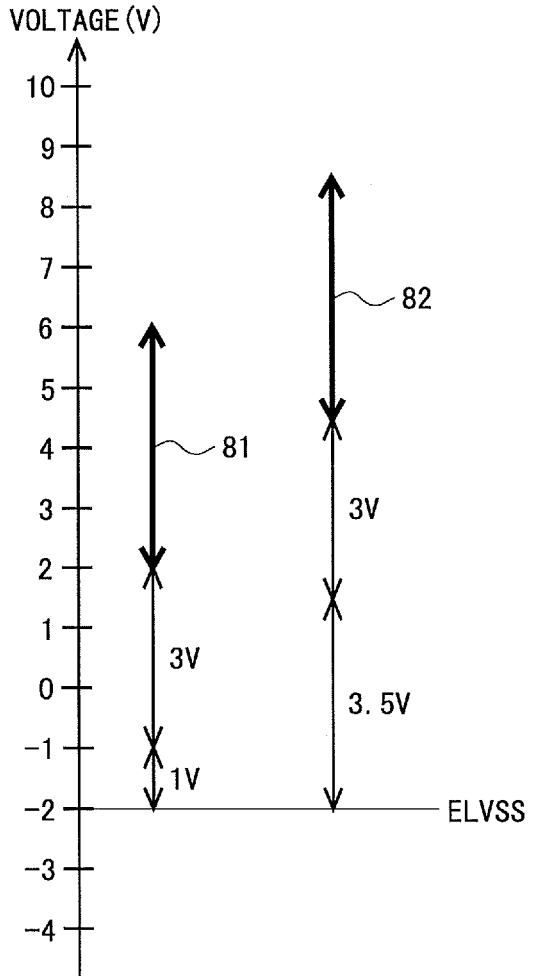
FIG. 20 is a diagram for describing a method for adjusting the low-level power supply voltage.
Figure 21:
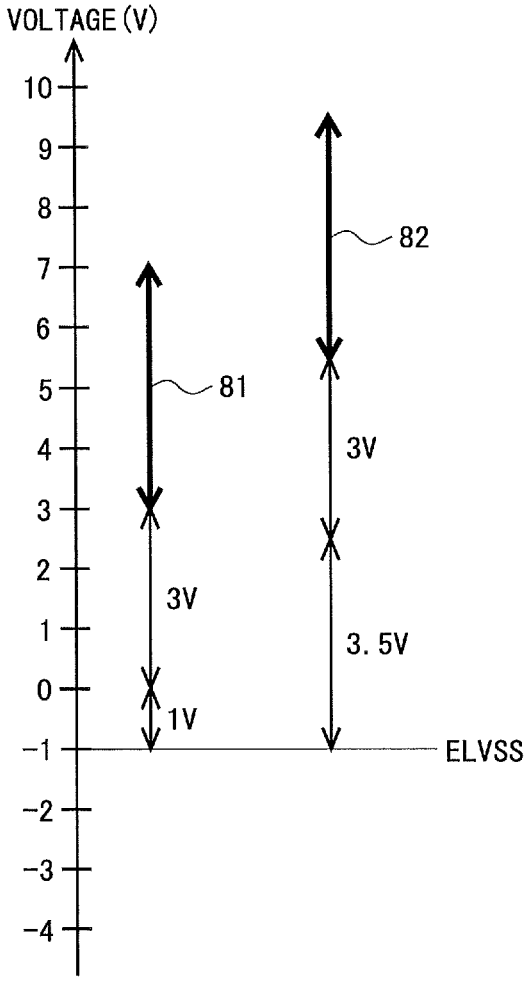
FIG. 21 is a diagram for describing a method for adjusting the low-level power supply voltage.
Figure 22:
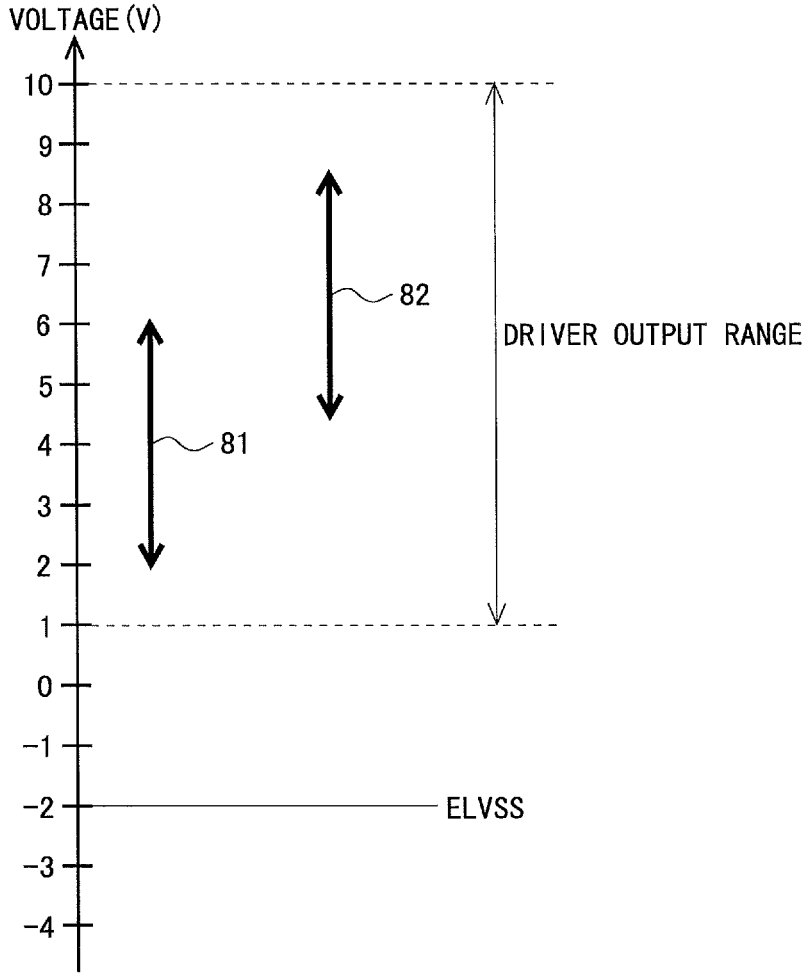
FIG. 22 is a diagram for describing a method for adjusting the low-level power supply voltage.
Figure 23:
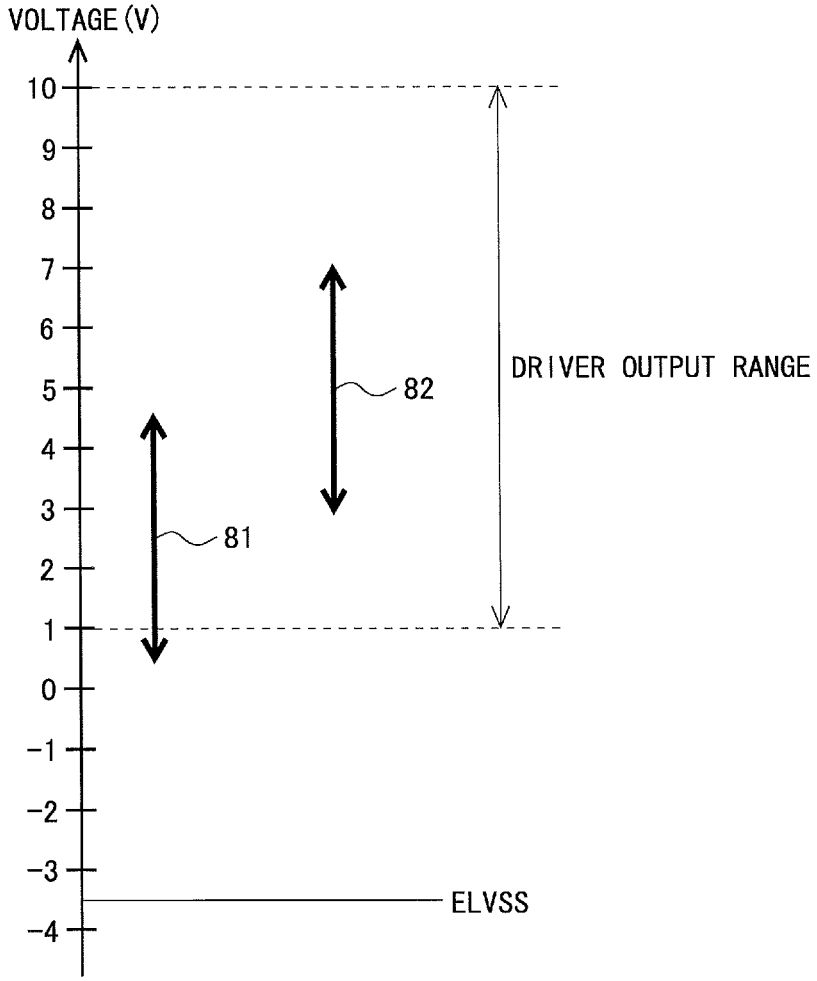
FIG. 23 is a diagram for describing a method for adjusting the low-level power supply voltage.
Figure 24:
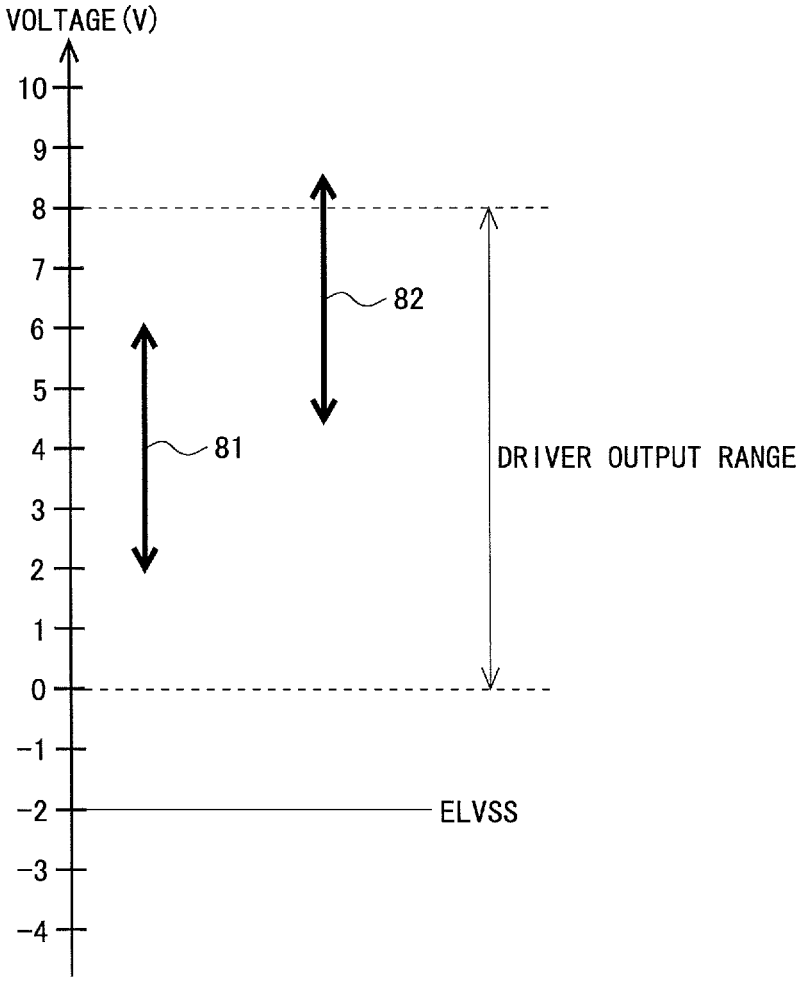
FIG. 24 is a diagram for describing a method for adjusting the low-level power supply voltage.
Figure 25:
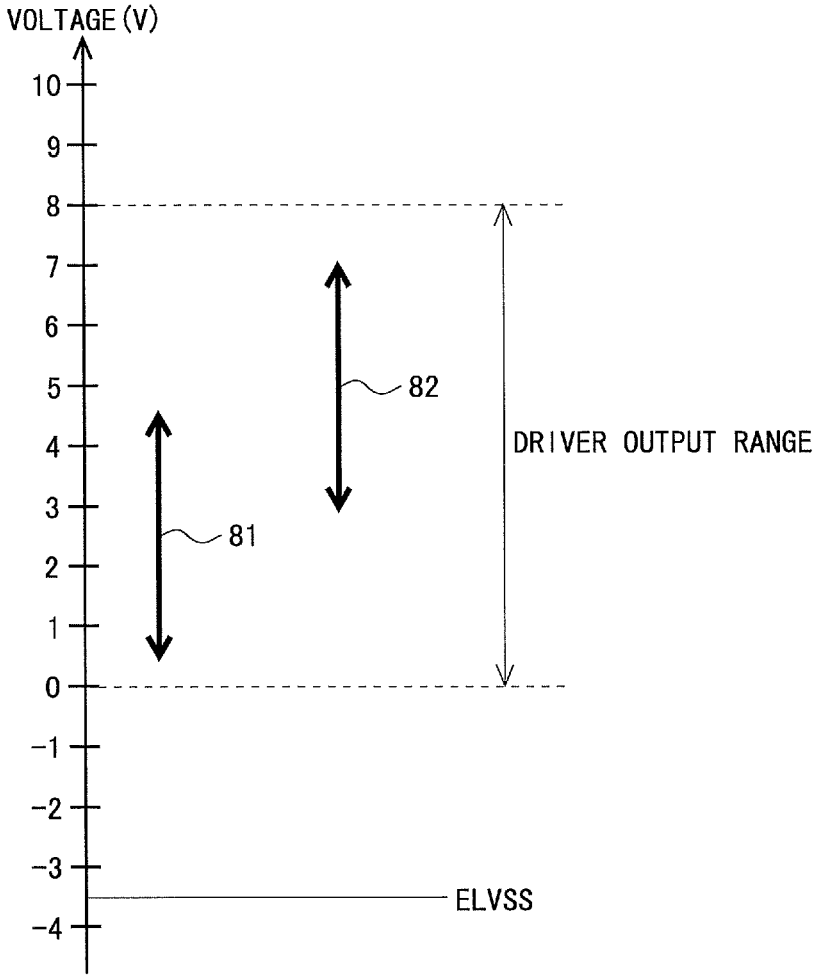
FIG. 25 is a diagram for describing a method for adjusting the low-level power supply voltage.

In the above-described case, when the value of the low-level power supply voltage ELVSS is set, at point in time tb, to a value lower by a value corresponding to the maximum value of the calculated values of change of all pixels than a value at the initial point in time (see the first variant), the grayscale voltage range at the minimum shift pixel is 0.5 V to 4.5 V, and the grayscale voltage range at the maximum shift pixel is 3 V to 7 V, as shown in FIG. 19. In addition, in the above-described case, when the value of the low-level power supply voltage ELVSS is set, at point in time tb, to a value lower by a value corresponding to the average value of the calculated values of change of all pixels than a value at the initial point in time (see the embodiment), the grayscale voltage range at the minimum shift pixel is 2 V to 6 V, as shown in FIG. 20, and the grayscale voltage range at the maximum shift pixel is 4.5 V to 8.5 V. Furthermore, in the above-described case, when the value of the low-level power supply voltage ELVSS is set, at point in time tb, to a value lower by a value corresponding to the minimum value of the calculated values of change of all pixels than a value at the initial point in time (see the second variant), the grayscale voltage range at the minimum shift pixel is 3 V to 7 V, and the grayscale voltage range at the maximum shift pixel is 5.5 V to 9.5 V, as shown in FIG. 21.

Here, it is assumed that the driver output range is 1 V to 10 V. At this time, when the value of the low-level power supply voltage ELVSS is adjusted at point in time tb based on the average value of the calculated values of change of all pixels, a grayscale failure does not occur in both the minimum shift pixel and the maximum shift pixel, as can be grasped from FIG. 22. On the other hand, when the value of the low-level power supply voltage ELVSS is adjusted at point in time tb based on the maximum value of the calculated values of change of all pixels, a grayscale failure occurs in a low-grayscale portion in the minimum shift pixel, as can be grasped from FIG. 23.

In addition, it is assumed that the driver output range is 0 V to 8 V. At this time, when the value of the low-level power supply voltage ELVSS is adjusted at point in time tb based on the average value of the calculated values of change of all pixels, a grayscale failure occurs in a high-grayscale portion in the maximum shift pixel, as can be grasped from FIG. 24. On the other hand, when the value of the low-level power supply voltage ELVSS is adjusted at point in time tb based on the maximum value of the calculated values of change of all pixels, a grayscale failure does not occur in both the minimum shift pixel and the maximum shift pixel, as can be grasped from FIG. 25.

As can be grasped from the above, an optimal manner for adjusting the value of the low-level power supply voltage ELVSS varies depending on the average value of the calculated values of change of all pixels, the maximum value of the calculated values of change of all pixels, the minimum value of the calculated values of change of all pixels, the driver output range, and the grayscale voltage width.

Hence, in the present variant, the value of a controlled low-level power supply voltage ELVSS is set to a value lower, by a voltage value that is determined based on a relationship among the average value of the calculated values of change of all pixels, the maximum value of the calculated values of change of all pixels, the minimum value of the calculated values of change of all pixels, the driver output range, and the grayscale voltage width, than a value at the initial point in time.

Note that it is considered that when the value of the low-level power supply voltage ELVSS is adjusted based on the mini mum value of the calculated values of change of all pixels, the grayscale voltage range is wholly lowered only slightly. Therefore, the value of a controlled low-level power supply voltage ELVSS may be set to a value lower, by a voltage value that is determined based on a relationship among the average value of the calculated values of change of all pixels, the maximum value of the calculated values of change of all pixels, the driver output range, and the grayscale voltage width, than a value at the initial point in time.

In addition, when one of the average value of the calculated values of change for all pixels, the average value of the maximum value and minimum value of the calculated values of change for all pixels, and the median of the calculated values of change for all pixels is defined as a representative value, the value of a controlled low-level power supply voltage ELVSS may be set to a value lower, by a voltage value that is determined based on a relationship among the representative value, the maximum value of the calculated values of change of all pixels, the minimum value of the calculated values of change of all pixels, the driver output range, and the grayscale voltage width, than a value at the initial point in time. Furthermore, the value of a controlled low-level power supply voltage ELVSS may be set to a value lower, by a voltage value that is determined based on a relationship among the representative value, the maximum value of the calculated values of change of all pixels, the driver output range, and the grayscale voltage width, than a value at the initial point in time.

Moreover, for a technique for preventing the occurrence of a grayscale failure, it is considered to set, at an initial point in time, the upper limit and lower limit of a grayscale voltage range to values that are somewhat far from the upper limit and lower limit of a driver output range, respectively, or to adjust the value of the low-level power supply voltage ELVSS at time intervals at which the spread of a difference between the maximum value and minimum value of the magnitudes of threshold shifts can be suppressed.

<5.5 Fifth Variant>

In the embodiment, a calculated value of change (an amount of change in threshold voltage) for determining the value of the low-level power supply voltage ELVSS is found based on a difference between a threshold voltage at an initial point in time (the sum of the value of a threshold voltage of a transistor T2 and the value of a threshold voltage of an organic EL element OLED) and a threshold voltage at a point in time of characteristic detection. However, the present invention is not limited thereto. A dummy pixel that is maintained in a non-lighting state may be provided in a panel, and a calculated value of change for determining the value of the low-level power supply voltage ELVSS may be found based on a difference between a threshold voltage that is found based on the results of characteristic detection and a threshold voltage of circuit elements (a transistor and an organic EL element) in the dummy pixel.

Figure 26:
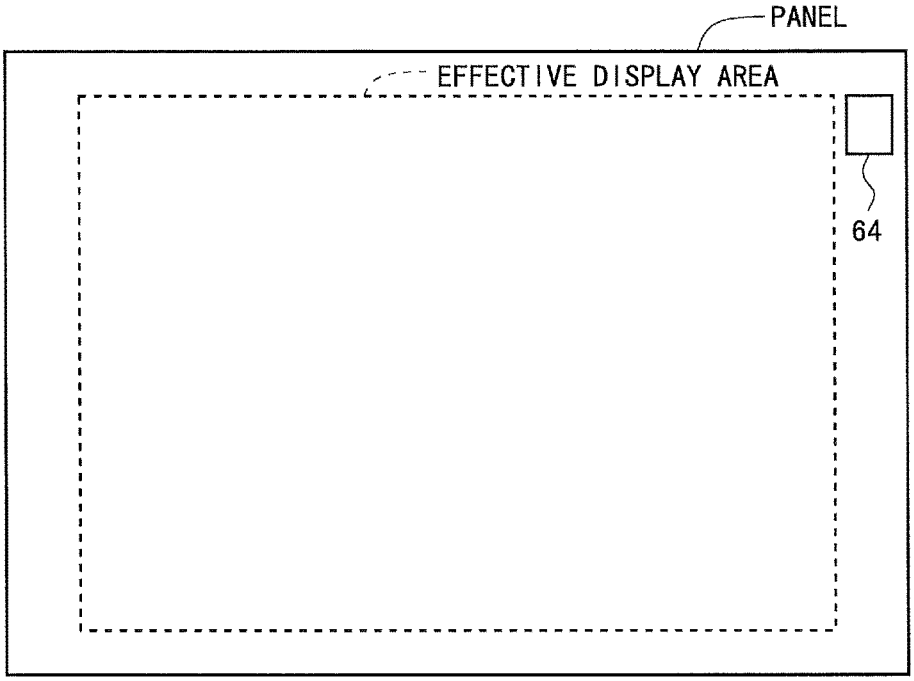
FIG. 26 is a diagram for describing a dummy pixel in a fifth variant of the embodiment.

In the present variant, a dummy pixel 64 is provided in an area outside an effective display area within a panel as shown in FIG. 26. In the dummy pixel, a transistor and an organic EL element, drive operation of which is not performed, are provided as dummy circuit elements. Then, the control circuit 20 finds, for each pixel, a calculated value of change of the transistor T2, based on a difference between a threshold voltage of the transistor T2 that is found based on the result of TFT characteristic detection and a threshold voltage of the transistor in the dummy pixel. In addition, the control circuit 20 finds, for each pixel, a calculated value of change of the organic EL element OLED, based on a difference between a threshold voltage of the organic EL element OLED that is found based on the result of OLED characteristic detection and a threshold voltage of the organic EL element in the dummy pixel.

Meanwhile, degradation of the dummy circuit elements can be considered to be caused by an environment such as temperature. On the other hand, degradation of the circuit elements in the effective display area (active area) includes one caused by lighting in addition to one caused by an environment. By the above, it is possible to separately consider degradation of the circuit elements in the effective display area caused by an environment and caused by lighting. Then, by adjusting the value of the low-level power supply voltage ELVSS using calculated values of change that are found in the above-described manner, and correcting video signals based, on the results of characteristic detection, even when a panel's periphery condition or environment condition has been changed from an initial point in time, degradation of the circuit elements can be effectively compensated for without causing a grayscale failure.

<5.6 Sixth Variant>

In the embodiment, the threshold voltages of circuit elements (a transistor T2 and an organic EL, element OLED) are found based on the results of detection of characteristics of the circuit elements, and calculated values of change are found based on the found threshold voltages. However, the present invention is not limited thereto, and calculated values of change may be found based on a temperature.

Figure 27:
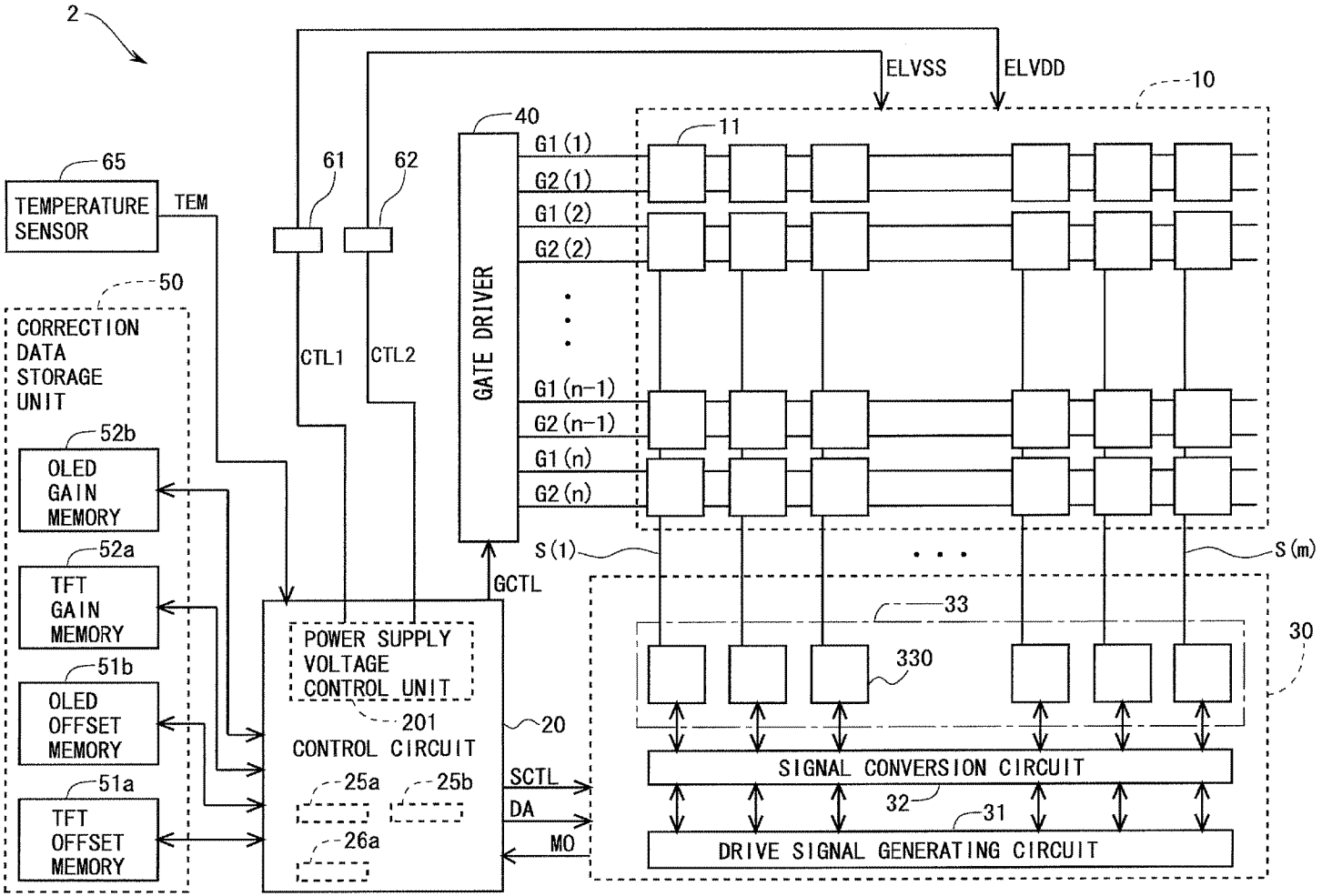
FIG. 27 is a block diagram showing an overall configuration of an organic EL display device in a sixth variant of the embodiment.

FIG. 27 is a block diagram showing an overall configuration of an organic EL display device 2 in the present variant. The organic EL display device 2 is provided with a temperature sensor (temperature detecting unit) 65, in addition to the components in the embodiment. In addition, the control circuit 20 is provided with three lookup tables (a TFT temperature-threshold voltage correspondence table 25*a*, an OLED temperature-threshold voltage correspondence table 25*b*, and a TFT temperature-mobility correspondence table 26).

The temperature sensor 65 detects a temperature. A detected temperature TEM obtained by the temperature sensor 65 is provided to the control circuit 20. FIG. 28 is a schematic diagram showing a configuration of the TFT temperature-threshold voltage correspondence table 25*a*. As shown in FIG. 28, the TFT temperature-threshold voltage correspondence table 25*a* stores correspondences between temperature and the threshold voltage of the transistor. Likewise, the OLED temperature-threshold voltage correspondence table 25*b* stores correspondences between temperature and the threshold voltage of the organic EL element. FIG. 29 is a schematic diagram showing a configuration of the TFT temperature-mobility correspondence table 26. As shown in FIG. 29, the TFT temperature-mobility correspondence table 26 stores correspondences between temperature and the mobility of the transistor.

In a configuration such as that described above, the control circuit 20 obtains a threshold voltage of the transistor T2 and a threshold voltage of the organic EL element OLED, based on the detected temperature TEM obtained by the temperature sensor 65. Furthermore, the control circuit 20 finds a magnitude of a threshold shift of the transistor T2 and a magnitude of a threshold shift of the organic EL element OLED, based on the threshold voltage of the transistor T2 and the threshold voltage of the organic EL element OLED which are obtained in the above-described manner. Then, when the value of the low-level power supply voltage ELVSS at an initial point in time is $V_{(ELVSS)(0)}$, the magnitude of the threshold shift of the transistor T2 is $\Delta Vth_{(TFT)}$, and the magnitude of the threshold shift of the organic EL element OLED is $\Delta Vth_{(OLED)}$, the value $V_{(ELVSS)}$ of a controlled low-level power supply voltage ELVSS is found by the following equation (19):

$$V_{(ELVSS)}=V_{(ELVSS)(0)}-\Delta Vth_{(TFT)}-\Delta Vth_{(OLED)} \quad (19)$$

Then, the value of the low-level power supply voltage ELVSS is set to the value found by the above equation (19).

In addition, the control circuit 20 obtains a mobility of the transistor T2, based on the detected temperature TEM obtained by the temperature sensor 65. Then, using the mobility, the value of the high-level power supply voltage ELVDD is adjusted in the same manner as in the embodiment.

According to the present variant, the value of the low-level power supply voltage ELVSS and the value of the high-level power supply voltage ELVDD can be adjusted without performing detection of TFT characteristics or detection of OLED characteristics.

<5.7 Seventh Variant>

Figure 30:
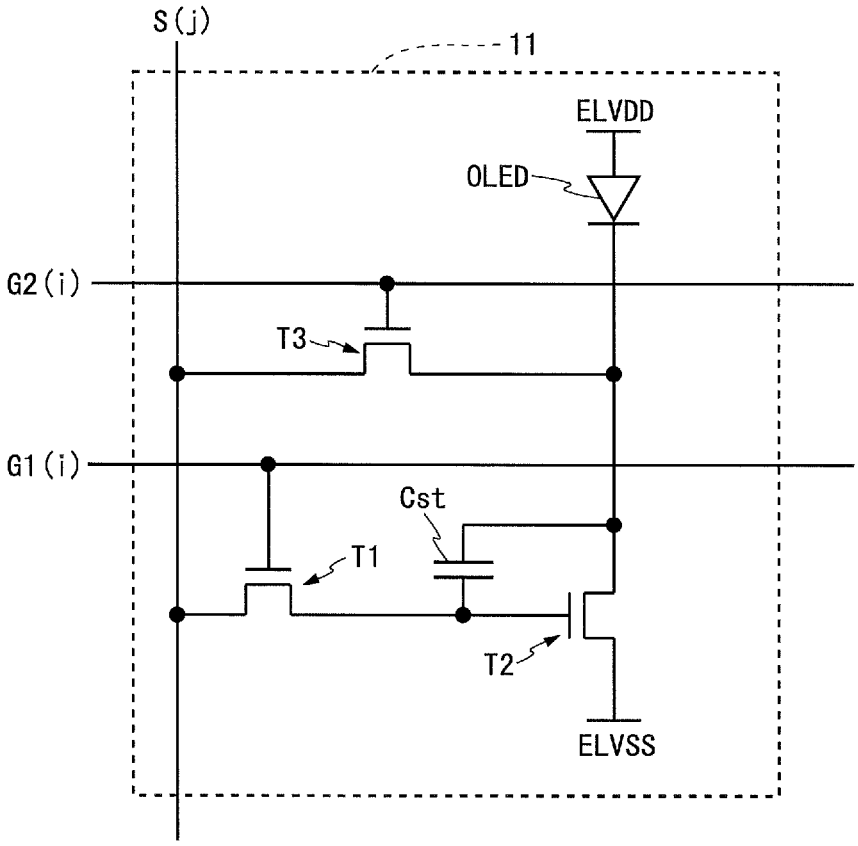
FIG. 30 is a circuit diagram showing a configuration of a pixel circuit in a seventh variant of the embodiment.

Although in the embodiment the pixel circuits 11 of the configuration shown in FIG. 6 are adopted, the present invention is not limited thereto. FIG. 30 is a circuit diagram showing a configuration of a pixel circuit 11 in the present variant. A transistor T1 is provided between a data line S(j) and a gate terminal of a transistor T2. The transistor T1 is connected at its gate terminal to a scanning line G1(*i*) and connected at its source terminal to the data line S(j). The transistor T2 is provided in series with an organic EL element OLED. The transistor T2 is connected at its gate terminal to a drain terminal of the transistor T, connected at its drain terminal to a cathode terminal (cathode) of the organic EL element OLED, and connected at its source terminal to a low-level power supply line ELVSS. A transistor T3 is connected at its gate terminal to a monitoring control line G2(*i*), connected at its drain terminal to the cathode terminal of the organic EL element OLED, and connected at its source terminal to the data line S(j) A capacitor Cst is connected at its one end to the gate terminal of the transistor T2 and connected at its other end to the drain terminal of the transistor T2. An anode terminal (anode) of the organic EL element OLED is connected to a high-level power supply line ELVDD.

Figure 31:
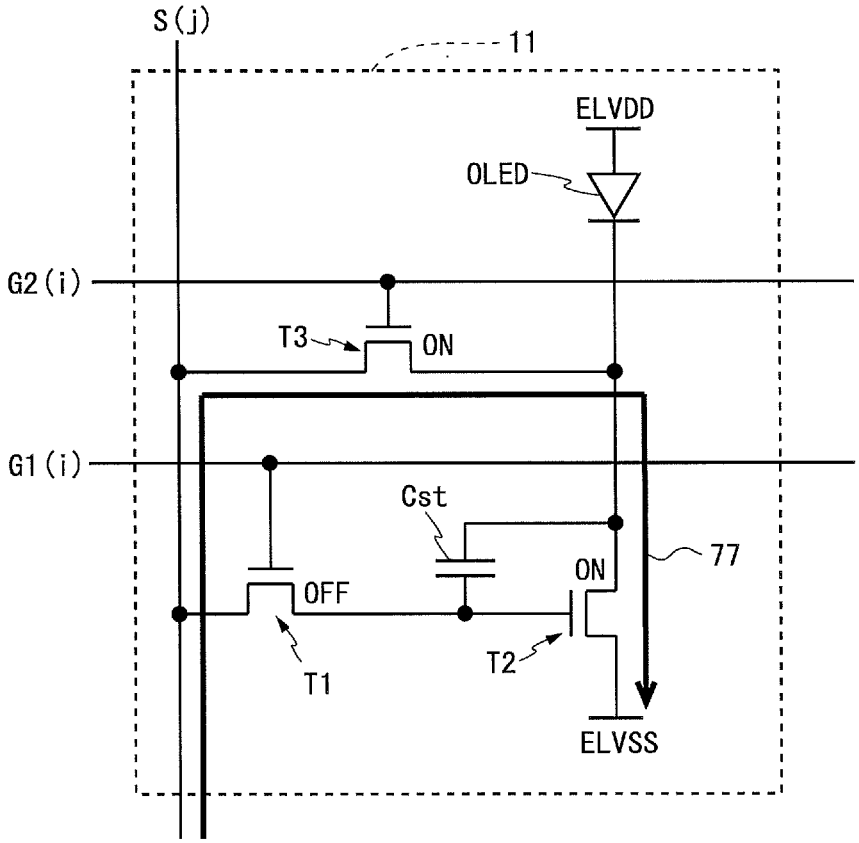
FIG. 31 is a diagram for describing the flow of a current during a TFT characteristic detection period in the seventh variant of the embodiment.
Figure 32:
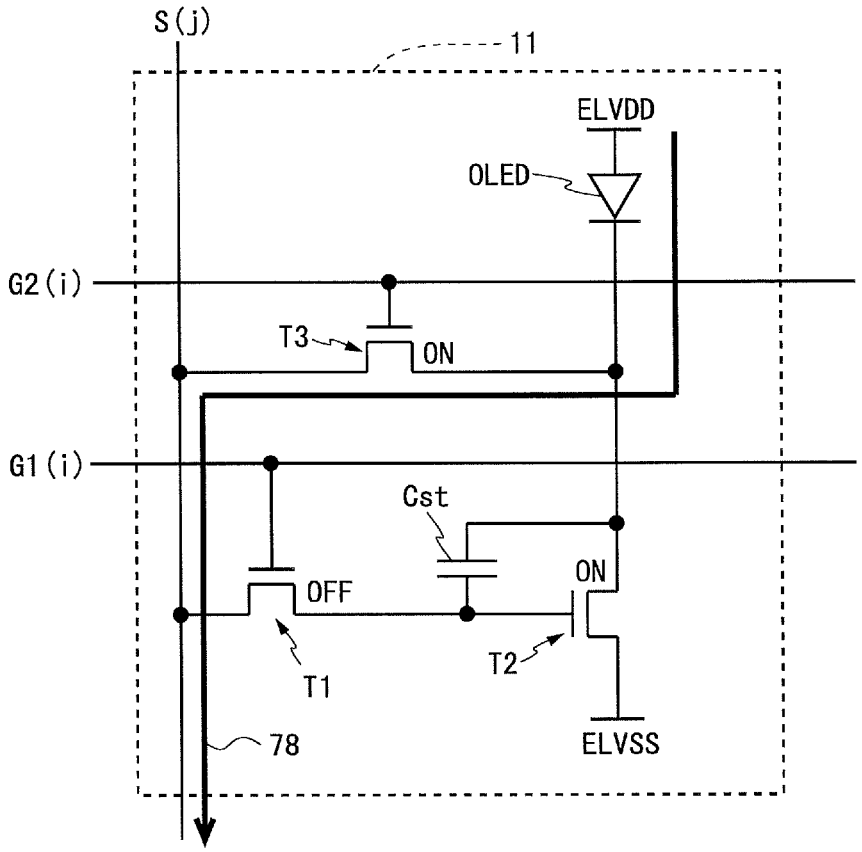
FIG. 32 is a diagram for describing the flow of a current during an OLED characteristic detection period in the seventh variant of the embodiment.

In a configuration such as that described above, by setting the value of a potential Vmg, the value of a potential Vm_TFT, and the value of a potential Vm_oled such that a current flows in a manner indicated by an arrow denoted by reference character 77 in FIG. 31 during a TFT characteristic detection period (see Tb of FIG. 8) and a current flows in a manner indicated by an arrow denoted by reference character 78 in FIG. 32 during an OLED characteristic detection period (see Tc of FIG. 8), TFT characteristics and OLED characteristics are detected. Then, in the same manner as in the embodiment, the value of the low-level power supply voltage ELVSS and the value of the high-level power supply voltage ELVDD are controlled. Specifically, the value of the low-level power supply voltage ELVSS is found by the above equation (11), and the value of the high-level power supply voltage ELVDD is found to satisfy the above expression (16). Note that as in the embodiment, the value of the low-level power supply voltage ELVSS may be found by the above equation (12) or the above equation (13).

As described above, even when the pixel circuits 11 of the configuration shown in FIG. 30 are adopted, the same effects as those obtained in the embodiment can be obtained.

<5.8 Eighth Variant>

Figure 33:
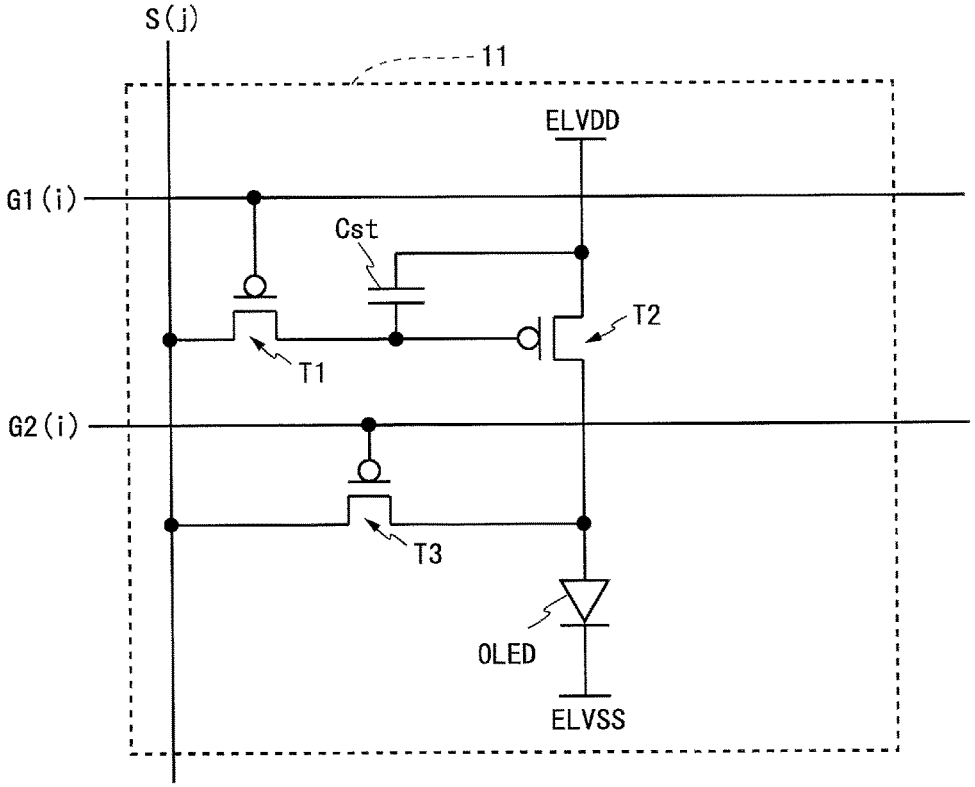
FIG. 33 is a circuit diagram showing a configuration of a pixel circuit in an eighth variant of the embodiment.

In the embodiment, the transistors T1 to T3 in the pixel circuit 11 are of an n-channel type. However, the present invention is not limited thereto, and p-channel transistors can also be adopted as the transistors T1 to T3 in the pixel circuit 11. FIG. 33 is a circuit diagram showing a configuration of a pixel circuit 11 in the present variant. The configuration in the present variant is the same as that in the embodiment (see FIG. 6) except that the transistors T1 to T3 are of a p-channel type.

Figure 34:
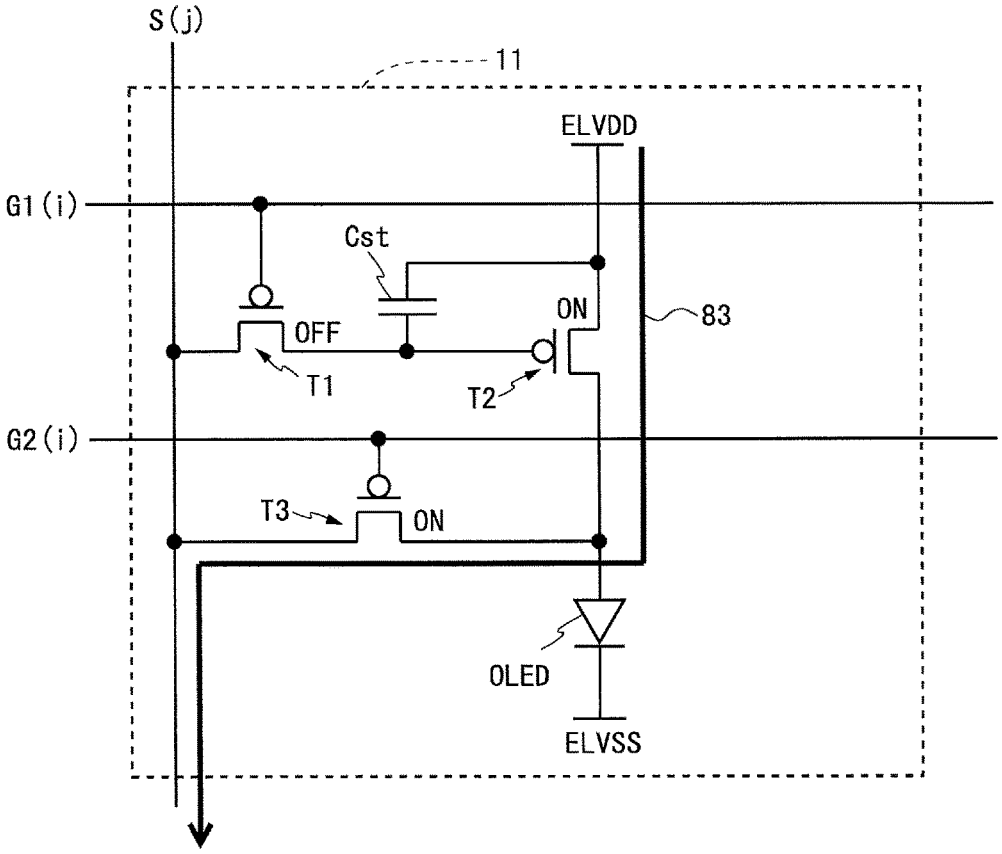
FIG. 34 is a diagram for describing the flow of a current during a TFT characteristic detection period in the eighth variant of the embodiment.
Figure 35:
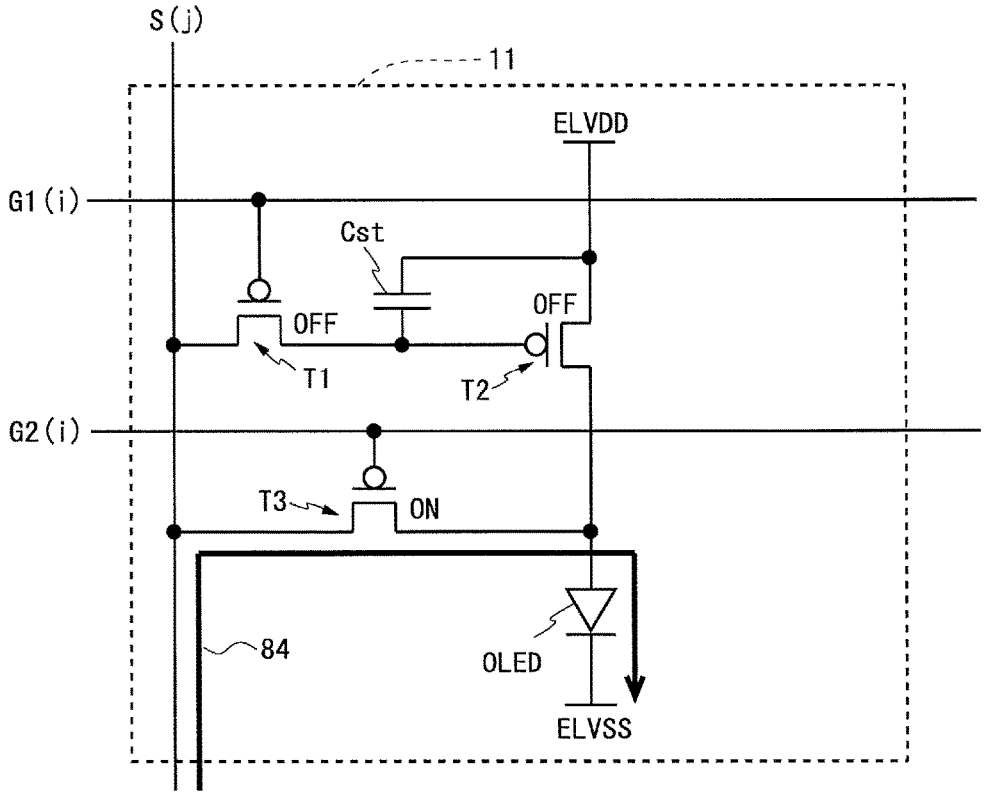
FIG. 35 is a diagram for describing the flow of a current during an OLED characteristic detection period in the eighth variant of the embodiment.

In the present variant, by setting the value of a potential Vmg, the value of a potential Vm_TFT, and the value of a potential Vm_oled such that a current flows in a manner indicated by an arrow denoted by reference character 83 in FIG. 34 during a TFT characteristic detection period (see Tb of FIG. 8) and a current flows in a manner indicated by an arrow denoted by reference character 84 in FIG. 35 during an OLED characteristic detection period (see Tc of FIG. 8), TFT characteristics and OLED characteristics are detected.

In the present variant, the value of the high-level power supply voltage ELVDD is found using an average value of calculated values of change (magnitudes of threshold shifts) for the transistors T2 (drive transistors) and an average value of calculated values of change (magnitudes of threshold shifts) for the organic EL elements OLED. Specifically, when the value of the high-level power supply voltage ELVDD at an initial point in time is $V_{(ELVDD)(0)}$, the average value of calculated values of change for the transistors T2 is $\Delta Vth_{(TFT)(AVE)}$, and the average value of calculated values of change for the organic EL elements OLED is $\Delta Vth_{(OLED)(AVE)}$, the $V_{(ELVDD)}$ of a controlled high-level power supply voltage ELVDD is found by the following equation (20):

$$V_{(ELVDD)}=V_{(ELVDD)(0)}+\Delta Vth_{(TFT)(AVE)}+\Delta Vth_{(OLED)(AVE)} \quad (20)$$

Note that the value of the high-level power supply voltage ELVDD may be found based on the magnitudes of threshold shifts of only the transistors T2 as shown in the following equation (21), or the value of the high-level power supply voltage ELVDD may be found based on the magnitudes of threshold shifts of only the organic EL elements OLED as shown in the following equation (22):

$$V_{(ELVDD)}=V_{(ELVDD)(0)}+\Delta Vth_{(TFT)(AVE)} \quad (21)$$

$$V_{(ELVDD)}=V_{(ELVDD)(0)}+\Delta Vth_{(OLED)(AVE)} \quad (22)$$

In addition, in the present variant, an average value of gains of all pixels in the display unit 10 is used as a value for controlling the value of the low-level power supply voltage ELVSS. Specifically, when the value of the high-level power supply voltage ELVDD at an initial point in time is $V_{(ELVDD)(0)}$, the maximum value of voltages applied between the anodes and cathodes of the organic EL elements OLED is Voled, and the maximum value of overdrive voltages (differences between gate-source voltages and threshold voltages) of the transistors T2 is "Vgs−Vth", the value $V_{(ELVSS)}$ of a controlled low-level power supply voltage ELVSS is found to satisfy the following expression (23). Note that Vgs and Vth are absolute values.

$$V_{(ELVSS)}<V_{(ELVDD)}-Voled-(Vgs-Vth) \quad (23)$$

The above expression (23) is an expression representing a condition that satisfies a saturated state.

As described above, when the transistors T2 operate in saturation region, the above equation (15) holds true for the overdrive voltage "Vgs−Vth" of the transistors T2. Here, a minimum value of gains of all pixels for the transistors T2 is substituted into β of the above equation (15). The value of "Vgs−Vth" obtained thereby is substituted into "Vgs−Vth" of the above expression (23). That is, it may be considered that the value $V_{(ELVSS)}$ of a controlled low-level power supply voltage ELVSS is found to satisfy the following expression (24):

$$V_{(ELVSS)}<V_{(ELVDD)}-Voled-(2\times Ioled/\beta)^{1/2} \quad (24)$$

Note that when detection of mobilities (gains) is not performed, the value of the high-level power supply voltage ELVDD may be changed in the same direction as a direction in which the value of the low-level power supply voltage changes and by the same value as the changed value of the low-level power supply voltage.

In the present variant, the value of the high-level power supply voltage ELVDD and the value of the low-level power supply voltage ELVSS are controlled in the above-described manner. By this, even when the pixel circuits 11 of the configuration shown in FIG. 33 are adopted, the same effects as those obtained in the embodiment can be obtained.

Note that when the pixel circuits 11 of the configuration shown in FIG. 33 are adopted, the value of the high-level power supply voltage ELVDD may be adjusted based on a maximum value of the calculated values of change of all pixels (see the second variant). Specifically, when the value of the high-level power supply voltage ELVDD at an initial point in time is $V_{(ELVDD)(0)}$ the maximum value of calculated values of change for the transistors T2 (drive transistors) is $\Delta Vth_{(TFT)(MAX)}$, and the maximum value of calculated values of change for the organic EL elements OLED is*j* $\Delta Vth_{(OLED)(MAX)}$, *the value* $V_{(ELVDD)}$ *of a controlled high-level power supply voltage* ELVDD *may be found by the following equation* (25):

$$V_{(ELVDD)}=V_{(ELVDD)(0)}+\Delta Vth_{(TFT)(MAX)}+\Delta Vth_{(OLED)(MAX)} \quad (25)$$

In addition, when the pixel circuits 11 of the configuration shown in FIG. 33 are adopted, the value of the high-level power supply voltage ELVDD may be adjusted based on a minimum value of the calculated values of change of all pixels (see the third variant). Specifically, when the value of the high-level power supply voltage ELVDD at an initial point in time is $V_{(ELVDD)(0)}$, the minimum value of calculated values of change for the transistors T2 (drive transistors) is $\Delta Vth_{(TFT)(MIN)}$, and the minimum value of calculated values of change for the organic EL elements OLED is $\Delta Vth_{(OLED)(MIN)}$, the value $V_{(ELVDD)}$ of a controlled high-level power supply voltage ELVDD may be found by the following equation (26):

$$V_{(ELVDD)}=V_{(ELVDD)(0)}+\Delta Vth_{(TFT)(MIN)}+\Delta Vth_{(OLED)(MIN)} \quad (26)$$

<6. Others>

The present invention is not limited to the above-described embodiment and variants and may be implemented by making various modifications thereto without departing from the true scope and spirit of the present invention. In addition, a configuration where the first to eighth variants are combined together as appropriate can also be adopted. For example, while the pixel circuits 11 in the seventh variant are adopted, the value of the low-level power supply voltage ELVSS may be adjusted in the manner described in the first variant.

DESCRIPTION OF REFERENCE CHARACTERS

1 and 2: ORGANIC EL DISPLAY DEVICE
10: DISPLAY UNIT
11: PIXEL CIRCUIT
20: CONTROL CIRCUIT
30: SOURCE DRIVER
40: GATE DRIVER
50: CORRECTION DATA STORAGE UNIT
61: ORGANIC EL HIGH-LEVEL POWER SUPPLY
62: ORGANIC EL LOW-LEVEL POWER SUPPLY
65: TEMPERATURE SENSOR
201: POWER SUPPLY VOLTAGE CONTROL UNIT
330: OUTPUT AND CURRENT-MONITORING CIRCUIT
T1 to T3: TRANSISTOR
Cst: CAPACITOR
OLED: ORGANIC EL ELEMENT
G1(1) to G1(*n*): SCANNING LINE
G2(1) to G2(*n*): MONITORING CONTROL LINE
S(1) to S(m): DATA LINE
ELVDD: HIGH-LEVEL POWER SUPPLY VOLTAGE AND HIGH-LEVEL POWER SUPPLY LINE
ELVSS: LOW-LEVEL POWER SUPPLY VOLTAGE AND LOW-LEVEL POWER SUPPLY LINE

The invention claimed is:

1. A display device including a plurality of pixel circuits, each including an electrooptical element whose luminance is controlled by a current, and a drive transistor configured to control a current to be supplied to the electrooptical element, the display device comprising:

a plurality of data lines configured to supply data voltages for grayscale display to the plurality of pixel circuits;

a data line drive circuit configured to apply the data voltages to the plurality of data lines;

an amount-of-characteristic-change obtaining unit configured to find an amount of change in characteristic of a target circuit element; at least either one of the drive transistor and the electrooptical element serving as the target circuit element; and a power supply voltage control unit configured to control at least a value of a first power supply voltage, the first power supply voltage being one of a first-level voltage and a second-level voltage, and the first-level voltage and the second-level voltage being supplied to the plurality of pixel circuits, wherein in each of the plurality of pixel circuits, a data voltage supplied by a corresponding data line is provided to a control terminal of the drive transistor, the second-level voltage is provided to a first conduction terminal of the drive transistor, a second conduction terminal of the drive transistor is connected to one electrode of the electrooptical element, and the first-level voltage is provided to an other electrode of the electrooptical element, the power supply voltage control unit controls the value of the first power supply voltage, depending on the amount of change found by the amount-of-characteristic-change obtaining unit, and the data voltage is generated by correcting a video signal transmitted from an external source, depending on the amount of change found by the amount-of-characteristic-change obtaining unit.

2. The display device according to claim 1, wherein both the drive transistor and the electrooptical element serve as the target circuit element, and the data voltage is found by the following equation:

$$V\text{data}=Vc*B1*B2+Vt1+Vt2-\Delta V$$

where Vdata is the data voltage, Vc is a voltage of the video signal after gamma correction, B1 is a gain value corresponding to a mobility of the drive transistor, B2 is a degradation correction factor of the electrooptical element, Vt1 is an offset value corresponding to a threshold voltage of the drive transistor, Vt2 is an offset value corresponding to a threshold voltage of the electrooptical element, and ΔV is a difference between the value of the first power supply voltage at an initial point in time and the value of the first power supply voltage at a point in time when the video signal is corrected.

3. The display device according to claim 1, wherein both the drive transistor and the electrooptical element serve as the target circuit element, and the data voltage is found by the following equation:

$$V\text{data}=Z(Vc*B1*B2+Vt1+Vt2-\Delta V)$$

where Vdata is the data voltage, Z is a factor for compensating for attenuation of the data voltage, Vc is a voltage of the video signal after gamma correction, B1 is a gain value corresponding to a mobility of the drive transistor, B2 is a degradation correction factor of the electrooptical element, Vt1 is an offset value corresponding to a threshold voltage of the drive transistor, Vt2 is an offset value corresponding to a threshold voltage of the electrooptical element, and ΔV is a difference between the value of the first power supply voltage at an initial point in time and the value of the first power supply voltage at a point in time when the video signal is corrected.

4. The display device according to claim 1, wherein the first power supply voltage is the first-level voltage.

5. The display device according to claim 1, wherein the amount-of-characteristic-Change obtaining unit finds an amount of change in threshold voltage of the drive transistor, as the amount of change in characteristic of the target circuit element.

6. The display device according to claim 1, wherein the amount-of-characteristic-Change obtaining unit finds an amount of change in threshold voltage of the electrooptical element, as the amount of change in characteristic of the target circuit element.

7. The display device according to claim 1, wherein when one of the first-level voltage and the second-level voltage that is different than the first power supply voltage is defined as a second power supply voltage, the power supply voltage control unit controls a value of the second power supply voltage, depending on the amount of change found by the amount-of-characteristic-change obtaining unit.

8. The display device according to claim 7, wherein the power supply voltage control unit controls the value of the second power supply voltage, depending on an average value of the amount of change for all of the plurality of pixel circuits, the amount of change being found by the amount-of-characteristic-change obtaining unit.

9. The display device according to claim 1, wherein the drive transistor is a thin film transistor using an oxide semiconductor for a channel layer.

10. The display device according to claim 1, further comprising a mobility obtaining unit configured to find a mobility of the drive transistor, wherein when one of the first-level voltage and the second-level voltage that is different than the first power supply voltage is defined as a second power supply voltage, the power supply voltage control unit controls a value of the second power supply voltage, depending on the mobility found by the mobility obtaining unit.

11. The display device according to claim 10, wherein the power supply voltage control unit controls a value V2 of the second power supply voltage to satisfy a following expression A when the value V2 of the second power supply voltage is larger than a value V1 of the first power supply voltage, and controls the value V2 of the second power supply voltage to satisfy a following expression B when the value V2 of the second power supply voltage is smaller than the value V1 of the first power supply voltage:

$$V2>V1+V\text{max}+(2\times I\text{max}/\beta)^{1/2} \quad (A)$$

$$V2<V1-V\text{max}-(2\times I\text{max}/\beta)^{1/2} \quad (B)$$

where Vmax is a maximum value of voltages applied between the one electrode and other electrode of the electrooptical element, Imax is a maximum value of currents flowing between the one electrode and other electrode of the electrooptical element, and β is a gain value proportional to the mobility found by the mobility obtaining unit.

12. A display device including a plurality of pixel circuits, each including an electrooptical element whose luminance is controlled by a current, and a drive transistor configured to control a current to be supplied to the electrooptical element, the display device comprising:

a plurality of data lines configured to supply data voltages for grayscale display to the plurality of pixel circuits;

a data line drive circuit configured to apply the data voltages to the plurality of data lines;

an amount-of-characteristic-change obtaining unit configured to find an amount of change in characteristic of a target circuit element, at least either one of the drive transistor and the electrooptical element serving as the target circuit element;

a power supply voltage control unit configured to control at least a value of a first power supply voltage, the first power supply voltage being one of a first-level voltage and a second-level voltage, and the first-level voltage and the second-level voltage being supplied to the plurality of pixel circuits; and a temperature detecting unit configured to detect a temperature, wherein in each of the plurality of pixel circuits, a data voltage supplied by a corresponding data line is provided to a control terminal of the drive transistor, the second-level voltage is provided to a first conduction terminal of the drive transistor, a second conduction terminal of the drive transistor is connected to one electrode of the electrooptical element, and the first-level voltage is provided to an other electrode of the electrooptical element, the amount-of-characteristic-change obtaining unit finds the amount of change in characteristic of the target circuit element, based on a temperature detected by the temperature detecting unit, and the power supply voltage control unit controls the value of the first power supply voltage, depending on the amount of change found by the amount-of-characteristic-change obtaining unit.

13. The display device according to claim 12, wherein the characteristic is either a threshold voltage of the drive transistor or a threshold voltage of the electrooptical element.

14. The display device according to claim 13, wherein the power supply voltage control unit controls the value of the first power supply voltage depending on the amount of change of the threshold voltage, the amount of change being found by the amount-of-characteristic-change obtaining unit.

15. The display device according to claim 12, wherein the characteristic is a mobility of the drive transistor.

16. The display device according to claim 15, wherein when one of the first-level voltage and the second-level voltage that is different than the first power supply voltage is defined as a second power supply voltage, the power supply voltage control unit controls a value of the second power supply voltage depending on the amount of change of the mobility, the amount of change being found by the amount-of-characteristic-change obtaining unit.

* * * * *